US007413020B2

(12) United States Patent
Carter et al.

(10) Patent No.: US 7,413,020 B2
(45) Date of Patent: Aug. 19, 2008

(54) FULL BORE LINED WELLBORES

(75) Inventors: Thurman B. Carter, Houston, TX (US); David J. Brunnert, Houston, TX (US); David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 460 days.

(21) Appl. No.: 10/794,790

(22) Filed: Mar. 5, 2004

(65) Prior Publication Data

US 2004/0244992 A1 Dec. 9, 2004

Related U.S. Application Data

(60) Provisional application No. 60/451,994, filed on Mar. 5, 2003, provisional application No. 60/452,269, filed on Mar. 5, 2003.

(51) Int. Cl.
*E21B 7/20* (2006.01)
*E21B 43/10* (2006.01)

(52) U.S. Cl. ..... 166/380; 166/207; 166/50; 175/171; 175/402

(58) Field of Classification Search ..... 166/50, 166/207, 313, 380; 175/171, 402
See application file for complete search history.

(56) References Cited

U.S. PATENT DOCUMENTS

| | | | |
|---|---|---|---|
| 122,514 | A | 1/1872 | Bullock |
| 761,518 | A | 5/1904 | Lykken |
| 1,077,772 | A | 11/1913 | Weathersby |
| 1,185,582 | A | 5/1916 | Bignell |
| 1,301,285 | A | 4/1919 | Leonard |

(Continued)

FOREIGN PATENT DOCUMENTS

| | | |
|---|---|---|
| CA | 2 335 192 | 11/2001 |

(Continued)

OTHER PUBLICATIONS

PCT Invitation to Pay Fees, International Application No. PCT/US2004/006749, dated Aug. 19, 2004.

(Continued)

*Primary Examiner*—Shane Bomar
(74) *Attorney, Agent, or Firm*—Patterson & Sheridan, L.L.P.

(57) ABSTRACT

Embodiments of the present invention generally provide methods and apparatus for forming a tubular-lined wellbore which does not decrease in diameter with increasing depth or length. Methods and apparatus for forming a substantially monobore well while drilling with casing are provided. In one aspect, a portion of a second casing is expanded into a portion of a first casing having a larger inner diameter than the remaining portion of the first casing string. In another aspect, the portion of the second casing is expanded into a portion of the first casing having a compressible member therearound. In another aspect, a lined lateral wellbore may be constructed by forming a lateral wellbore extending from a main wellbore lined with casing. A diameter of at least a portion of the lateral wellbore may be expanded. An expandable tubular element may be run into lateral wellbore and expanded to have an inner diameter equal to or larger than an inner diameter of the main wellbore casing. Embodiments provide a fluid path around casing before sealing the casing within a wellbore or within a well casing, even after the casing has been hung within the wellbore or from the well casing.

19 Claims, 36 Drawing Sheets

U.S. PATENT DOCUMENTS

| | | | |
|---|---|---|---|
| 1,324,303 | A | 12/1919 | Carmichael |
| 1,342,424 | A | 6/1920 | Cotten |
| 1,418,766 | A | 6/1922 | Wilson |
| 1,459,990 | A | 6/1923 | Reed |
| 1,471,526 | A | 10/1923 | Pickin |
| 1,545,039 | A | 7/1925 | Deavers |
| 1,561,418 | A | 11/1925 | Duda |
| 1,569,729 | A | 1/1926 | Duda |
| 1,585,089 | A | 5/1926 | Youle |
| 1,597,212 | A | 8/1926 | Spengler |
| 1,728,136 | A | 9/1929 | Power |
| 1,777,592 | A | 10/1930 | Thomas |
| 1,825,028 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |
| 1,930,825 | A | 10/1933 | Raymond |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,102,555 | A | 12/1937 | Dyer |
| 2,105,885 | A | 1/1938 | Hinderliter |
| 2,167,338 | A | 7/1939 | Murcell |
| 2,214,226 | A | 9/1940 | English |
| 2,214,429 | A | 9/1940 | Miller |
| 2,216,226 | A | 10/1940 | Bumpous |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,344,120 | A | 3/1944 | Baker |
| 2,345,308 | A | 3/1944 | Wallace |
| 2,370,832 | A | 3/1945 | Baker |
| 2,379,800 | A | 7/1945 | Hare |
| 2,383,214 | A | 8/1945 | Proul |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,696,367 | A | 12/1954 | Robishaw |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,898,971 | A | 8/1959 | Hempel |
| 2,953,406 | A | 9/1960 | Young |
| 2,978,047 | A | 4/1961 | DeVaan |
| 3,001,585 | A | 9/1961 | Shiplet |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,195,646 | A | 7/1965 | Brown |
| 3,273,660 | A | 9/1966 | Jackson et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,467,180 | A | 9/1969 | Pensolti |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,621,910 | A | 11/1971 | Sanford |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,712,376 | A | 1/1973 | Owen et al. |
| 3,729,057 | A | 4/1973 | Wemer |
| 3,746,330 | A | 7/1973 | Taciuk |
| 3,747,675 | A | 7/1973 | Brown |
| 3,760,894 | A | 9/1973 | Pitifer |
| 3,776,307 | A | 12/1973 | Young |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,818,734 | A | 6/1974 | Bateman |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,911,707 | A | 10/1975 | Minakov et al. |
| 3,913,687 | A | 10/1975 | Gyongyosi et al. |
| 3,915,244 | A | 10/1975 | Brown |
| 3,934,660 | A | 1/1976 | Nelson |

3,935,910 A 2/1976 Gaudy et al.
3,945,444 A 3/1976 Knudson
3,947,009 A 3/1976 Nelmark
3,948,321 A 4/1976 Owen et al.
3,964,556 A 6/1976 Gearhart et al.
3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.
4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,182,423 A 1/1980 Ziebarth et al.
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,429,620 A 2/1984 Burkhardt et al.
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,708,202 A 11/1987 Sukup et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,770,259 A 9/1988 Jansson
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,828,050 A 5/1989 Hashimoto
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale 4,848,469 A 7/1989 Baugh et al.
4,854,386 A 8/1989 Baker et al.
4,858,705 A 8/1989 Thiery
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,024,273 A 6/1991 Coone et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,303,772 A 4/1994 George et al.
5,305,830 A 4/1994 Wittrisch
5,305,839 A 4/1994 Kalsi et al.
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,343,968 A 9/1994 Glowka
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tassari et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,462,120 A 10/1995 Gondouin
5,464,062 A 11/1995 Blizzard, Jr.
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,685,373 A 11/1997 Collins et al.
5,697,442 A 12/1997 Baldridge
5,706,894 A 1/1998 Hawkins, III
5,706,905 A 1/1998 Barr 5,711,382 A 1/1998 Hansen et al.
5,717,334 A 2/1998 Vail, III et al.
5,718,288 A 2/1998 Bertet et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A 5/1998 Langford, Jr. et al.
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,791,416 A 8/1998 White et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,890,549 A 4/1999 Sprehe
5,894,897 A 4/1999 Vail, III
5,901,787 A 5/1999 Boyle
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Varcaemer et al.
6,089,323 A 7/2000 Newman et al.
6,098,717 A 8/2000 Bailey et al.
6,106,200 A 8/2000 Mocivnik et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,227,587 B1 5/2001 Terral
6,234,257 B1 5/2001 Ciglenec et al.
6,237,684 B1 5/2001 Bouligny, Jr. et al.
6,244,363 B1 6/2001 McLeod
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,318,457 B1 * 11/2001 Den Boer et al. ..... 166/66.7
6,318,472 B1 11/2001 Rogers et al.
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.

6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,431,282 B1 * 8/2002 Bosma et al. ..... 166/288
6,431,626 B1 8/2002 Bouligny
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,494,272 B1 12/2002 Eppink et al.
6,497,280 B2 12/2002 Beck et al.
6,497,289 B1 12/2002 Cook et al.
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,063 B2 4/2003 Ohmer
6,554,064 B1 4/2003 Restarick et al.
6,561,271 B2 * 5/2003 Baugh et al. ..... 166/285
6,571,868 B2 6/2003 Victor
6,578,630 B2 6/2003 Simpson et al.
6,585,040 B2 7/2003 Hanton et al.
6,585,053 B2 7/2003 Coon
6,591,471 B1 7/2003 Hollingsworth et al.
6,591,905 B2 7/2003 Coon
6,595,288 B2 7/2003 Mosing et al.
6,598,678 B1 7/2003 Simpson et al.
6,612,383 B2 9/2003 Desai et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,640,903 B1 11/2003 Cook et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,399 B2 2/2004 Maguire
6,691,801 B2 2/2004 Juhasz et al.
8,688,398 2/2004 Pietras
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 * 3/2004 Haugen et al. ..... 166/384
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,725,938 B1 4/2004 Pietras
6,732,822 B2 5/2004 Slack et al.
6,742,584 B1 6/2004 Appleton
6,742,591 B2 6/2004 Metcalfe
6,742,596 B2 6/2004 Haugen
6,742,606 B2 6/2004 Metcalfe et al.
6,745,834 B2 6/2004 Davis et al.
6,749,026 B2 * 6/2004 Smith et al. ..... 166/313
6,752,211 B2 6/2004 Dewey et al.
6,758,278 B2 7/2004 Cook et al.
6,802,374 B2 10/2004 Edgar et al.
6,832,658 B2 12/2004 Keast
6,837,313 B2 1/2005 Hosie et al.
6,840,322 B2 1/2005 Haynes
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway
6,883,611 B2 * 4/2005 Smith et al. ..... 166/313
6,892,819 B2 5/2005 Cook et al.
6,920,932 B2 7/2005 Zimmerman
6,920,934 B2 * 7/2005 Badrak et al. ..... 166/381
6,923,255 B2 8/2005 Lee
6,926,126 B2 8/2005 Baumann et al.
6,941,652 B2 9/2005 Echols et al.
6,953,096 B2 10/2005 Gledhill et al.
7,000,695 B2 2/2006 Steele et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,082,997 B2 8/2006 Slack
7,083,005 B2 8/2006 Galloway et al.
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
7,213,654 B2 * 5/2007 Plucheck et al. ..... 166/380
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0045284 A1 11/2001 Simpson et al.
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0145281 A1 10/2002 Metcalfe et al.
2002/0157829 A1 10/2002 Davis et al.
2002/0162690 A1 11/2002 Hanton et al.
2002/0166668 A1 11/2002 Metcalfe et al.
2002/0170720 A1 11/2002 Haugen
2002/0189806 A1 12/2002 Davidson et al.

2002/0189863 A1 12/2002 Wardley
2003/0019639 A1 1/2003 Mackay
2003/0029641 A1 2/2003 Meehan
2003/0034177 A1 2/2003 Chitwood et al.
2003/0037931 A1 2/2003 Coon
2003/0042022 A1 3/2003 Lauritzen et al.
2003/0047320 A1 3/2003 Badrak et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0183424 A1 10/2003 Tulloch
2003/0213598 A1 11/2003 Hughes
2003/0217865 A1 11/2003 Simpson et al.
2003/0221519 A1 12/2003 Haugen et al.
2004/0000405 A1 1/2004 Fournier, Jr. et al.
2004/0003490 A1 1/2004 Shahin et al.
2004/0003944 A1 1/2004 Vincent et al.
2004/0011534 A1 1/2004 Simonds et al.
2004/0011566 A1 1/2004 Lee
2004/0016575 A1 1/2004 Shahin et al.
2004/0060697 A1 4/2004 Tilton et al.
2004/0060700 A1 4/2004 Vert et al.
2004/0069500 A1 4/2004 Haugen
2004/0069501 A1 4/2004 Haugen et al.
2004/0079533 A1 4/2004 Buytaert et al.
2004/0108142 A1 6/2004 Vail, III
2004/0112603 A1 6/2004 Galloway et al.
2004/0112646 A1 6/2004 Vail
2004/0112693 A1 6/2004 Baumann et al.
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0144547 A1 7/2004 Koithan et al.
2004/0149431 A1* 8/2004 Wylie et al. ..... 166/242.1
2004/0168799 A1* 9/2004 Simonds et al. ..... 166/278
2004/0168808 A1* 9/2004 Smith ..... 166/313
2004/0173358 A1 9/2004 Haugen
2004/0182579 A1 9/2004 Steele et al.
2004/0216892 A1 11/2004 Giroux et al.
2004/0216924 A1 11/2004 Pietras et al.
2004/0216925 A1 11/2004 Metcalfe et al.
2004/0221997 A1 11/2004 Giroux et al.
2004/0226751 A1 11/2004 McKay et al.
2004/0238218 A1 12/2004 Runia et al.
2004/0244992 A1 12/2004 Carter et al.
2004/0245020 A1 12/2004 Giroux et al.
2004/0251025 A1 12/2004 Giroux et al.
2004/0251050 A1 12/2004 Shahin et al.
2004/0251055 A1 12/2004 Shahin et al.
2004/0262013 A1 12/2004 Tilton et al.
2005/0000691 A1 1/2005 Giroux et al.
2005/0011643 A1 1/2005 Slack et al.
2005/0056433 A1* 3/2005 Ring et al. ..... 166/384
2005/0077048 A1 4/2005 Hall
2005/0096846 A1 5/2005 Koithan et al.
2005/0152749 A1 7/2005 Anres et al.
2005/0178555 A1* 8/2005 Smith et al. ..... 166/313
2005/0183892 A1 8/2005 Oldham et al.
2005/0241709 A1* 11/2005 Johnson et al. ..... 138/28
2005/0241834 A1* 11/2005 McGlothen et al. ..... 166/380
2005/0252688 A1* 11/2005 Head et al. ..... 175/61
2005/0274547 A1 12/2005 Fincher et al.
2006/0006004 A1* 1/2006 Terry et al. ..... 175/61
2006/0070771 A1 4/2006 McClain et al.
2007/0068703 A1 3/2007 Tessari et al.
2007/0079995 A1 4/2007 McClain et al.

FOREIGN PATENT DOCUMENTS

DE 3 213 464 10/1983
DE 3 523 221 2/1987
DE 3 918 132 12/1989
DE 4 133 802 10/1992
EP 0 087 373 8/1983
EP 0 162 000 11/1985
EP 0 171 144 2/1986
EP 0 235 105 9/1987
EP 0 265 344 4/1988
EP 0 285 386 10/1988
EP 0 397 323 11/1990
EP 0 426 123 5/1991
EP 0 462 618 12/1991
EP 0 474 481 3/1992
EP 0479583 4/1992
EP 0 525 247 2/1993
EP 0 554 568 8/1993
EP 0 589 823 3/1994
EP 0 659 975 6/1995
EP 0 790 386 8/1997
EP 0 881 354 4/1998
EP 0 571 045 8/1998
EP GB 2 329 918 4/1999
EP 0 961 007 12/1999
EP 0 962 384 12/1999
EP 1 006 260 6/2000
EP 1 050 661 11/2000
EP 1148206 10/2001
EP 1 256 691 11/2002
FR 2053088 7/1970
FR 2741907 6/1997
FR 2 841 293 12/2003
GB 540 027 10/1941
GB 709 365 5/1954
GB 716 761 10/1954
GB 733596 7/1955
GB 7 928 86 4/1958
GB 8 388 33 6/1960
GB 881 358 11/1961
GB 887 150 1/1962
GB 887150 1/1962
GB 9 977 21 7/1965
GB 1 277 461 6/1972
GB 1 306 568 3/1973
GB 1 448 304 9/1976
GB 1 469 661 4/1977
GB 1 582 392 1/1981
GB 2 053 088 2/1981
GB 2 115 940 9/1983
GB 2 170 528 8/1986
GB 2 201 912 9/1988
GB 2 216 926 10/1989
GB 2 221 482 2/1990
GB 2 223 253 4/1990
GB 2 221 482 7/1990
GB 2 224 481 9/1990
GB 2 239 918 7/1991
GB 2 240 799 8/1991
GB 2 275 486 4/1993
GB 2 294 715 8/1996
GB 2 313 860 2/1997
GB 2 320 270 6/1998
GB 2 320 734 7/1998

| | | |
|---|---|---|
| GB | 2 324 108 | 10/1998 |
| GB | 2 326 896 | 1/1999 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| GB | 2 396 375 | 6/2004 |
| RU | 2 079 633 | 5/1997 |
| RU | 2079633 | 5/1997 |
| RU | 2079633 C1 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 395557 | 8/1973 |
| SU | 501139 | 12/1973 |
| SU | 415346 | 2/1974 |
| SU | 585266 | 7/1974 |
| SU | 583278 | 8/1974 |
| SU | 461218 | 2/1975 |
| SU | 481689 | 8/1975 |
| SU | 501139 | 1/1976 |
| SU | 601390 | 1/1976 |
| SU | 581238 | 2/1976 |
| SU | 655843 | 3/1977 |
| SU | 581238 | 11/1977 |
| SU | 583278 | 12/1977 |
| SU | 585266 | 12/1977 |
| SU | 781312 | 3/1978 |
| SU | 601390 | 4/1978 |
| SU | 655843 | 4/1979 |
| SU | 899820 | 6/1979 |
| SU | 781312 | 11/1980 |
| SU | 955765 | 2/1981 |
| SU | 899820 | 1/1982 |
| SU | 1304470 | 8/1984 |
| SU | 1618870 | 1/1991 |
| SU | 1808972 | 5/1991 |
| SU | 1808972 | 4/1993 |
| SU | 955765 | 1/1995 |
| SU | 1304470 | 1/1995 |
| WO | WO 82/01211 | 4/1982 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/18328 | 4/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/37772 | 6/2000 |
| WO | WO 00/37773 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/50732 | 8/2000 |
| WO | WO 00/66879 | 11/2000 |
| WO | WO 00/77431 | 12/2000 |
| WO | WO 01/12946 | 2/2001 |
| WO | WO 01/46550 | 6/2001 |
| WO | WO 01/60545 | 8/2001 |
| WO | WO 01/66901 | 9/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/29199 | 4/2002 |
| WO | WO 02/33212 | 4/2002 |
| WO | WO 02/44601 | 6/2002 |
| WO | WO 02/081863 | 10/2002 |
| WO | WO 02/086287 | 10/2002 |
| WO | WO 02/092956 | 11/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M. Gelfgat, "Retractable Bits Development and Applicantion" Transactions of the ASME, vol. 120, (Jun. 1998), pp. 124-130.

"First Success with Casing-Drilling" Word Oil, (Feb. 1999), pp. 25.

Dean E. Gaddy, Editor, "Russia Shares Technical Know-How with U.S." Oil & Gas Journal, (Mar. 1999), pp. 51-52 and 54-56.

U.S. Appl. No. 10/794,800, filed Mar. 5, 2004 (WEAT/0360).

U.S. Appl. No. 10/832,804, filed Apr. 27, 2004 (WEAT/0329.P1).

U.S. Appl. No. 10/795,214, filed Mar. 5, 2004 (WEAT/0373).

U.S. Appl. No. 10/794,795, filed Mar. 5, 2004 (WEAT/0357).

U.S. Appl. No. 10/775,048, filed Feb. 9, 2004 (WEAT/0359).

U.S. Appl. No. 10/772,217, filed Feb. 2, 2004 (WEAT/0344).
U.S. Appl. No. 10/788,976, filed Feb. 27, 2004 (WEAT/0372).
U.S. Appl. No. 10/794,797, filed Mar. 5, 2004 (WEAT/0371).
U.S. Appl. No. 10/767,322, filed Jan. 29, 2004 (WEAT/0343).
U.S. Appl. No. 10/795,129, filed Mar. 5, 2004 (WEAT/0366).
U.S. Appl. No. 10/794,790, filed Mar. 5, 2004 (WEAT/0329).
U.S. Appl. No. 10/162,302, filed Jun. 4, 2004 (WEAT/0410).
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applicatons, Alan MacKenzie & Cliff Hogg, World Oil, Jan. 1999, pp. 55-61.
U.S. Appl. No. 10/618,093, filed Jul. 11, 2003.
U.S. Appl. No. 10/189,570, filed Jul. 6, 2002.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Majarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservior," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling for Depleted Reservkors, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drilling String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mecico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 2999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Coast," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexiblility for Casing Drilling," Paper No. WOCD-0306-01, World Oil Casing Drilling Technical Conference, 2003, pp. 1-11.

Evans, et al., "Development And Testing Of An Economical Casing Connection For Use In Drilling Operations," paper WOCD-0306-03, World Oil Casing Drilling Technical Conference, Mar. 6-7, 2003, pp. 1-10.

PCT Search Report, International Application No. PCT/US2004/006749, dated Nov. 11, 2004.

Detlef Hahn, Friedhelm Makohl, and Larry Watkins, Casing-While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Safety Systems, W-K-M Division, ACF Industries, Catalog 80, 1980, 5 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 ro 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Alexander Sas-Jaworsky and J. G. Williams, Development of Composite Coiled Tubing For Oilfield Services, SPE 26536, Society of Petroleum Engineers, Inc., 1993.

Coiled Tubing Handbook, World Oil, Gulf Publishing Company, 1993.

U.K. Examination Report, Appliction No. GB0518159.9, dated Nov. 17, 2005.

Multilateral Case History, Onshore-Nigeria, Baker Hughes, 2000.

Multilateral Case History, Offshore Norway, Baker Hughes, 1995.

Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.

GB Combined Search and Examination Report, Application No. 0624782.9, Dated Apr. 19, 2007.

Charles O. Vail and Verne Smith, New Developments In Air-Gas Drilling and Completions, World Oil, Part One, Nov. 1963, pp. 70-73.

Charles O. Vail and Verne Smith, New Developments In Air-Gas Drilling and Completions, World Oil, Part Two, Dec. 1963, pp. 82-86.

Combined Search and Examination Report, Application No. GB0711793.0, dated Jul. 23, 2007.

* cited by examiner

FULL BORE LINED WELLBORES

CROSS-REFERENCE TO RELATED APPLICATIONS

This application claims benefit of U.S. Provisional Patent Application Ser. No. 60/451,994 filed on Mar. 5, 2003, which application is herein incorporated by reference in its entirety. This application further claims benefit of U.S. Provisional Patent Application Ser. No. 60/452,269 filed on Mar. 5, 2003, which application is herein incorporated by reference in its entirety.

BACKGROUND OF THE INVENTION

1. Field of the Invention

Embodiments of the present invention generally relate to drilling and completion of oil and gas wells. More specifically, embodiments of the present invention relate to methods and apparatus for forming a wellbore by drilling with casing. Embodiments of the present invention generally relate, more particularly, to the construction of lateral wellbores.

2. Description of the Related Art

In the drilling of oil and gas wells, a wellbore is formed in a formation using a drill bit that is urged downwardly at a lower end of a drill string. After drilling a predetermined depth, the drill string and the drill bit are removed, and the wellbore is typically lined with a string of pipe called casing. The casing forms a major structural component of the wellbore and serves several important functions, such as preventing the formation wall from caving into the wellbore, isolating different zones in the formation, preventing the flow of fluids into the wellbore, and providing a means of maintaining control of fluids and pressure while drilling. Casing is available in a range of sizes and material grades, the choice of which is typically determined by a particular application.

The casing typically extends down the wellbore from the surface to a designated depth. Various downhole tools are often run through the casing to perform various operations downhole in the wellbore. Accordingly, the drift diameter of the casing dictates the types of downhole tools that may be run through the casing. Drift diameter generally refers to the inside diameter that the casing manufacturer guarantees per specifications. In other words, the drift diameter may be used (e.g., by a well planner) to determine what size tools may later be run through the casing.

For various production oriented reasons, it may be desirable to form a lateral (e.g., deviating from vertical) wellbore extending from a main (or "parent") wellbore. For example, because a lateral wellbore typically penetrates a greater length of the reservoir, it may offer significant production improvement over a purely vertical main wellbore. Lateral wellbores extending from a cased main wellbore may be formed by removing a portion of the main wellbore casing to expose a portion of the formation. The lateral wellbore may then be formed by drilling out from the main wellbore through the exposed portion of the formation. Various well-known techniques are available to achieve the desired deviation from the main wellbore when drilling the lateral wellbore.

For the previously described reasons (e.g., support, isolation, etc.), it is also desirable to line a lateral wellbore with casing. However, in order to reach the lateral wellbore, casing used to line the lateral wellbore must pass through the main wellbore casing. Therefore, to run the casing into the lateral wellbore, the outer diameter of the casing used to line the lateral wellbore must be smaller than the inner diameter of the main wellbore casing. Accordingly, casing used to line conventional lateral wellbores has been limited to casing having inner diameters significantly smaller than the main wellbore casing. As a result of this smaller inner diameter, the types of downhole tools that may be run in the lateral wellbore are typically restricted, thereby limiting the types of operations that may be performed therein. Accordingly, what is needed is an improved method for forming a lateral wellbore lined with casing having an enlarged inner diameter relative to casing lining conventional lateral wellbores.

To drill within the wellbore to a predetermined depth in conventional well completion operations, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever-decreasing diameter.

As an alternative to the conventional method, drilling with casing is a method sometimes used to place casing strings within the wellbore. This method involves attaching a cutting structure in the form of a drill bit to the same string of casing which will line the wellbore. Rather than running a drill bit on a smaller diameter drill string, the drill bit or drill shoe is run in at the end of the larger diameter of casing that will remain in the wellbore and be cemented therein. Drilling with casing is a desirable method of well completion because only one run-in of the working string into the wellbore is necessary to form and line the wellbore for each casing string.

Specifically, drilling with casing is typically accomplished by lowering and rotating a first casing string with a cutting structure attached thereto into a formation to form a portion of the wellbore at a first depth. During the lowering of the casing string, it is often necessary to circulate drilling fluid while drilling into the formation to form a path within the formation through which the casing string may travel. The first casing string is cemented into the formation. Next, a second casing string with a drill bit attached thereto is lowered and rotated into the formation while circulating fluid to form a portion of the wellbore at a second depth. The second casing string is hung off of the first casing string and cemented into the formation. This process can be repeated with additional casing strings until the wellbore extends to the desired depth.

Because the second casing string must travel through the first string of casing to reach the formation below the first casing string, the second casing string must have a smaller inner diameter than the second casing string. Historically, therefore, as more casing strings were set in the wellbore, the casing strings became progressively smaller in diameter in order to fit within the previous casing string. The drill bit for drilling to the next predetermined depth must thus become progressively smaller as the diameter of each casing string decreases in order to fit within the previous casing string. Therefore, multiple drill bits of different sizes are ordinarily necessary for drilling in well completion operations. Progressively decreasing the diameter of the casing strings with increasing depth within the wellbore limits the size of wellbore tools which are capable of being run into the wellbore. Furthermore, restricting the inner diameter of the casing strings limits the volume of hydrocarbon production which may flow to the surface from the formation.

Recently, methods and apparatus for expanding the diameter of casing strings within a wellbore have become feasible. When using expandable casing strings to line a wellbore, the well is drilled to a first designated depth with a drill bit on a drill string, then the drill string is removed. A first string of casing is set in the drilled out portion of the wellbore, and cement is circulated into the annulus behind the casing string. Next, the well is drilled to a second designated depth, and a second string of casing is run into the drilled out portion of the wellbore at a depth such that the upper portion of the second string of casing overlaps the lower portion of the first string of casing. Cement can be placed behind the second casing string and then the second casing string is expanded into contact with the existing first string of casing with an expander tool. This process is typically repeated with additional casing strings until the well has been drilled to total depth.

An advantage gained with using expander tools to expand expandable casing strings is the decreased annular space between the overlapping casing strings. Because the subsequent casing string is expanded into contact with the previous string of casing, the decrease in diameter of the wellbore is essentially the thickness of the subsequent casing string. However, even when using expandable technology, casing strings must still become progressively smaller in diameter in order to fit within the previous casing string.

Currently, monobore wells are being investigated to further limit the decrease in the inner diameter of the wellbore with increasing depth. Monobore wells would theoretically result when the wellbore is approximately the same diameter along its length or depth through the expansion of casing strings, causing the path for fluid between the surface and the wellbore to remain consistent along the length of the wellbore and regardless of the depth of the well. In a monobore well, tools could be more easily run into the wellbore because the size of the tools which may travel through the wellbore would not be limited to the constricted inner diameter of casing strings of decreasing inner diameters.

Theoretically, in the formation of a monobore well, a first casing string could be inserted into the wellbore and cemented therein. Thereafter, a second casing string of a smaller diameter than the first casing string could be inserted into the wellbore and expanded to approximately the same inner diameter as the first casing string. The casing strings may be connected together through a conventional hanger, or by expanding the inner diameter of the larger diameter first casing string, which is located above the second casing string, where the first and second casing strings overlap. Additional casing strings would be inserted into the wellbore and expanded, as described in relation to the first and second casing strings, until the wellbore extends to the desired depth.

With monobore well investigation, certain problems present. One problem relates to the expansion of the smaller casing string into the larger casing string to form the connection therebetween. Current methods of expanding casing strings in a wellbore to create a connection between casing strings requires the application of a radial force to the interior of the smaller casing string and expanding its diameter out until the larger casing string is itself pushed past its elastic limits. The result is a connection having an outer diameter greater than the original outer diameter of the larger casing string. While the increase in the outer diameter is small in comparison to the overall diameter, there are instances where expanding the diameter of the larger casing string is difficult or impossible. For example, in the completion of a monobore well, the upper casing string may be cemented into place before the next casing string is lowered into the well and its diameter expanded. Because the annular area between the outside of the larger casing string and the borehole therearound is filled with cured cement, the diameter of the larger casing string cannot expand past its original shape. Expansion of the required magnitude may also rupture the casing.

When hanging a casing string from another casing string, whether during a drilling operation or a drilling with casing operation, the casing string being hung may be set mechanically or hydraulically. A typical apparatus for setting a casing string in a well casing includes a liner hanger and a running tool. The running tool is provided with a valve seat obstruction which will allow fluid pressure to be developed to actuate the slips in order to set the liner hanger in the well casing. Once the liner hanger has been set, the running tool is rotated counterclockwise to unscrew the running tool from the liner hanger and the running tool is then removed.

One advantageous use for expandable tubulars is to hang one tubular within another. For example, the upper portion of a casing string can be expanded into contact with the inner wall of a casing in a wellbore. In this manner, the bulky and space-demanding slip assemblies and associated running tools can be eliminated. One problem with using expandable tubular technology used casing strings relates to cementing the casing strings within the wellbore. Cementing is performed by circulating uncured cement down the wellbore and back up an annulus between the exterior of the casing string being set and the wellbore therearound. In order for the cement to be circulated, a fluid path is necessary between the annulus and the wellbore. Hanging a casing string in a wellbore by circumferentially expanding its walls into the well casing obstructs the juncture and prevents circulation of fluids. To avoid this circulation problem, casing strings must usually be temporarily hung in a wellbore prior to cementing.

Therefore, a need exists for a method and apparatus for forming a substantially monobore well when drilling with casing. There is a further need for an apparatus and method for use when drilling with casing for forming a cased wellbore with an inner diameter which does not decrease with increasing depth within the wellbore. There is a yet further need for an apparatus and method for use in drilling with casing which involves running a casing string of smaller inner diameter into a formation and subsequently expanding a casing string of larger inner diameter to form a wellbore with substantially the same inner diameter along its length.

Moreover, there is a need for apparatus and methods that permit casing to be hung in a well and also leave a fluid path around the casing, at least temporarily. Additionally, there is a need for casing having a means for circulating fluids therearound even after the casing has been hung within the wellbore or previously installed casing.

SUMMARY OF THE INVENTION

Embodiments of the present invention generally relate to methods and apparatus for forming a substantially monobore well which does not decrease in diameter with increasing depth or length within the formation. Embodiments of the present invention further generally provide full bore lined lateral wellbores, and methods of making the same.

For one embodiment, a method of forming a full bore lined lateral wellbore is provided. The method generally includes forming a lateral wellbore extending from a main wellbore, wherein a diameter of the lateral wellbore is larger than an inner diameter of casing lining the main wellbore, running an expandable tubular element through the casing lining the main wellbore into the lateral wellbore, and expanding the tubular element within the lateral wellbore. The expanded tubular element may have an outer diameter larger than the drift diameter of the main wellbore lining. For some embodiments, the expanded tubular may have an inner diameter greater than the inner diameter of the main wellbore casing, providing a full-bore lined lateral. For some embodiments, the lateral wellbore may be formed and the expandable tubular element may be run concurrently in a single pass through the main wellbore, utilizing a drilling with lining operation.

For one embodiment, another method of forming a full bore lined lateral wellbore is provided. The method generally includes securing a diverter within a main wellbore lined with casing, forming a lateral wellbore with a drill bit guided by the diverter, expanding a diameter of at least a portion of the lateral wellbore, running an expandable tubular element, through the casing lining the main wellbore, into the lateral wellbore, and expanding the tubular element within the lateral wellbore, such that the expanded tubular element has an outer diameter larger than the inner diameter of the casing lining the main wellbore.

For one embodiment, a lateral wellbore extending from a main wellbore lined with casing is provided. At least a portion of the lateral wellbore is lined with casing, the casing having an outer diameter larger than the drift diameter of the main wellbore casing. For some embodiments, the lined portion of the lateral wellbore may extend to the main wellbore.

The present invention generally provides an apparatus and method for forming a cased wellbore which does not decrease in inner diameter with increasing depth while drilling with casing. More specifically, the present invention provides an apparatus and method for forming a cased wellbore of substantially the same inner diameter with increasing depth while drilling with casing. In one aspect, the apparatus includes a casing string, an earth removal member or cutting structure operatively attached to a lower end of the casing string, and a compressible member disposed at a lower end of the casing string. In another aspect, the apparatus includes a casing string with an enlarged inner diameter at its lower end, an earth removal member or cutting structure operatively attached to a lower end of the casing string, and a drillable portion disposed within the casing string.

In one aspect, the method includes drilling a wellbore using a first casing string with an earth removal member or cutting structure operatively disposed at its lower end, locating the first casing string within the wellbore, locating a portion of a second casing string adjacent to a portion of the first casing string with an enlarged inner diameter, and expanding the portion of the second casing string so that the portion of the second casing string has an inner diameter at least as large as a smallest inner diameter portion of the first casing string. In another aspect, the method includes drilling a wellbore using a first casing string with a cutting structure operatively disposed at its lower end and a compressible member disposed around the first casing string, locating the first casing string within the wellbore, locating a portion of a second casing string adjacent to the compressible member, and expanding the portion of the second casing string so that the portion of the second casing string has an inner diameter at least as large as a smallest inner diameter portion of the first casing string.

Providing a method and apparatus for drilling with casing to form a substantially monobore well increases the possible inner diameter of a cased wellbore formed by drilling with casing. As a consequence, flexibility in the tools which are capable of being run into the cased wellbore is increased. Furthermore, forming a substantially monobore well using drilling with casing technology allows a wellbore of substantially the same inner diameter along its length to be formed in less time compared to conventional drilling methods.

In one aspect, embodiments of the present invention generally provide a method of forming a cased well, comprising lowering a first casing having an earth removal member operatively attached to its lower end into a formation to form a wellbore of a first depth, expanding at least a portion of the first casing into gripping engagement with the wellbore to hang the first casing within the wellbore, leaving a fluid path between the first casing and the wellbore after expanding at least the portion of the first casing, flowing a fluid through the fluid path, and closing the fluid path. In another aspect, embodiments of the present invention provide a method of casing a wellbore, comprising lowering a first casing having an earth removal member operatively attached to its lower end into a formation to form a wellbore, the first casing having at least one bypass for circulating a fluid formed therein, expanding at least a portion of the first casing into frictional engagement with the wellbore to hang the first casing within the wellbore, circulating the fluid through the at least one bypass, and expanding the first casing to close the bypass.

In yet another aspect, embodiments of the present invention include an apparatus for use in drilling with casing, comprising a tubular string having a casing portion, an earth removal member operatively attached to its lower end, and at least one fluid bypass area located thereon, and an expansion tool disposed within the tubular string, the expansion tool capable of expanding a portion of the tubular string into a surrounding wellbore while leaving a flow path around an outer diameter of the tubular string to a surface of the wellbore.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally provide methods and apparatus for forming a lined wellbore which does not decrease in diameter with increasing depth or length within the formation. The wellbore may include only a main wellbore or may include the main wellbore and any number of lateral wellbores extending therefrom. In some embodiments, drilling with casing is utilized to form a substantially monobore well lined with the casing.

In one aspect, embodiments of the present invention provide improved lateral wellbores and apparatus and methods for forming the same. The lateral wellbores extend from a main wellbore and are at least partially lined with casing having an outer diameter larger than the drift diameter of casing used to line the main wellbore (at least the casing used to line the main wellbore above the lateral). For some embodiments, the inner diameter of the lateral wellbore casing may be larger than the inner diameter of the main wellbore casing. Such lateral wellbores may be referred to as full bore lined lateral wellbores. In either case, by providing a larger inner diameter than conventional lateral wellbores, a larger variety of tools may be run in the lateral wellbore.

Figure 1:
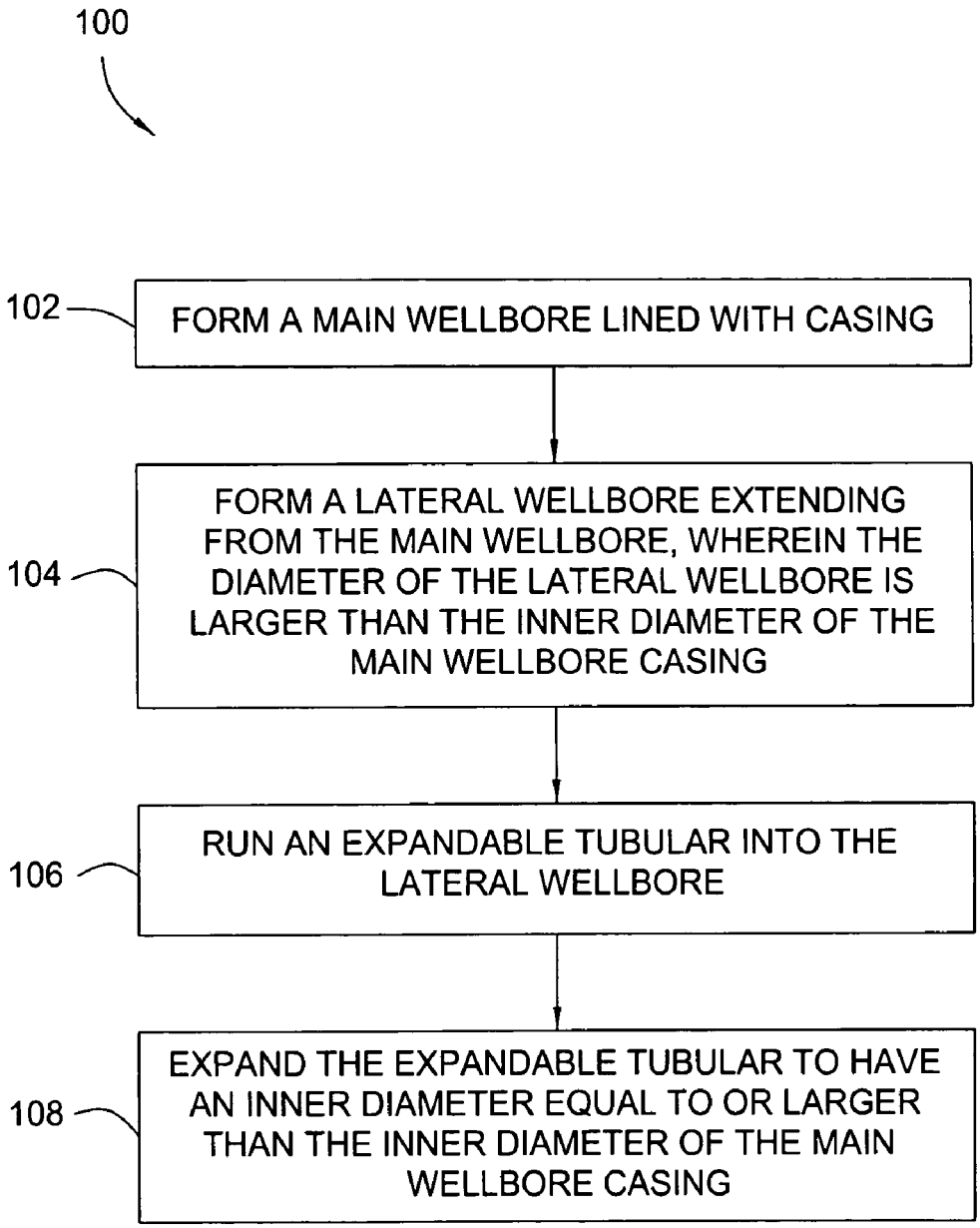
FIG. 1 is a flow diagram of exemplary operations in accordance with aspects of the present invention.

FIG. 1 is a flow diagram of exemplary operations 100 for constructing a lateral wellbore in accordance with aspects of the present invention. FIGS. 2A-2G illustrate a lateral wellbore, as well as the main wellbore from which it extends, at various stages of formation in accordance with the operations 100. Thus, the operations 100 may be best described with reference to FIGS. 2A-2G. However, the lateral wellbore illustrated in FIGS. 2A-2G is exemplary of just one embodiment of a lateral wellbore that may be constructed according to the operations 100 and, as will be described in greater detail below, various other lateral wellbores may also be constructed in accordance with the operations 100.

Figure 2A:
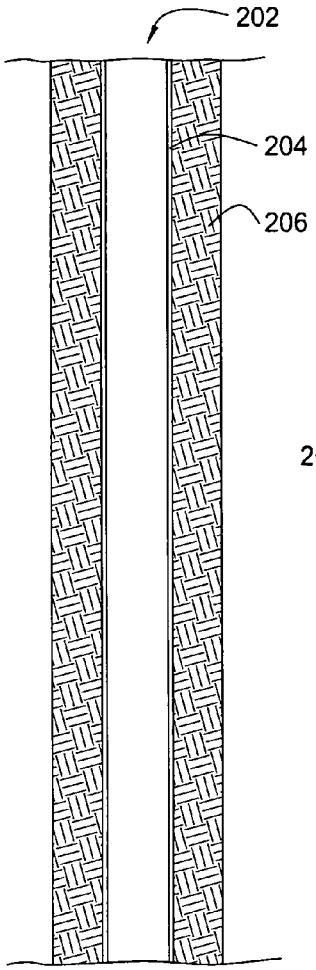
FIGS. 2A-2G show a lateral wellbore at various stages of formation, according to one embodiment of the present invention.

The operations 100 begin, at step 102, by forming a main wellbore lined with casing. For example, as illustrated in FIG. 2A, a main wellbore 202 lined with casing 204 may be formed in a formation 206. The main wellbore 202 may be formed using any suitable means. For some embodiments, the main wellbore 202 may be formed as a single diameter "monobore" and/or the casing 204 may be formed from expandable tubular elements, such as those available from Weatherford International, Inc. The expandable tubular elements (or "tubulars") may be screened or made of a solid material. Advantages of forming the main wellbore 202 as a monobore include reduced production time because the main wellbore 202 may have a single diameter, reducing the number of bits required to drill the main wellbore 202.

Advantages of forming the casing from expandable tubulars include an increase in the achievable inner diameter throughout the length of the main wellbore. In other words, conventional casing techniques require the use of sequential casing strings of increasingly smaller diameters, because each successive casing string must be run through the previous casing string. However, expandable tubulars may be run downhole in an unexpanded state having a sufficiently small outer diameter to pass through the inner diameter of previously expanded tubulars. Accordingly, casing formed of expandable tubulars need not suffer the successively smaller diameters associated with conventional casing, and may provide full bore access to the main wellbore, thereby potentially allowing a greater variety of downhole tools to be run in the main wellbore 202.

Figure 2B:
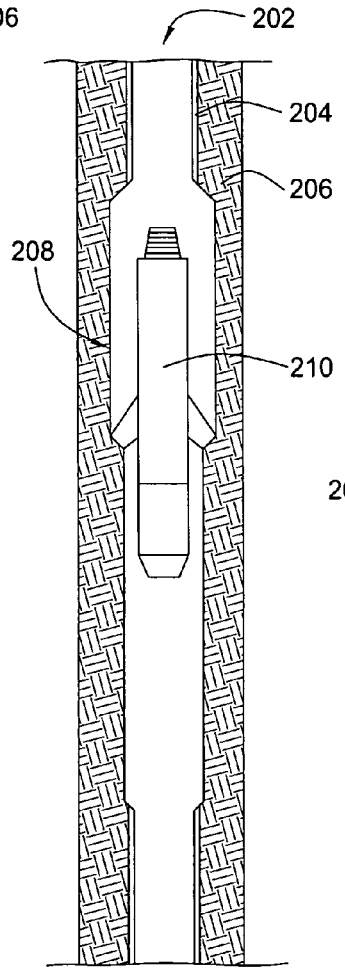

At step 104, a lateral wellbore extending from the main wellbore is formed, wherein the diameter of the lateral wellbore is larger than the inner diameter of the main wellbore casing 204. As illustrated in FIG. 2B, in order to form the lateral wellbore 214, a section of the casing 204 may be removed to expose a portion of the formation 206. Depending on the technique used to remove the section of the casing, an entire annular section of the casing 204 may be removed, or only a portion of the casing 204. Alternately, the casing 204 may be cut along an entire perimeter and an upper section (above the cut) of the casing 204 may be raised to expose a portion of the formation 206. Further, depending on the removal process, a portion of physically alterable bonding material, preferably cement, used set the casing 204 within the wellbore 202 may be exposed instead of, or in addition to the formation 206. Regardless, a diameter of the main wellbore 202 may be enlarged where the section of casing has been removed, for example, using a conventional underreamer 210, to form a cavity 208 having a larger diameter than surrounding sections of the wellbore 202.

Figure 2C:
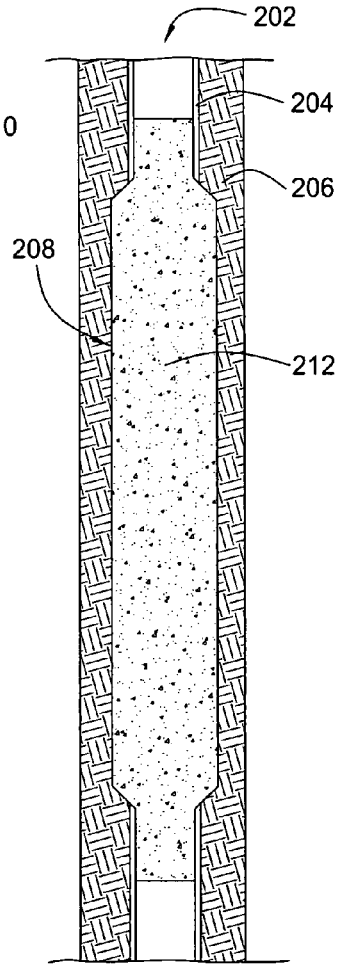
Figure 2D:
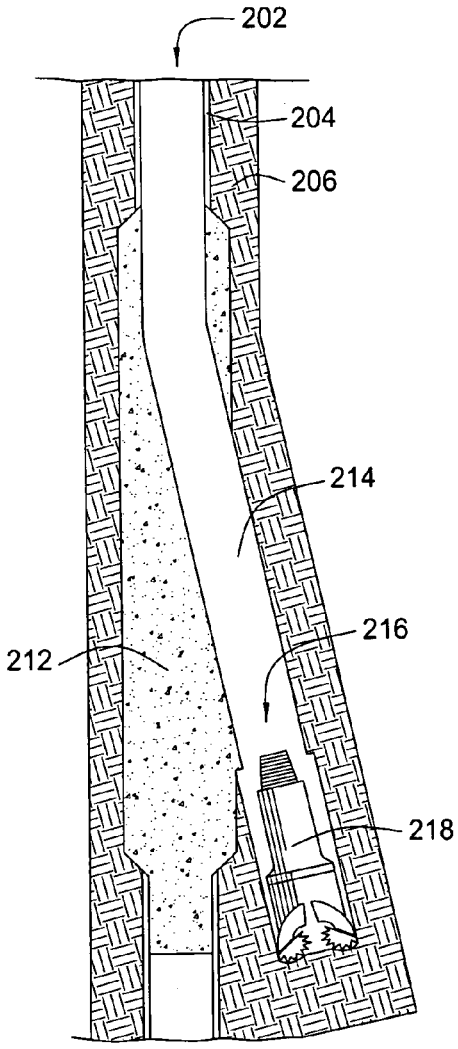

As illustrated in FIG. 2C, in preparation for drilling the lateral wellbore, the cavity 208 may be filled with a physically alterable bonding material such as cement 212. A lateral wellbore 214 may then be formed by drilling through the cement 212, as illustrated in FIG. 2D. For example, drill deviation achievable by drilling through cement 212 is well known and may be adequately controlled to form the lateral wellbore 214 having a desired trajectory.

In order to be run through the casing 204, an earth removal member, preferably a drill bit (not shown), used to drill through the cement 212 must have an outer diameter less than the inner diameter of the casing 204. Accordingly, the lateral wellbore 214 drilled with the drill bit may initially have a diameter smaller than the inner diameter of the casing 204 and must, therefore, be expanded. As illustrated, the lateral wellbore 214 may be expanded using an expandable bit 218, underreamer, back reamer, or similar apparatus. An example of an expandable bit is disclosed in International Publication Number WO 01/81708. A1, which is incorporated by reference herein in its entirety. Similar to a conventional underreamer, the expandable bit may include a set of blades that move between an open, extended position and a closed, retracted position. Generally, movement of the blades between the open and the closed position may be controlled through the use of hydraulic fluid flowing through the center of the expandable bit. For example, increasing the hydraulic pressure (i.e., by increasing the flow) may move the blades to the open position, while decreasing the hydraulic pressure may return the blades to the closed position.

Therefore, the blades may be placed in a closed (retracted) position giving the expandable bit 218 a smaller diameter than the inner diameter of the casing 204, allowing the expandable bit 218 to be run in the lateral wellbore 214. The blades may then be opened giving the expandable bit 218 a larger diameter, allowing at least a portion of the lateral wellbore 214 to be expanded to have a greater diameter than the inner diameter of the casing 204. After expanding the portion 216 of the lateral wellbore 214, the blades may be returned to the closed position and the expandable bit 218 may be removed through the lateral wellbore 214 and the casing 204 of the main wellbore 202. Cutting members disposed on the arms of the expandable bit 218 may be made of any suitable hard material, such as tungsten carbide or polycrystalline diamond ("PCD").

Figure 2E:
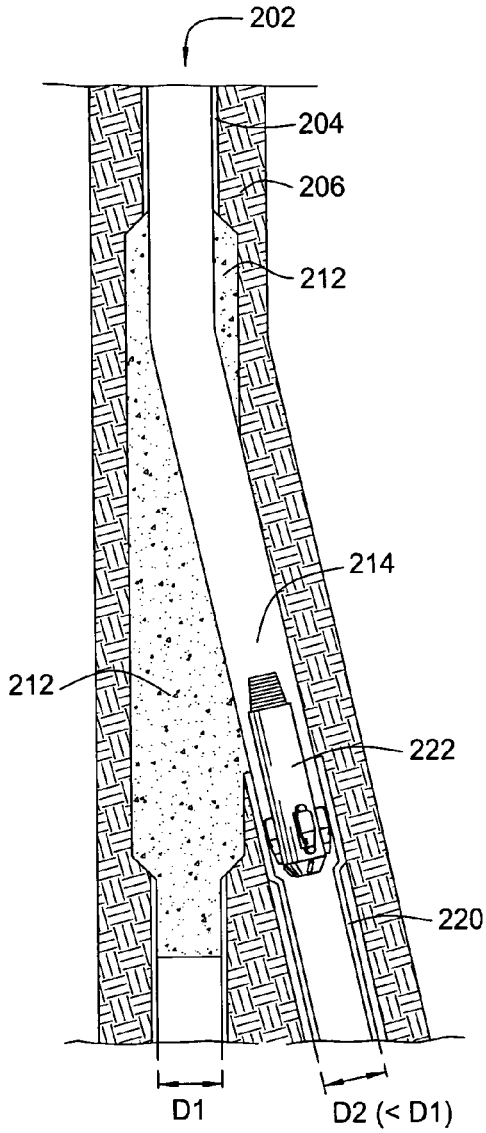

At step 106, an expandable tubular lining is run into the lateral wellbore 214. At step 108, the tubular lining is expanded to have an inner diameter equal to or larger than the inner diameter of the main wellbore casing 204. For example, as illustrated in FIG. 2E, an expandable tubular 220 having an outer diameter D2 smaller than the inner diameter D1 of the casing 204 may be run into the expanded portion 216 of the lateral wellbore 214. The expandable tubular 220 may then be expanded, for example, using an expander tool 222. The expandable tubular 220 may comprise any number of any type of suitable expandable tubular elements, which may be solid or screened, and may be of any suitable length. The expander tool 222 may be any suitable expanding tool, such as a fixed-cone type or rotary-type expander tool. Expandable tubulars usable in the present invention and methods of installing the same are described in greater detail in the commonly owned, co-pending U.S. patent application Ser. No. 09/969,089, entitled "Method and Apparatus for Expanding and Separating Tubulars in a Wellbore," which is herein incorporated by reference in its entirety.

Figure 2F:
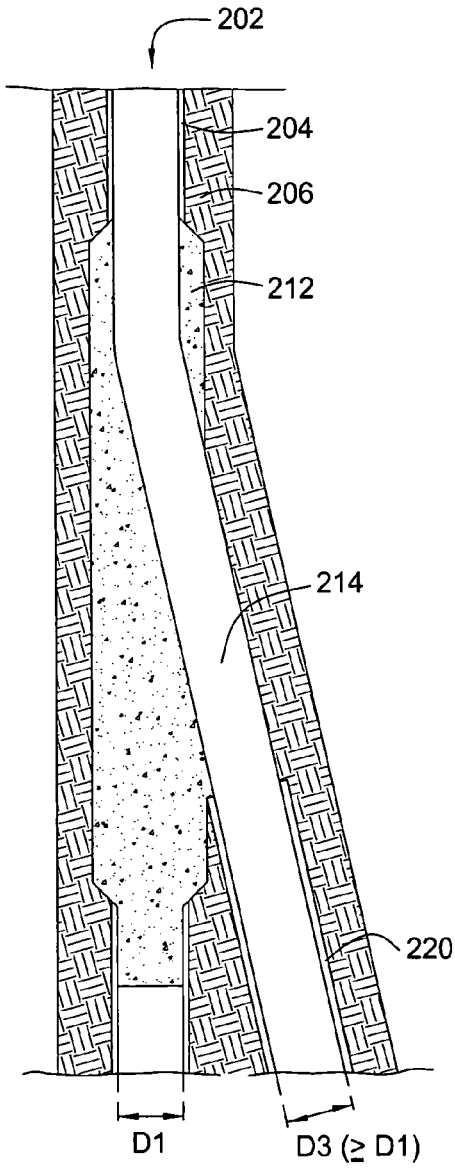

Recalling that the term "drift diameter" generally refers to the inside diameter that the casing manufacturer guarantees per specifications, the specified drift diameter of the main wellbore casing 204 is typically at least slightly smaller than the actual inner diameter D1 to allow for manufacturing tolerances. As previously described, to ensure that the casing elements could be run through the main wellbore casing 204, the outer diameter of casing used to line conventional lateral wellbores was smaller than the drift diameter of the main wellbore casing 204. In contrast, once expanded, the tubular 220 may have an outer diameter greater than the drift diameter of the main wellbore casing 204. Of course, this larger outer diameter also results in a larger inner diameter.(assuming like casing thicknesses). For some embodiments, as illustrated in FIG. 2F, the tubular 220 may be expanded such that the inner diameter (D3) of the tubular 220 is equal to or larger than the inner diameter (D1) of the main wellbore casing 204, thus providing a full-bore lined lateral.

As an example, a typical 9⅝-in. casing may have an 8.53-in. drift diameter. Accordingly, the lateral wellbore 214 may be initially formed by drilling through the cement 212 with an 8.50-in. diameter bit. Prior to running the expandable tubular 220, the lateral wellbore 214 may be expanded to have a diameter sufficiently large (e.g., approximately 9.63 in.) to allow the tubular 220 to expand to have an inner diameter greater than 8.53 in. Of course, actual dimensions will vary depending on the particular application.

Figure 2G:
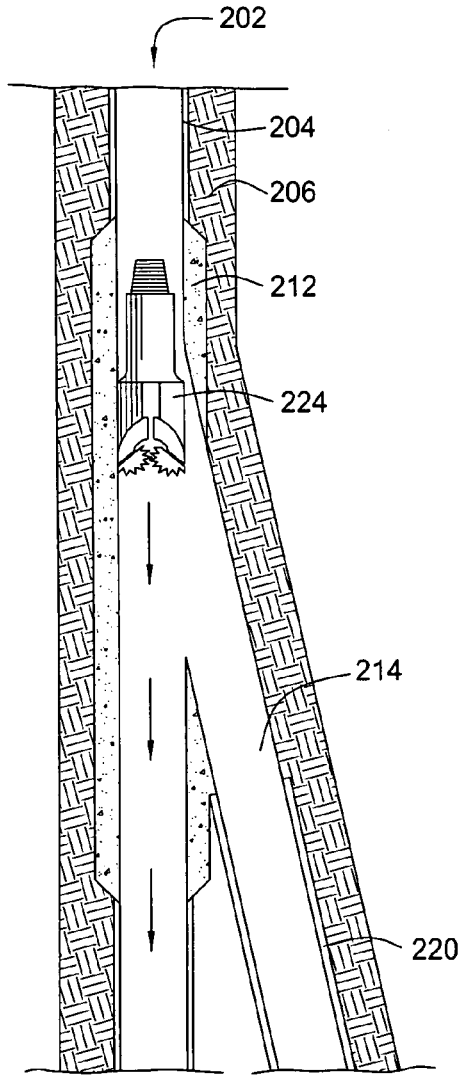

Regardless of the actual dimensions, in contrast to conventional lateral wellbores lined with casing having a smaller inner diameter than the main wellbore lined within casing, the larger inner diameter of the lateral wellbore 214 may provide full bore access for the running of tools for various operations. For some applications, it may be desirable to leave the lateral wellbore 214 isolated from sections of the main wellbore 202 below a junction between the lateral wellbore 214 and the main wellbore 202 (the "lateral junction"). Alternatively, as illustrated in FIG. 2G, if desired, fluid communication between the lateral wellbore 214 and sections of the main wellbore 202 below the lateral junction may be readily established by drilling through the cement 212, for example, with an earth removal member such as a bit 224.

Figure 3A:
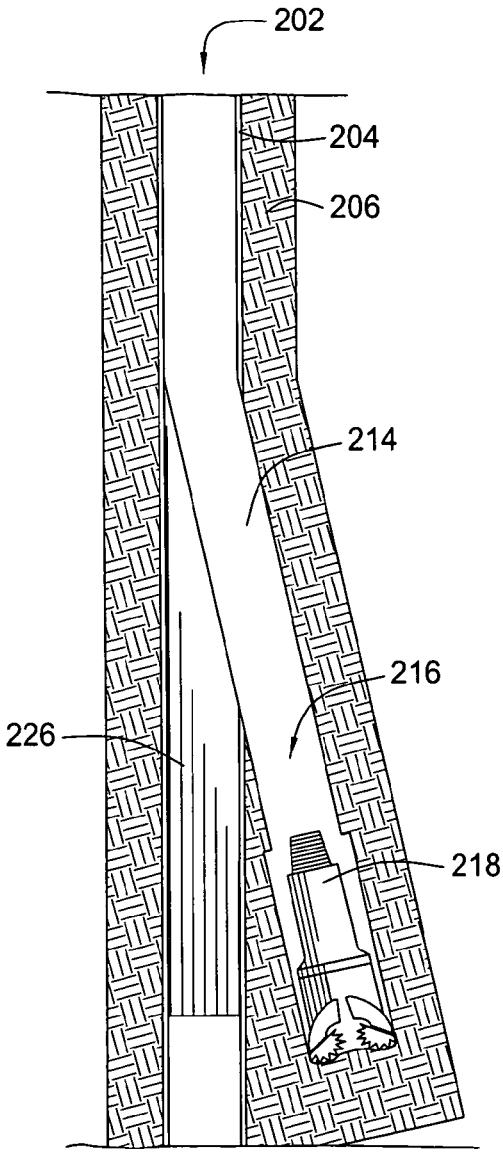
FIGS. 3A-3C show a lateral wellbore at various stages of formation, according to another embodiment of the present invention.
Figure 3B:
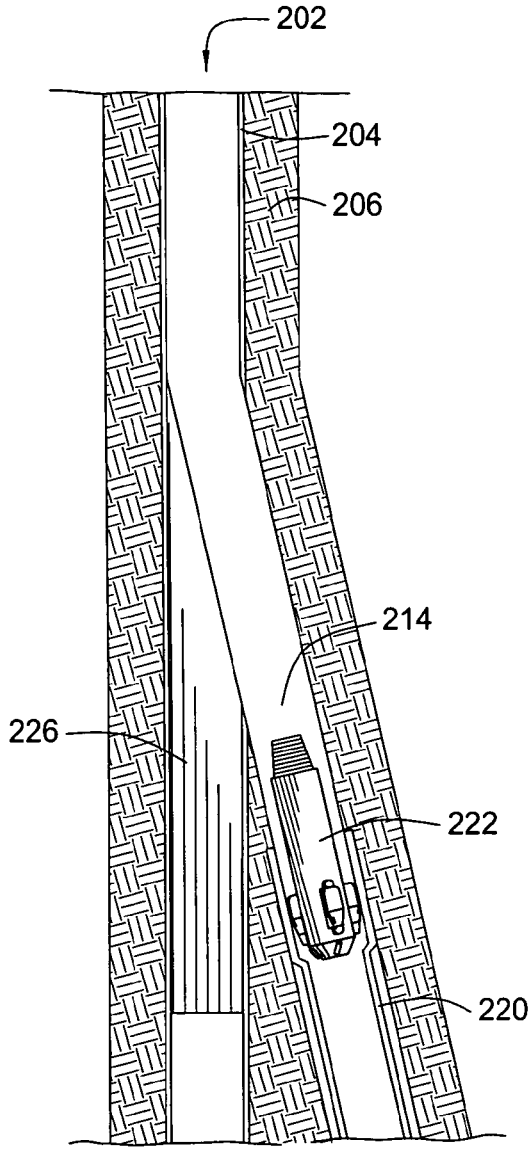
Figure 3C:
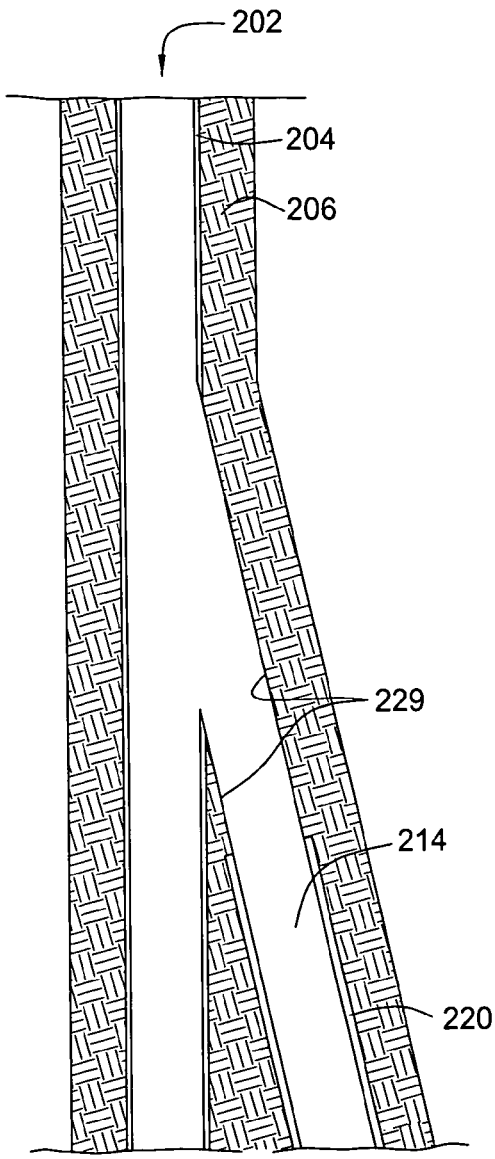

FIGS. 3A-3C show another example of a full bore lined lateral wellbore 214, at various stages of formation that may also be constructed according to the operations 100 of FIG. 1. As illustrated in FIG. 3A, the lateral wellbore 214 may be formed (e.g., at step 104) using a diverter 226, for example a whipstock or deflector, rather than the cement 212 used to form the lateral wellbore 214 of FIGS. 2D-2G. Prior to drilling the lateral wellbore 214, a section or "window" of the casing 204 may be removed, for example using a milling apparatus such as that described in the commonly owned U.S. Pat. No. 6,105,675, entitled "Downhole Window Milling Apparatus and Method for Using the Same," which is herein incorporated by reference in its entirety. The diverter 226 may be run through the casing 204 and secured (anchored) within the main wellbore 202 at a position corresponding to the desired location of the lateral wellbore 214. In the alternative, the diverter 226 may be run into the main wellbore 202 with the casing 204. In a subsequent drilling operation, the diverter 226 may serve to guide (i.e., divert) an earth removal member such as a drill bit (not shown) through the removed section of the casing 204 in the desired trajectory.

As previously described with reference to FIG. 2D, the diameter of the lateral wellbore 214 may initially be smaller than the inner diameter of the casing 204 and may be expanded with an expandable bit 218, underreamer, back reamer, or similar apparatus. As illustrated in FIG. 3B, once the lateral wellbore 214 is expanded, an expandable tubular 220 may be run into the lateral wellbore 214 and expanded using an expander tool 222. As illustrated in FIG. 3C, after expanding the tubular 220 to have an inner diameter equal to or larger than the inner diameter of the main wellbore casing 204, the diverter 226 may be removed to establish communication between the lateral wellbore 214 and sections of the main wellbore 202 below the lateral junction, may be left within the main wellbore 202, or may be left within the main wellbore 202 and subsequently drilled through to reestablish communication with the main wellbore 202.

Decisions regarding how to form a lateral wellbore (e.g., using cement or a diverter) may be made based on application considerations. For example, forming the lateral wellbore 214 using the cementing technique illustrated in FIGS. 2A-2G may be preferred if the portion of the main wellbore 202 below the lateral junction is to be isolated. However, the trajectory (e.g., azimuth and inclination) of the lateral wellbore 214 may be better controlled using a diverter 226 rather than using cement 212. Further, as illustrated in FIG. 3C, by controlling the azimuth of the trajectory, only a minimal portion (window) of the casing 204 through which the lateral Wellbore 214 will be formed needs to be removed, allowing a majority of the annular portion of the casing 204 surrounding the lateral junction to remain intact, thus providing a potentially stronger wellbore structure.

Figure 4A:
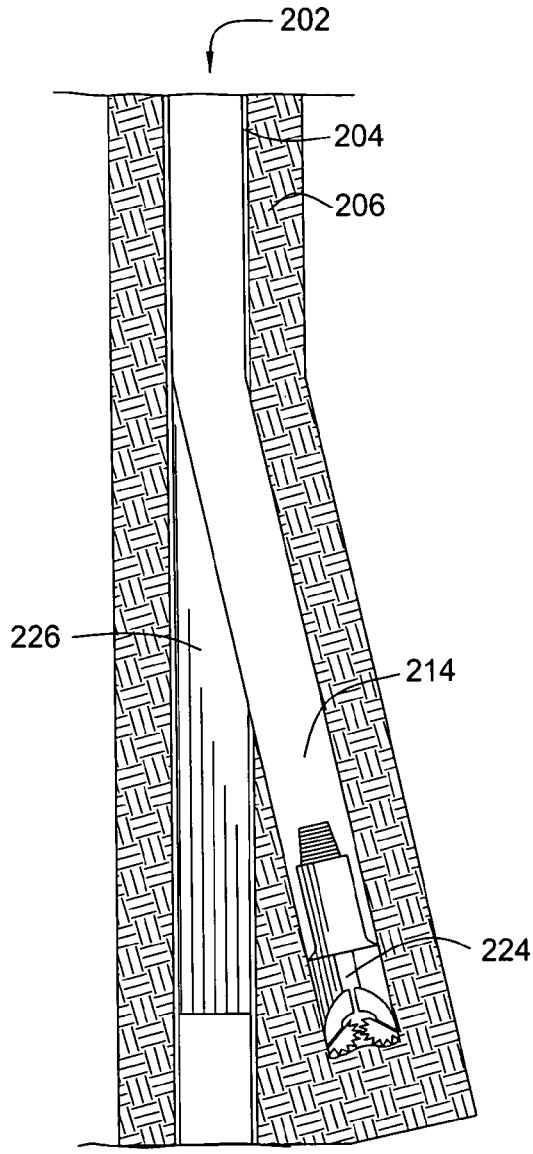
FIGS. 4A-4F show a lateral wellbore at various stages of formation, according to yet another embodiment of the present invention.

As illustrated in FIG. 3C, however, portions 229 of the lateral wellbore 214 may still remain unlined. In some applications, to maximize support of the wellbore structure, it may be desirable to form a fully lined lateral wellbore, where an entire portion of the lateral wellbore 214 extending to the main wellbore 202 is lined. As illustrated in FIGS. 4A-4F, a fully lined lateral wellbore 214 may be constructed by modifying the operations described above with reference to constructing the lateral wellbore 214 of FIGS. 3A-3C. For example, as illustrated in FIG. 4A, the lateral wellbore 214 may still be formed by drilling with an earth removal member, preferably a bit 224, guided by the diverter 226.

Figure 4B:
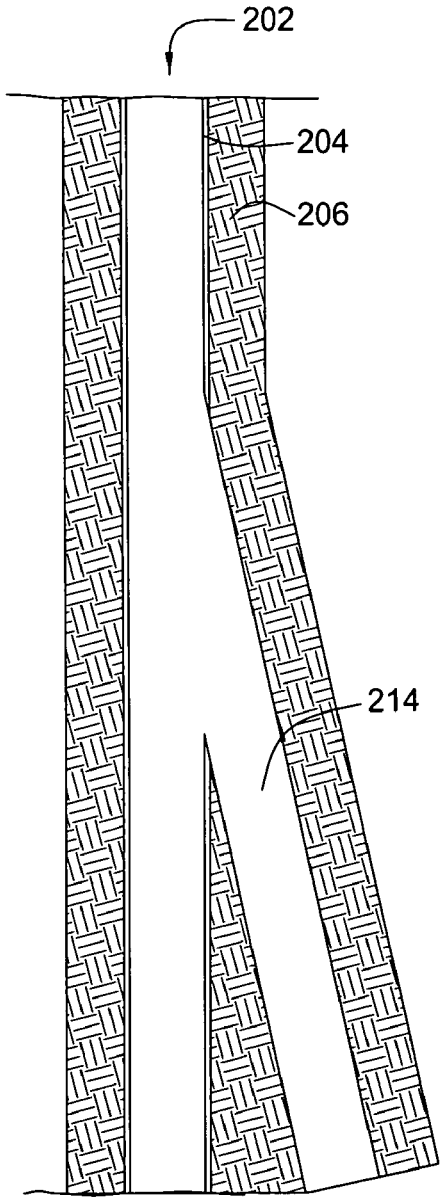
Figure 4C:
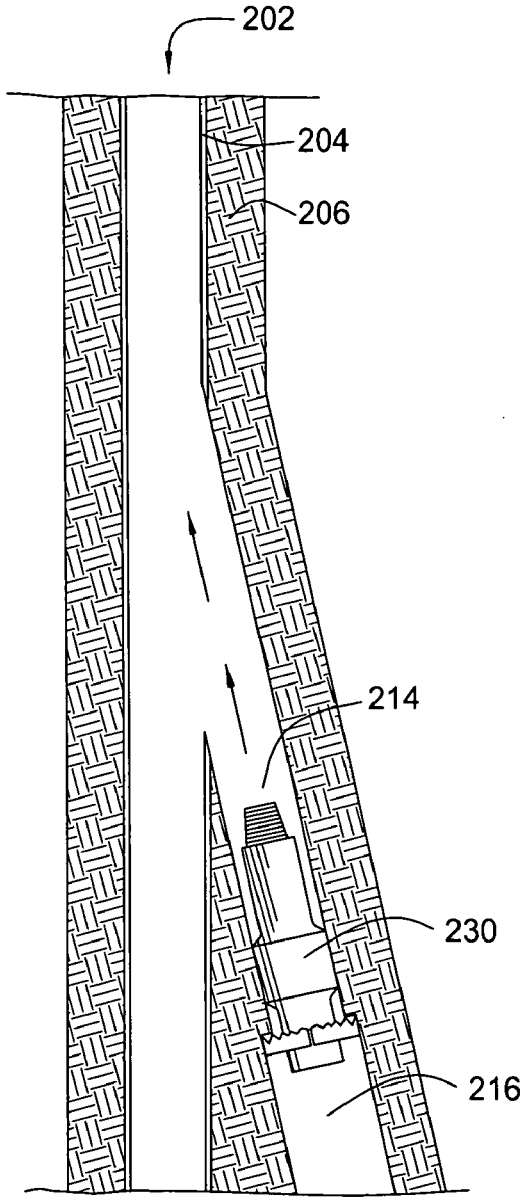

However, as illustrated in FIG. 4B, prior to enlarging the diameter of the lateral wellbore 214, the diverter 226 may be removed. As shown in FIG. 4C, with the diverter 226 removed, the entire length of the lateral wellbore 214 may be enlarged, for example using a back reamer 230 or similar apparatus. An example of an expandable back reamer usable in embodiments of the present invention is described in detail in the commonly assigned, co-pending U.S. patent application Ser. No. 10/259,218 filed on Sep. 27, 2002, entitled "Internal Pressure Indication and Locking Mechanism for a Downhole Tool," which is herein incorporated by reference in its entirety. The back reamer 230 may be run within the lateral wellbore 214 to a controlled depth and operated to expand at least a portion of the lateral wellbore 214 from the controlled depth to the lateral junction.

Figure 4D:
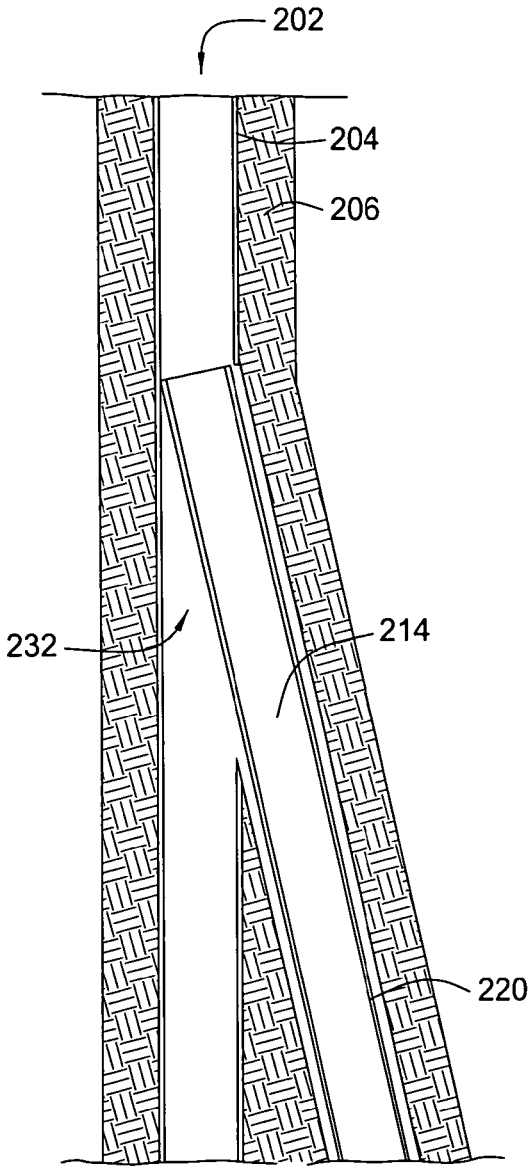
Figure 4E:
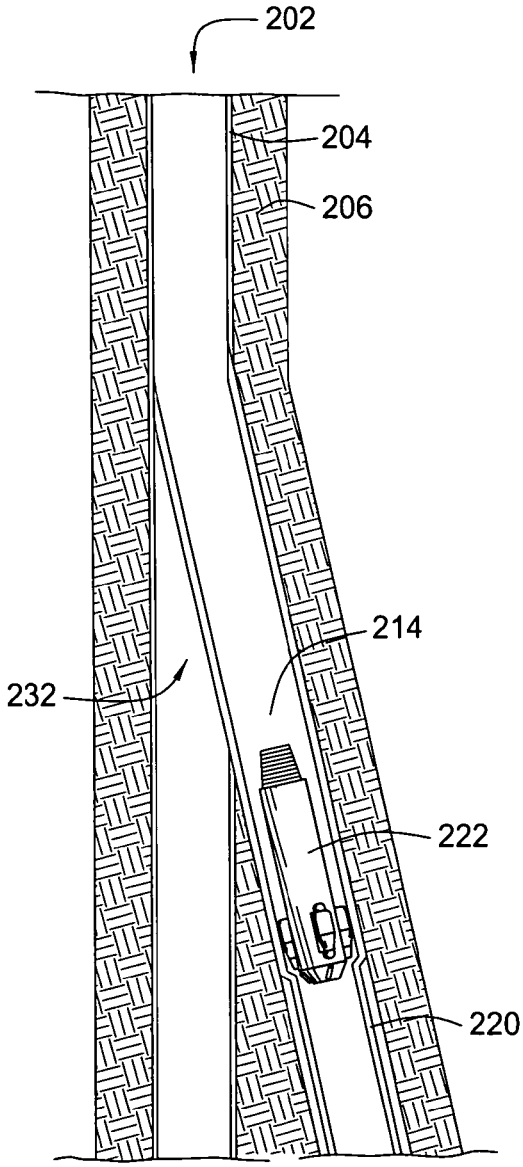
Figure 4F:
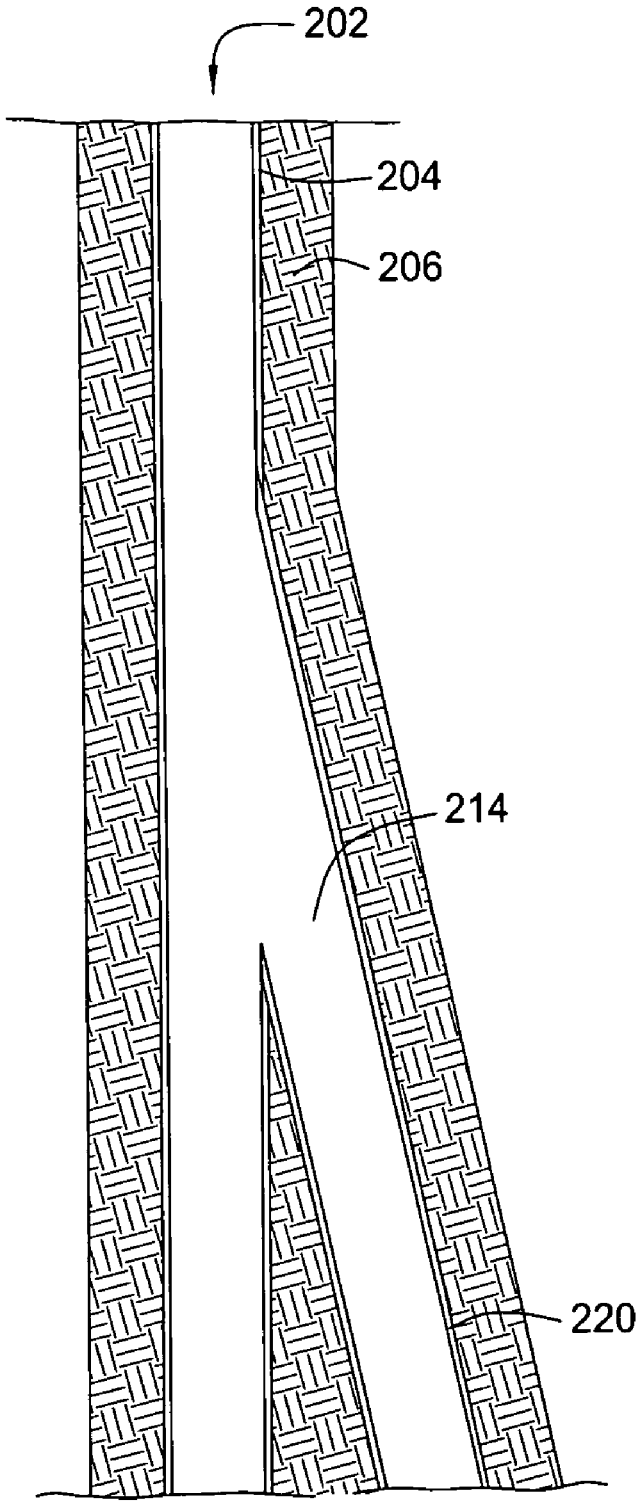

Subsequently, as illustrated in FIG. 4D, an expandable tubular 220 may be run into the lateral wellbore 214 with a portion 232 extending into the main wellbore 202. The tubular 220 may then be expanded using the expander tool 222 to fully line the lateral wellbore 214 up to the main wellbore 202. The portion 232 of the tubular 220 extending into the main wellbore 202 may subsequently be removed using any suitable technique (e.g., drilling, milling, etc.) to leave the fully lined lateral junction illustrated in FIG. 4F.

Referring again to FIG. 1, it should be noted that, while the operations 100 are shown as sequential steps, they do not have to be performed sequentially. As an example, for some embodiments, the operations 104 and 106 may be performed concurrently utilizing a "drilling with liner" or "drilling with casing" technique illustrated in FIGS. 5A-D (e.g., with the expandable bit 218 of FIGS. 2D and 3A or expandable back-reamer 230 of FIG. 4C). Forming the lateral by drilling with casing may reduce time and associated production costs.

Figure 5A:
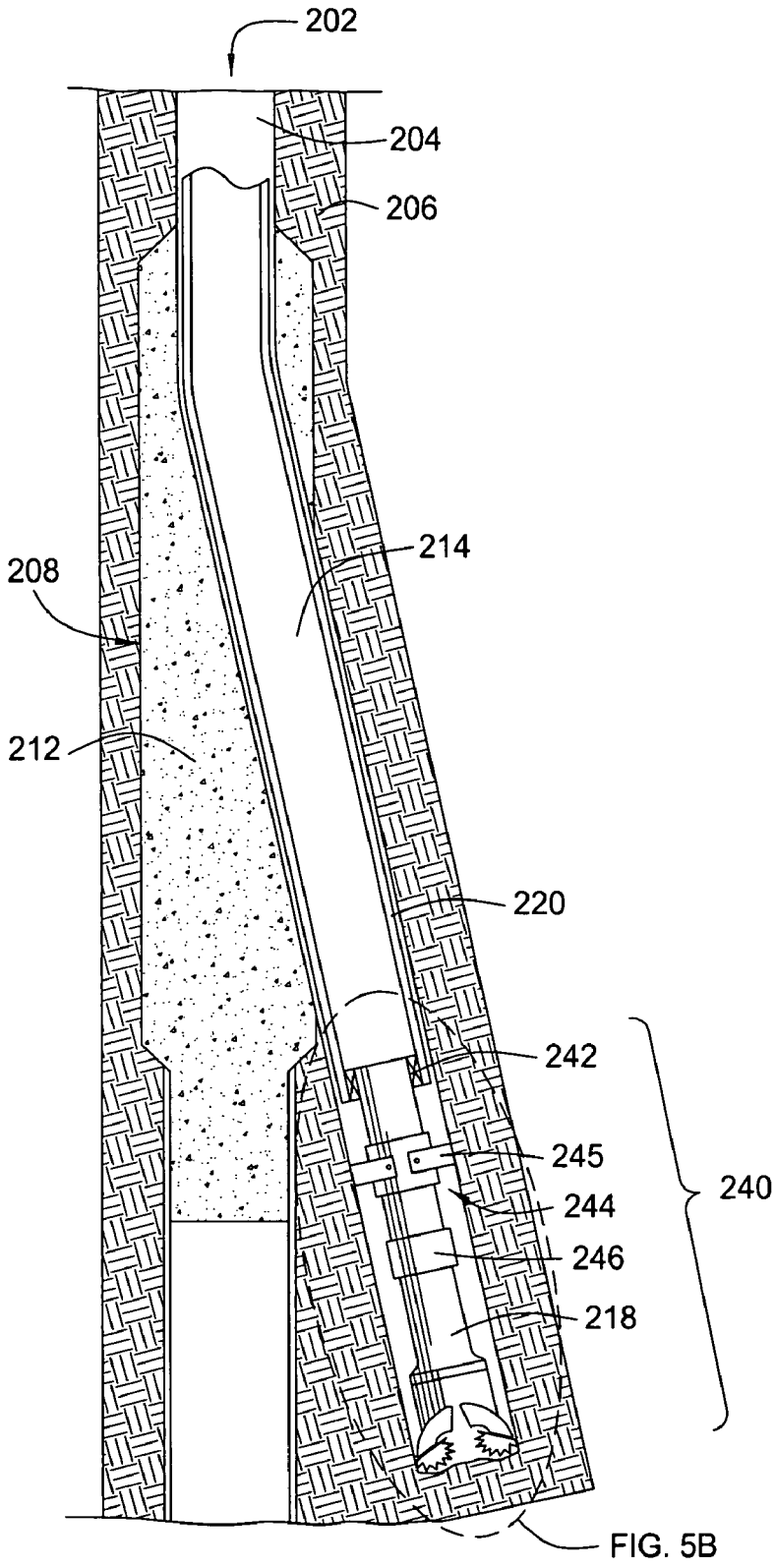
FIGS. 5A-5D show a lateral wellbore formed by drilling with liner at various stages of formation, according to another embodiment of the present invention.

FIG. 5A illustrates one embodiment of a system for drilling with liner including a bottomhole assembly ("BHA") 240 secured to the bottom of an expandable tubular element 220 with a latch 242. For some embodiments, the tubular element 220 may be rotated from the surface of the wellbore 202 to rotate an expandable bit 218 disposed on a bottom of the BHA 240. For other embodiments, the expandable bit 218 may be driven by a drill motor (not shown) included with the BHA 240. For other embodiments, no rotation is necessary to form the deviated lateral wellbore 214, but mere jetting of drilling fluid through the earth removal member 218 and lowering of the tubular element 220 forms the lateral wellbore 214. Any combination of the above drilling methods is also contemplated for use in the present invention. In any case, the lateral wellbore 214 may be formed by deviating from the main wellbore 202 using any of the previously discussed techniques, such as use of a whipstock or drilling through cement 212 (as shown in FIGS. 5A-D). The expandable bit 218 may be placed in a retracted position (shown in FIG. 5B) to run in through the main wellbore casing 202 and expanded after reaching the cement 212, or at some location thereafter, to drill the enlarged lateral wellbore 214.

Figure 5B:
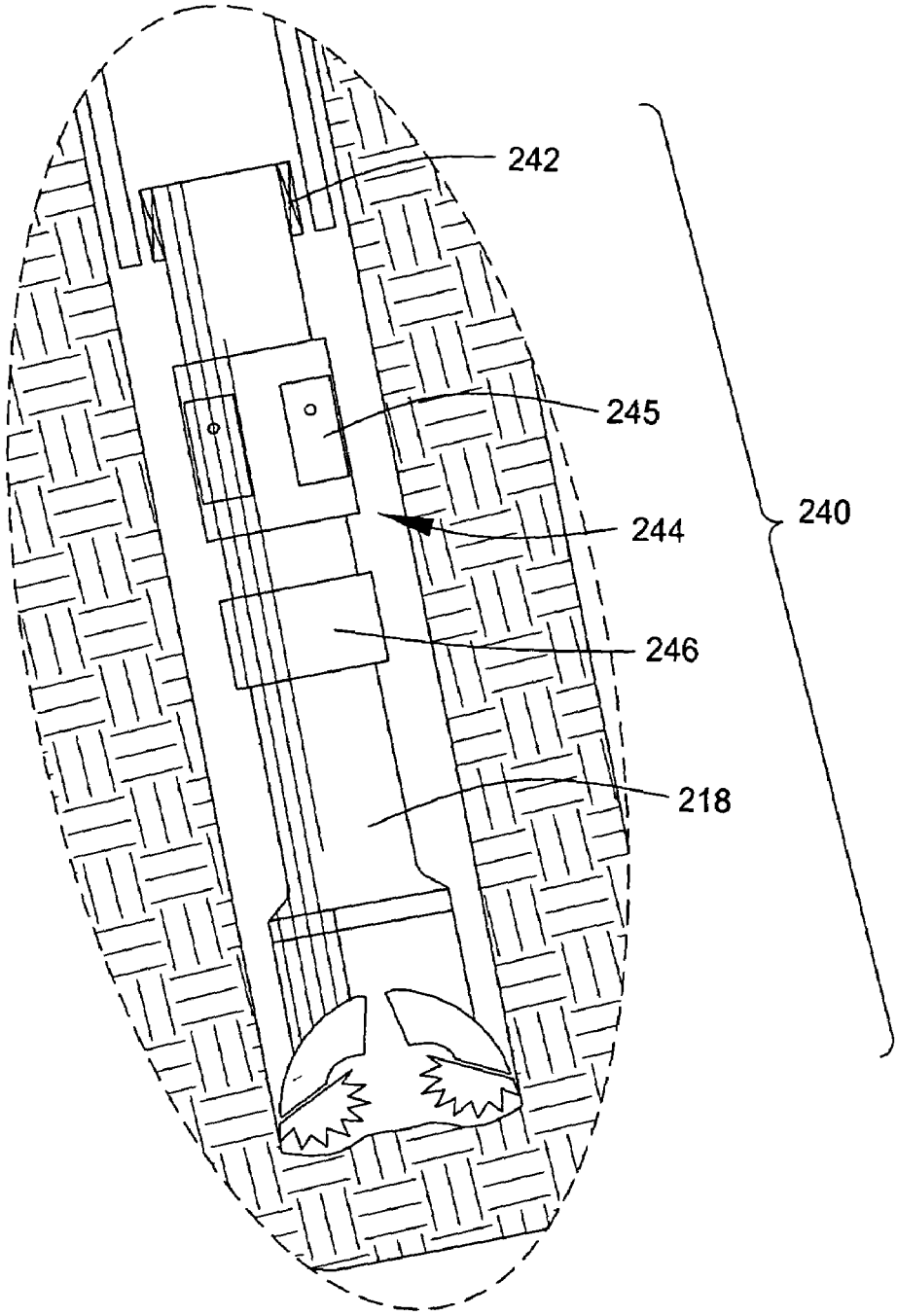

As illustrated in FIGS. 5A-B, to enhance drilling the enlarged lateral wellbore 214, the BHA 240 may include an expandable stabilizer 244 having one or more expandable members 245. The expandable members 245 may be placed in a retracted position (shown in FIG. 5B) to run in through the main wellbore casing 204 and in an expanded position to engage an inner surface of the lateral wellbore 214 while drilling. As illustrated in FIGS. 5A-B, the BHA 240 may also include one or more logging-while-drilling ("LWD") or measurement-while-drilling ("MWD") tools 246, each having one or more sensors to measure one or more downhole parameters, such as conditions in the wellbore (e.g., pressure, temperature, wellbore trajectory, etc.), geophysical parameters (e.g., resistivity, porosity, sonic velocity, gamma ray, etc.), and/or MWD tools that measure formation parameters (e.g., resistivity, porosity, sonic velocity, gamma ray). The tool 246 may have any suitable combination of circuitry to log measured parameters for later retrieval and/or communicate (telemeter) the measured parameters to the surface of the wellbore 202. In either case, taking these measurements while drilling may eliminate an additional pass with similar tools subsequent to drilling.

Once the enlarged lateral wellbore 214 is formed, the expandable tubular element 220 may be expanded, as previously described. Prior to or after the expanding, one or more components of the BHA 240 may be retrieved from the lateral wellbore 214. For example, the BHA 240 may be detached from the tubular element 220 by unlatching the latch 242, the one or more expandable members 245 of the expandable stabilizer 244 may be retracted, and the expandable bit 218 may be retracted to retrieve the entire BHA 240. As an alternative, any or all of the components of the BHA 240 may be left in the lateral wellbore 214, for example if the costs associated with retrieval outweigh the costs of the equipment.

Figure 5C:
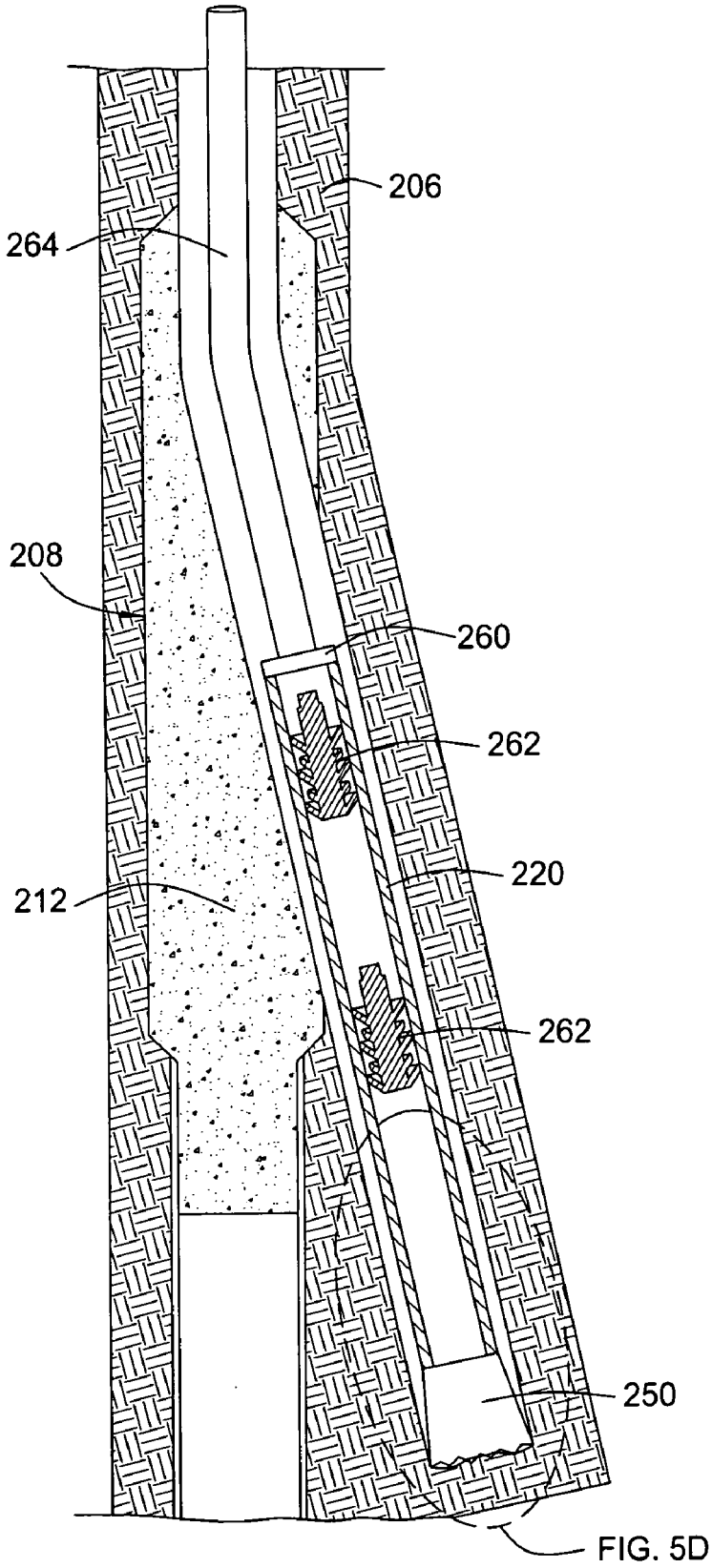

FIG. 5C illustrates another embodiment of a system for drilling with lining comprising an earth removal member, preferably a drilling member 250, operatively connected to a lower portion of an expandable tubular element 220. The drilling member 250 may be an expandable drill bit, such as the expandable drill bit 218 of FIG. 5A, allowing for run-in through the main wellbore casing 204. For some embodiments, in addition to being expandable, the drilling member 250 may also be "drllable," allowing for future expansion of the lateral wellbore 214. For example, at least a portion of the drilling member 250 may be made of a relatively soft alloy and the cutting members may be designed to not damage a subsequent drilling member run in the hole to drill through the drilling member 250. For example, relatively hard cutting members may be designed to break off and be removed with rock formation and other particles in the drilling fluid. In either case, as previously described, the tubular element 220 may be rotated from the surface to rotate the drilling member 250 (e.g., via a drill pipe 264), rotated by a downhole mud motor, jetted into the formation, or any combination thereof.

Figure 5D:
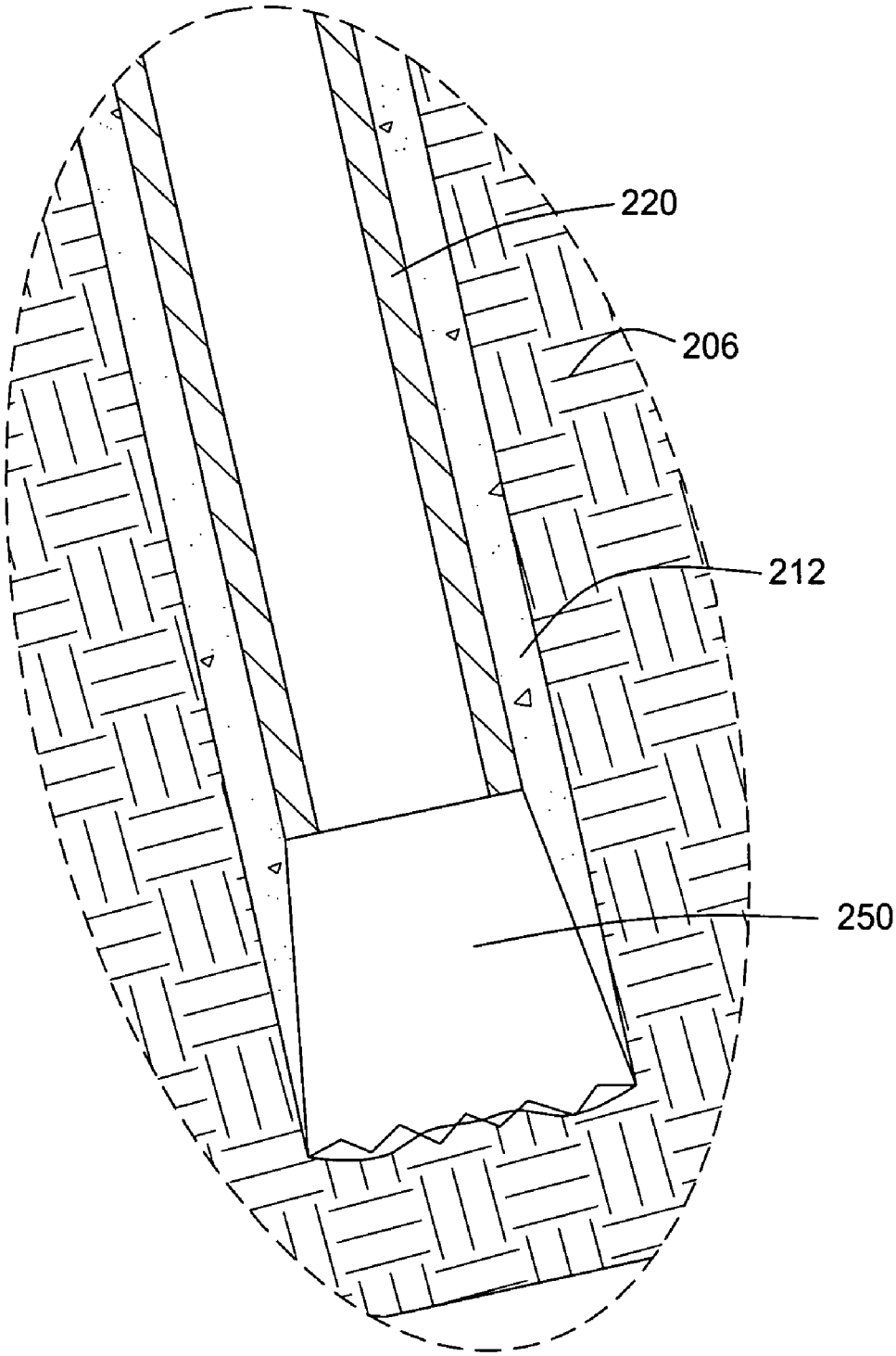

As illustrated in FIG. 5C, a cement tool 260 and one or more cement plugs 262 may be run in with the expandable element 220, allowing the expandable element 220 to be set in place (preferably cemented) within the lateral wellbore 214 by a physically alterable bonding material such as cement 212 flowed into an annulus between the outer diameter of the expandable element 220 and the formation 206, as shown in FIG. 5D. For different embodiments, the expandable element 220 may be expanded before or after flowing the cement 212 downhole. Of course, if the cement 212 is flowed before expanding, the expanding operations should take place prior to the cement setting. Otherwise, the cement 212 may prevent expansion of the tubular element 220 and/or expansion of the tubular element 220 may jeopardize the integrity of the cement 212.

Because of this risk, it may be desirable to have the option of cementing after expansion. For some embodiments, this option may be provided by forming the lateral wellbore 214 with a sufficiently large diameter. In other words, the diameter of the lateral wellbore 214 may be designed to accommodate cement 212 flowing freely to surround the tubular 220 even after expansion. Therefore, the expanding and cementing operations may be performed independently, and the risk of the cement setting prior to completion of the expansion operation may be eliminated.

Through the use of expandable tubulars, embodiments of the present invention provide lined lateral wellbores having an outer diameter greater than the drift diameter of casing lining the main wellbore from which they extend. For some embodiments, the inner diameter of the lateral wellbore casing may be equal to or larger than the inner diameter of the main wellbore casing, thus providing a full-bore lined lateral. Accordingly, downhole tools designed to be run through the main wellbore casing may also be run through the lateral wellbore casing, thus providing greater flexibility in operations performed within the lateral wellbore.

In another embodiment, a substantially monobore well, or at least a cased wellbore which does not increase in diameter with increasing depth or length of the wellbore, is formed in a formation regardless of whether a lateral wellbore is formed. A first casing string and a second casing string may comprise a section of casing or two or more sections of casing connected (preferably threadedly connected) to one another. In one aspect, the first casing string has an enlarged inner diameter into which a second casing string is expanded into so that the inner diameter of the second casing string is at least as large as the inner diameter of the first casing string. In another aspect, a first casing string includes at least one compressible member which may be compressed when a second casing string is expanded into the first casing string, thereby forming a wellbore where the inner diameter of the second casing string is at least as large as the inner diameter of the first casing string.

Figure 6:
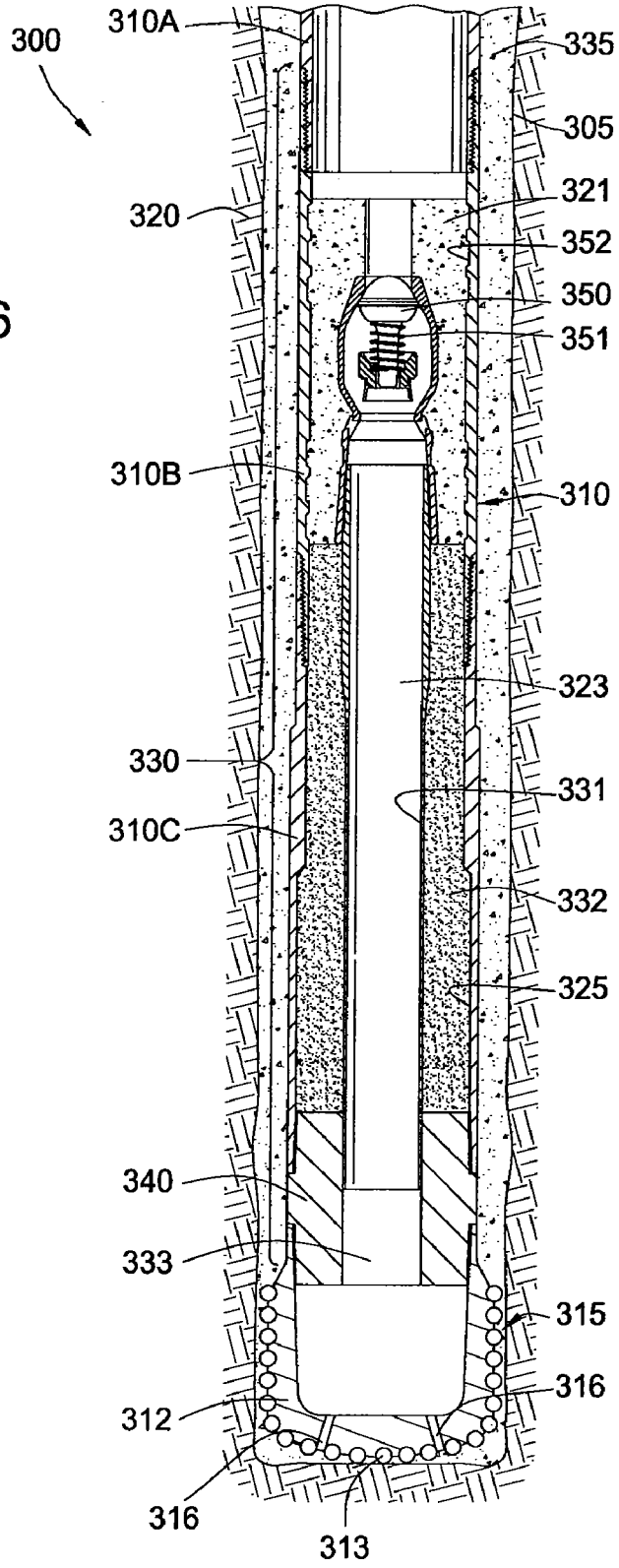
FIG. 6 is a sectional view of an embodiment of a first casing string having an earth removal member attached thereto lowered into the formation to a first depth and set within the formation. A lower portion of the first casing string has a larger inner diameter than an upper portion of the first casing string.

FIG. 6 shows an apparatus 300 of the present invention for use in drilling with casing to form a substantially monobore well, or at least a cased wellbore that does not decrease in diameter with increased depth. A first casing string 310 has a cutting structure 315 attached to its lower end for drilling through a formation 320 to form a wellbore 305. The cutting structure 315 includes any earth removal member. The cutting structure 315 is preferably a drill bit constructed of a drillable material 312 such as aluminum. The cutting structure 315 preferably includes small, substantially spherical cutting members 313, preferably constructed of tungsten carbide or polycrystalline diamond, disposed around the drillable material 312 for use in drilling into the formation 320. The cutting structure 315 has at least one perforation (nozzle) 316 extending therethrough to allow drilling fluid to circulate within the formation 320. The first casing string 310 includes casing sections 310A, 310B, and 310C connected, preferably threadedly connected, to one another. Any number of casing sections may be threadedly connected to one another to form the first casing string 310, or the first casing string 310 may only include one casing section.

A lower portion of an inner diameter of the first casing string 310 has a cut-away portion 325 therein. The cut-away portion 325 of the first casing string 310 has a larger inner diameter than the remaining portion of the first casing string 310 disposed above the cut-away portion 325, so that the cut-away portion 325 is an undercut portion of the first casing string 310. The cut-away portion 325 provides a mating surface for an upper portion of a second casing string 810 (shown in FIG. 7) when the upper portion of the second casing string 810 is expanded into the first casing string 310. The mating surface of the cut-away portion 325 is preferably non-expanding.

Disposed within the inner diameter of the first casing string 310 is a drillable cementing assembly 330 which facilitates the function of cementing an annular space 335 between the outer diameter of the first casing string 310 and the inner diameter of the wellbore 305. The cementing assembly 330, preferably a cement shoe assembly, comprises a longitudinal bore 323 running therethrough, providing a fluid flow path for cement and well fluids. A one-way valve, for example a check valve 350, is located within the longitudinal bore 323. The check valve 350 permits fluid entrance from the well surface through the check valve 350 and into the longitudinal bore 323, yet prevents fluid from passing from the wellbore 305 into a portion of the first casing string 310 above the check valve 350. A spring 351, as shown in FIG. 6, may be used to bias the check valve 350 in a closed position. Any other mechanism which permits one-way fluid flow through the longitudinal bore 323 may be utilized with the present invention.

An annular area 321 adjacent to the check valve 350 and between the inner diameter of the first casing string 310 and the longitudinal bore 323 is filled with a drillable material, preferably cement, to stabilize the longitudinal bore 323. One or more upsets 352 (preferably a plurality of upsets 352) are disposed in the first casing string 310 to hold the cement in place and prevent axial movement thereof. Lining the longitudinal bore 323 between the check valve 350 and a lower end of the first casing string 310 is a tubular member 331. An annular area 332 between the tubular member 331 and the first casing string 310 is filled with an aggregate material such as sand. The purpose of the aggregate material is to support the tubular member 331.

Below the annular area 332 filled with aggregate material is a drillable portion 340. The drillable portion 340 is connected, preferably threadedly connected, to a lower end of the first casing string 310 so that a longitudinal bore 333 running through the drillable portion 340 is in line with the longitudinal bore 323. The drillable portion 340 is constructed of drillable material to support the aggregate material in the annular space 332 and has wear-resistant characteristics so that the material is not affected by hydraulic pressure characteristic of the wellbore 305 conditions. Preferably, the drillable portion 340 is formed of a solid material, and even more preferably, with a composite material such as fiberglass.

One or more grooves (not shown) may be disposed on an outer portion of the drillable material 340 around the perimeter of the drillable material 340 where the drillable material 340 meets the first casing string 310. The groove ensures that the drillable portion 340 falls away from the first casing string 310 as the second casing string 810 drills through the first casing string 310, as described below. Disposed in an upper portion of the drillable material 340 are one or more radially extending voids (not shown) formed in the composite material which extend from the first casing string 310 inward to terminate adjacent to the tubular member 331. The voids in the composite material ensure that the outermost portions of the drillable material 340 fall away from the first casing string 310 as the second casing string 810 drills through the first casing string 310.

Figure 7:
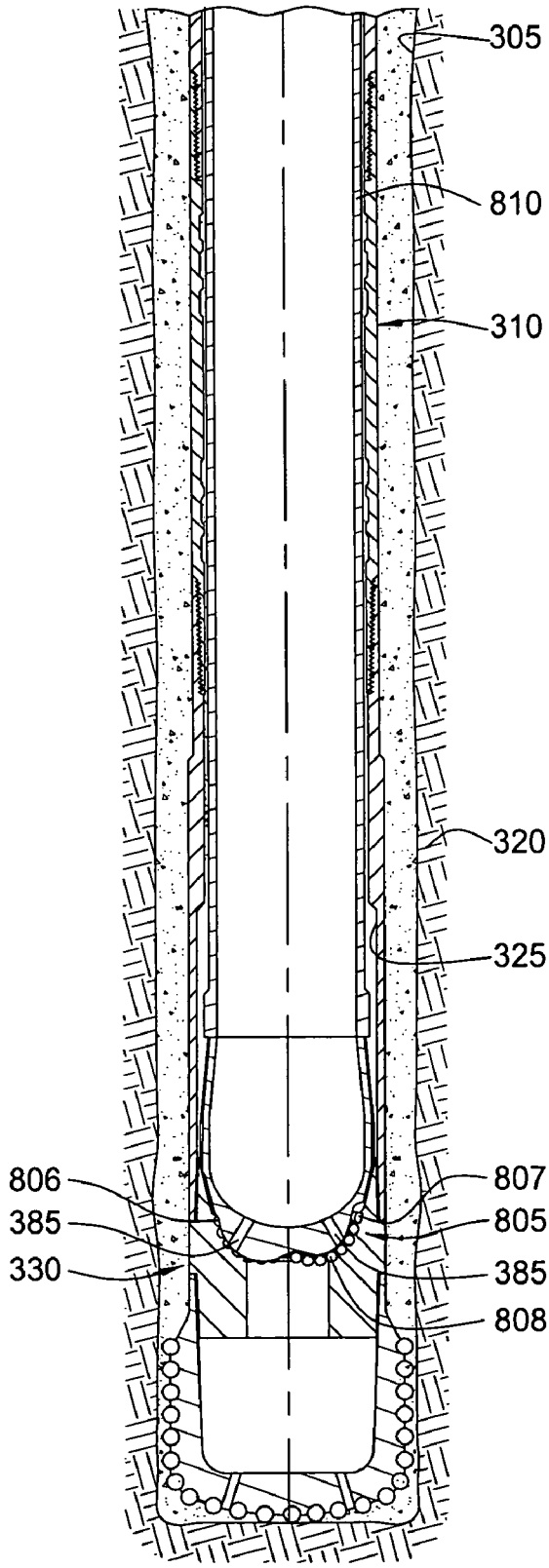
FIG. 7 shows the first casing string of FIG. 6 where a second casing string having an expandable cutting structure attached thereto is lowered through an inner diameter of the first casing string. The expandable cutting structure is in the retracted, closed position.
Figure 8:
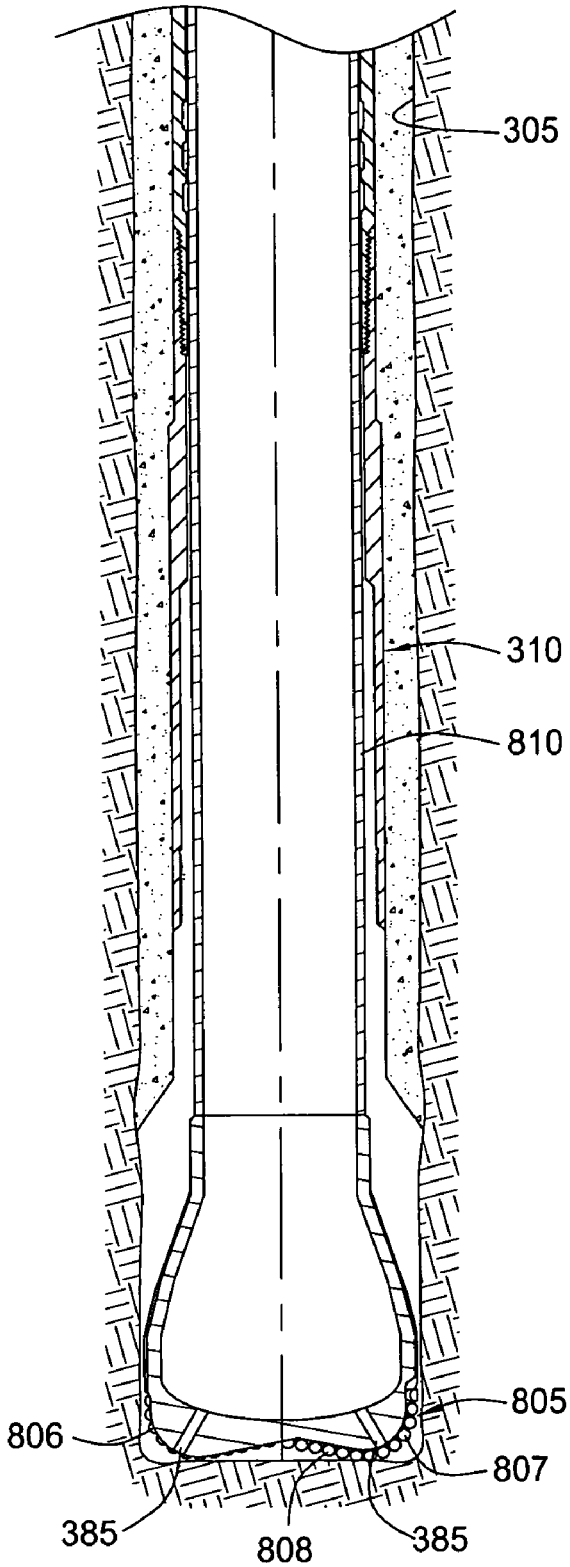
FIG. 8 shows the first casing string of FIG. 6, where the second casing string has drilled through the first casing string and the earth removal member attached to the first casing string. The expandable cutting structure is shown expanded into the open position to drill the second casing string to a second depth within the formation.
Figure 9:
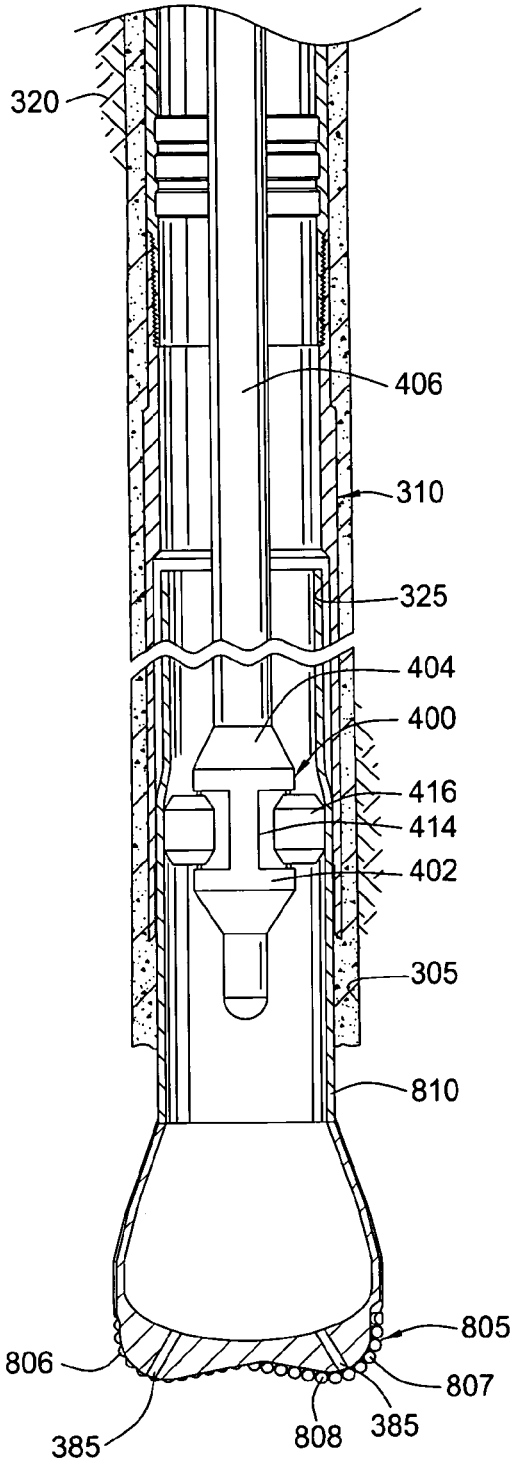
FIG. 9 shows the first casing string of FIG. 6, where the second casing string is drilled into the formation to the second depth and is being radially expanded into contact with the inner diameter of the first casing string.
Figure 10:
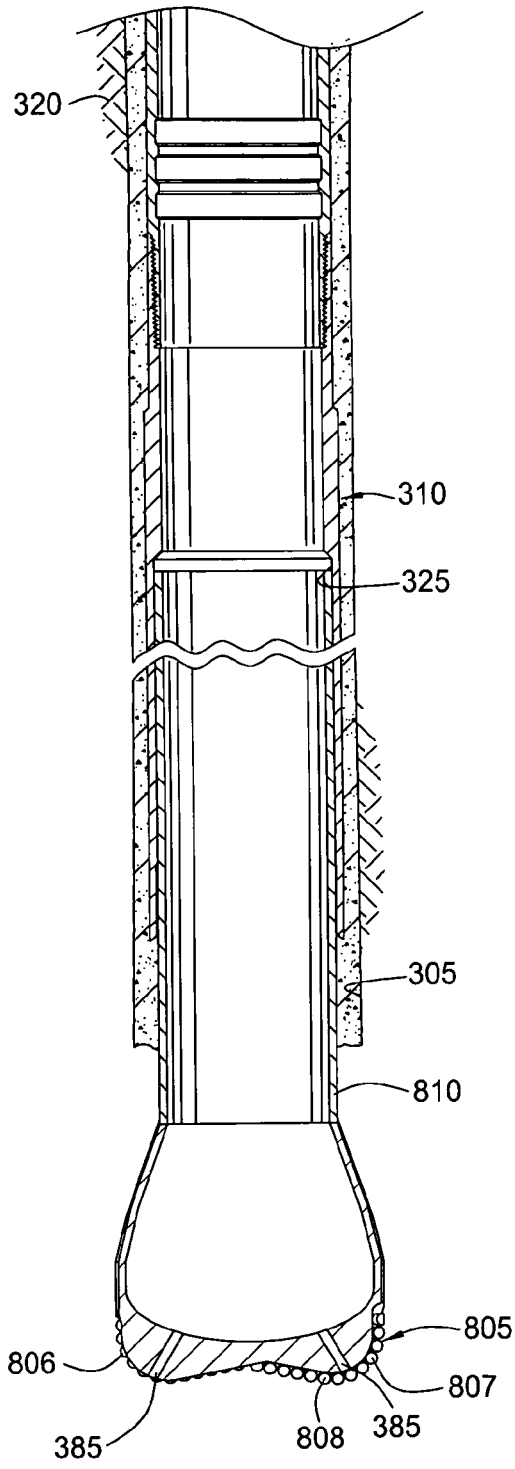
FIG. 10 shows the first casing string of FIG. 6, where the second casing string is expanded into contact with the inner diameter of the first casing string. The second casing string is set within the formation to form a substantially monobore well.

FIG. 7 depicts the second casing string 810 drilling through the first casing string 310. The second casing string 810 has an expandable earth removal member, preferably an expandable cutting structure 805, operatively connected to its lower end. The expandable cutting structure 805 is extendable and retractable between a closed, retracted position shown in FIG. 7 and an open, expanded position, as shown in FIG. 8 (also described above in relation to FIGS. 1-5). The expandable cutting structure 805 is in the closed position while drilling through the cementing assembly 330 within the first casing string 310 because the expandable cutting structure 805 is too large in diameter to travel through the first casing string 310 while in the open position. The expandable cutting structure 805 is manipulated into the open position to drill into the formation 320 to a second depth at which to set the second casing string 810 at the end of the operation, as shown in FIGS. 8-10. In the closed position, the expandable cutting structure 805 is smaller in diameter than in the open position.

An example of an expandable cutting structure 805 in the form of an expandable drill bit is disclosed in U.S. application Ser. No. 10/335,957 filed on Dec. 31, 2002, which is herein incorporated by reference in its entirety.

The expandable cutting structure 805 generally includes a set of blades 806, 807 which move between the open and closed position. Hydraulic fluid flowing through the expandable cutting structure 805 controls the movement of the blades 806, 807 between the open and closed position.

The expandable cutting structure 805 is preferably an expandable drill bit. A plurality of cutting members 808 is disposed on an outer portion of the blades 806, 807. The cutting members 808 are typically small and substantially spherical and may be made of tungsten carbide or polycrystalline diamond surfaces. The blades 806, 807 are constructed and arranged to permit the cutting members 808 to contact and drill into the earth when the blades 806, 807 are expanded outward and not ream the wellbore 305 or surrounding casing string 310 when the blades 806, 807 are collapsed inward.

Generally, one or more nozzles 385 of the expandable cutting structure 805 are in fluid communication with a longitudinal bore through the second casing string 810. The nozzles 385 allow jetting of the drilling fluid during the drilling operation through the first casing string 310 to remove any cutting build-up which may gather in front of the blades 806, 807. The nozzles 385 also permit jetting of the drilling fluid during the drilling operation through the formation 320 below the first casing string 310 to form a path for the second casing string 810 through the formation 320. Furthermore, the nozzles 385 are used to create a hydraulic pressure differential within the bore through the second casing string 810 to cause the blades 806, 807 of the expandable cutting structure 805 to expand outward, as described in U.S. application Ser. No. 10/335,957, incorporated by reference above.

FIG. 9 illustrates the second casing string 810 being expanded into the first casing string 310 by an expander tool 400. Any expander tool may be used with the present invention which is capable of expanding the second casing string 810 by elastic or plastic deformation radially outward, preferably into contact with the first casing string 310, including a mechanical expander such as an expander cone. The expander tool 400 depicted in FIG. 9 is used to expand the second casing string 810 from the lower end of the second casing string 810 upward with pressurized fluid supplied through a working string 406. In the alternative, the expander tool 400 may be used to expand the second casing string 810 from the top down. The expander tool 400 includes a body 402 which is hollow and generally tubular with a connector 404 for connection to the working string 406. The body 402 includes one or more recesses 414 to hold a respective roller 416. Each of the mutually identical rollers 416 is near-cylindrical and slightly barreled. Each of the rollers 416 is mounted by means of a bearing (not shown) at each end of the respective roller for rotation about a respective rotation axis which is parallel to the longitudinal axis of the expander tool 400 and radially offset therefrom. The inner end of a piston (not shown) is exposed to the pressure of fluid within the hollow core of the expander tool 400, and the pistons serve to actuate or urge the rollers 416 against the inner diameter of the second casing string 810 therearound.

In FIG. 9, the expander tool 400 is shown in an actuated position and is expanding the diameter of the second casing string 810 radially outward, preferably into the inner diameter of the wellbore 305 and into the cut-away portion 325 of the first casing string 310. Typically, the expander tool 400 rotates as the rollers 416 are actuated and the expander tool 400 is urged upwards in the wellbore 305. In this manner, the expander tool 400 can be used to enlarge the diameter of the second casing string 810 circumferentially to a uniform size along a predetermined length in the wellbore 305.

Figure 11:
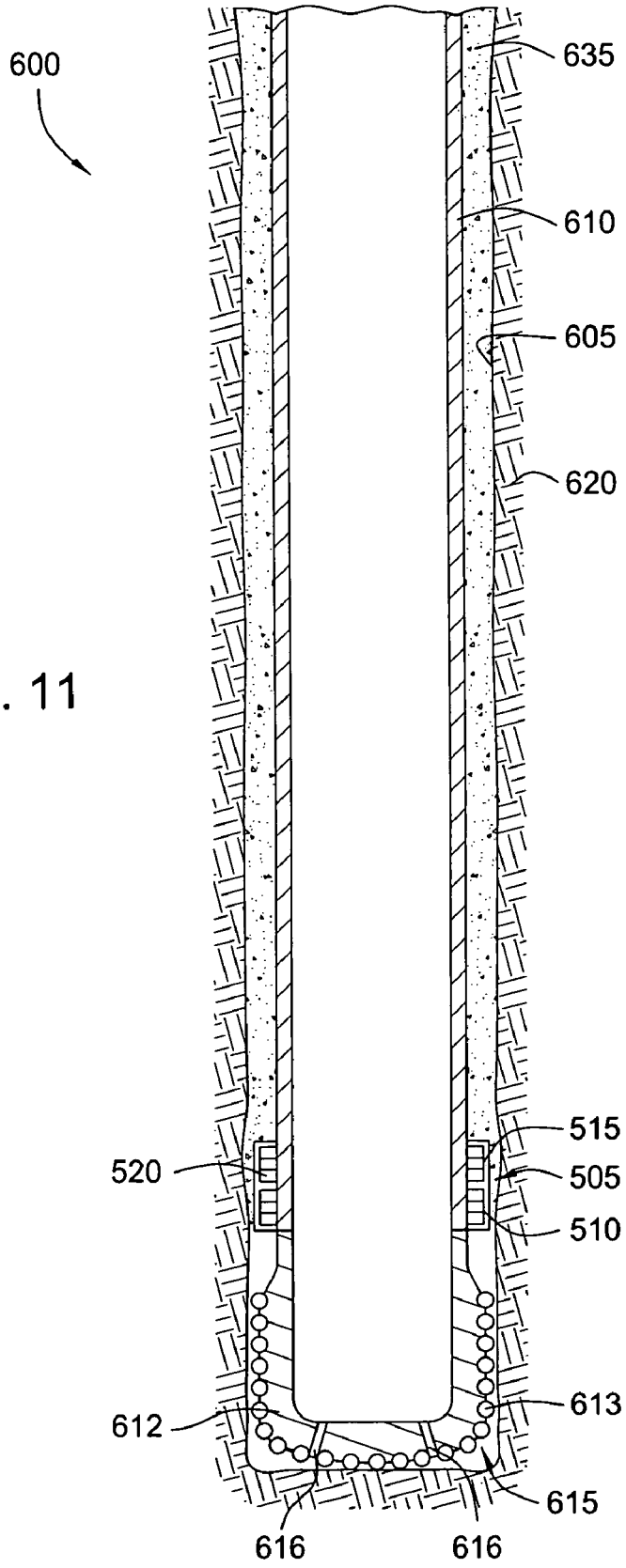
FIG. 11 is a sectional view of an alternate embodiment of a first casing string having an earth removal member attached thereto lowered into the formation to a first depth and set within the formation. An attenuator is attached to a lower portion of an outer diameter of the first casing string.

FIG. 11 depicts an alternate embodiment of an apparatus 600 of the present invention. A first casing string 610 has an earth removal member, preferably a cutting structure 615, operatively attached to its lower end. The cutting structure 615 is preferably a drill bit constructed of a drillable material 612, preferably aluminum, and small, substantially spherical cutting members 613, preferably constructed of tungsten carbide or polycrystalline diamond, disposed around the drillable material 612 for drilling into a formation 620. The cutting structure 615 includes any earth removal member. The cutting structure 615 has at least one perforation (nozzle) 616 extending therethrough to allow drilling fluid to circulate within the formation 620 while drilling.

An attenuator 505 is disposed on or in the first casing string 610. In the embodiment shown, the attenuator 505 is disposed circumferentially around an outer diameter of a lower end of the first casing string 610. The attenuator 505 is preferably compressible due to radial force, but capable of withstanding hydrostatic pressure within a wellbore 605. Cement or another comparable physically alterable bonding material must be capable of bonding to the attenuator 505. Preferably, the attenuator 505 is constructed of compressible aluminum.

The attenuator 505 includes a wall 510 located a distance radially from the outer diameter of the first casing string 610. The wall 510 is connected to the first casing string 610 by one or more webs 515, preferably a plurality of webs 515, extending radially therefrom. In between the plurality of webs 515 is at least one void area 520. The wall 510 and the plurality of webs 515 prevent cement and other fluids from entering the void areas 520, so that the webs 515 compress into the void areas 520 upon radial force exerted by an expander tool 400 (see FIG. 14A).

In an alternate embodiment, the attenuator 505 may be constructed of a compressible material with voids disposed therein. In this embodiment, because the material is inherently compressible, the webs 515 and the void areas 520 are not necessary. Preferably in this embodiment, the attenuator 505 is constructed of a porous material which is compressible due to radial force, but withstands hydrostatic pressure. More preferably, the attenuator 505 is constructed of styrofoam.

Figure 12:
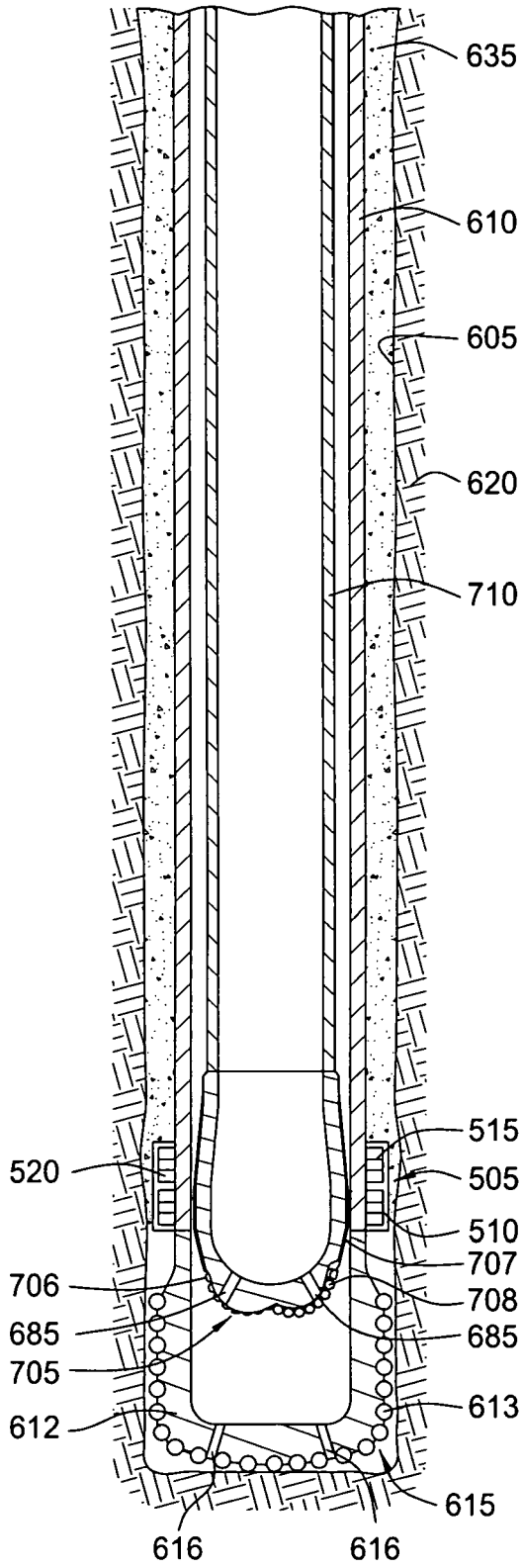
FIG. 12 shows the first casing string of FIG. 11 being drilled through by a second casing string having an expandable cutting structure attached thereto. The expandable cutting structure is in the retracted, closed position.
Figure 13:
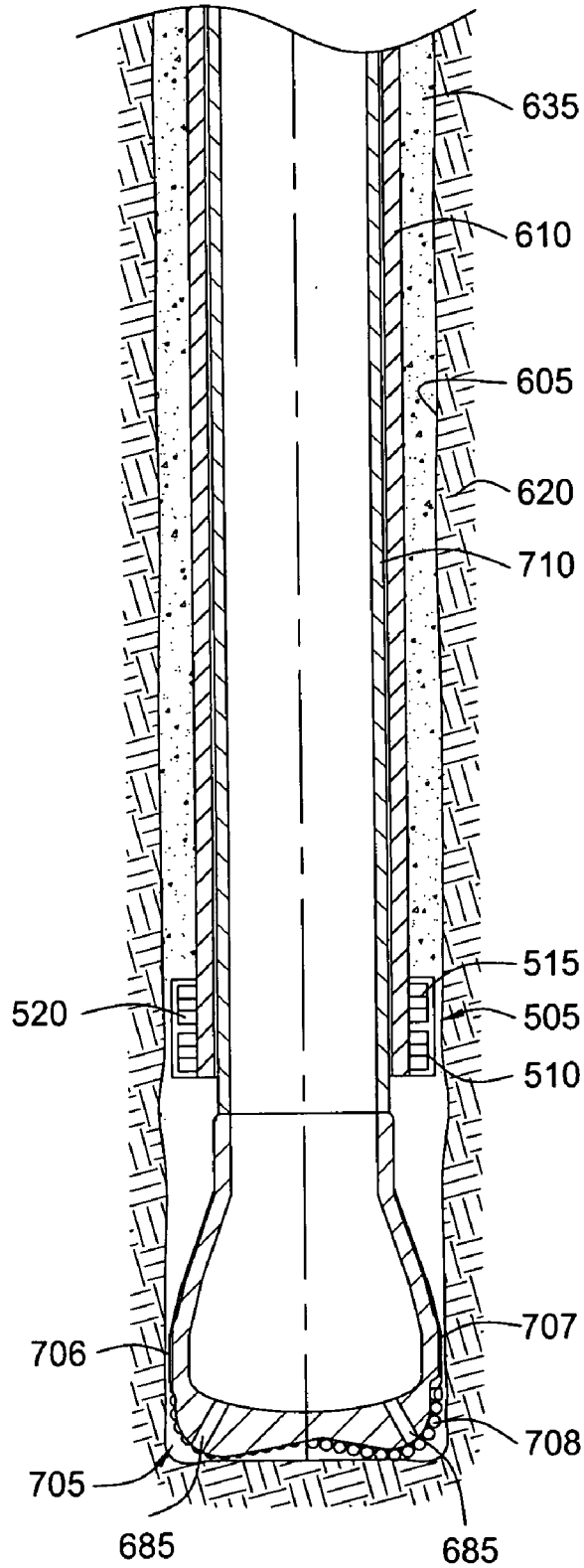
FIG. 13 shows the first casing string of FIG. 11, where the second casing string has drilled through the first casing string and the earth removal member attached to the first casing string. The expandable cutting structure is in the expanded, open position to drill into the formation to a second depth.
Figure 14:
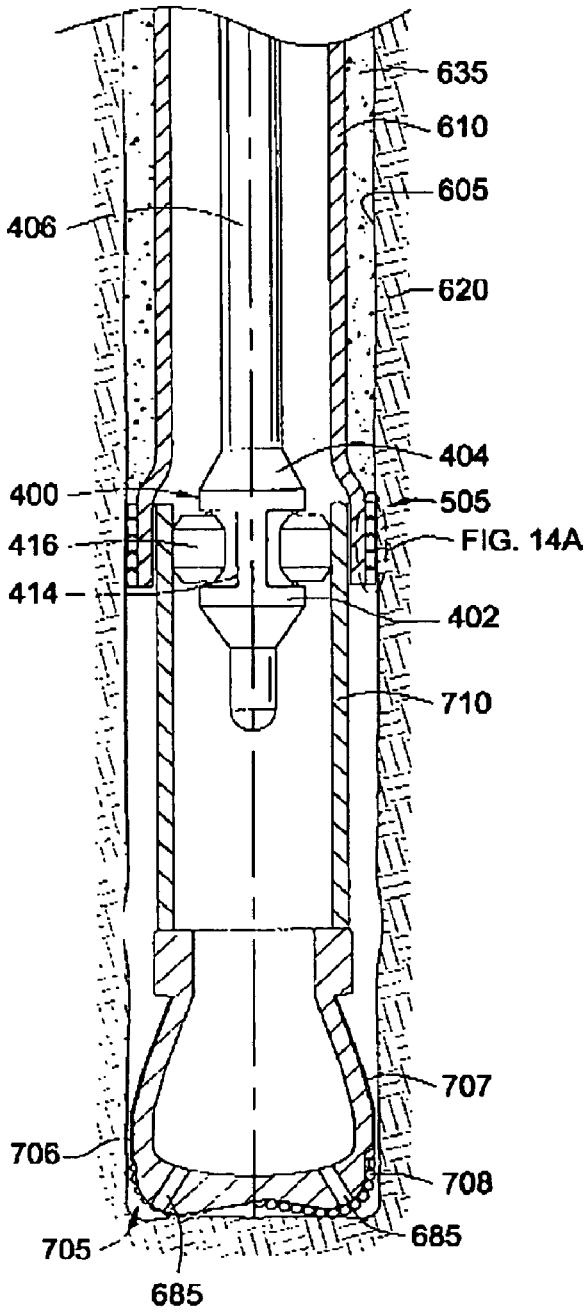
FIG. 14 shows the second casing string being expanded into the first casing string of FIG. 11 to form a substantially monobore well. The attenuator is compressed by the force exerted during the expansion process.

FIGS. 12-13 depict a second casing string 710 with an expandable earth removal member, preferably an expandable cutting structure 705, operatively connected to its lower end. The expandable cutting structure 705 and the second casing string 710 are substantially identical in structure and operation to those described above in relation to FIGS. 6-10. FIG. 14 shows the expander tool 400, which is substantially identical in structure and operation to the expander tool 400 of FIG. 9, expanding the second casing string 710 into contact with the first casing string 610. The attenuator 505 is shown compressed by the expander tool 400 in FIGS. 14 and 14A.

In the operation of the first embodiment illustrated in FIGS. 6-10, the first casing string 310 with the cutting structure 315 attached thereto is lowered into the formation 320 with a draw works (not shown), for example, and at least a portion of the first casing string 310 (e.g., the cutting structure 315) may optionally be simultaneously rotated, preferably by a top drive (not shown) or a mud motor (not shown). While the first casing string 310 is being drilled into the formation 320, drilling fluid is simultaneously introduced into the inner diameter of the first casing string 310. Referring to FIG. 6, the fluid flows through the first casing string 310, through the check valve 350, through the longitudinal bore 323, through the perforations 316 in the cutting structure 315, and up through the annular space 335. The check valve 350 prevents the fluid from flowing back up through the first casing string 310 to the surface, thus forcing the fluid out into the formation 320.

After the first casing string 310 is drilled to the desired depth within the formation 320, the flow of drilling fluid is halted. To determine when the first casing string 310 has reached the desired depth within the formation 320, logging-while-drilling or measuring-while-drilling may be utilized, as is known by those skilled in the art. Specifically, one or more logging and/or measuring tools may be employed within or on the first casing string 310 to determine by measuring one or more geophysical parameters in the formation 320 whether the first casing string 310 is proximate to the desired location. Exemplary geophysical parameters which may be sensed within the formation 320 include but are not limited to resistivity of the formation 320, pressure, and temperature.

A physically alterable bonding material, preferably a setting fluid such as cement, may then be introduced into the first casing string 310. A volume of cement is introduced into the first casing string 310 which is sufficient to fill at least a portion of the annular space 335 between the first casing string 310 and the wellbore 305, thus cementing the first casing string 310 into the formation 320. The cement flows through the first casing string 310, through the check valve 350, through the longitudinal bore 323, through the perforations 316 in the cutting structure 315, and up through the annular space 335. The check valve 350 prevents the cement from flowing back up through the casing string 310 to the surface, thus forcing the cement flow out into the formation 320. After the cement is pumped into the wellbore 305, drilling fluid may optionally be pumped into the first casing string 310 to ensure that most of the cement exits the lower end of the cutting structure 315. FIG. 6 shows the first casing string 310 set at the desired depth within the formation 320 by cement within the annular space 335.

Once the first casing string 310 has been set within the formation 320 when the cement cures, the second casing string 810 is utilized to drill through the drillable cementing assembly 330 within the first casing string 310. The outer diameter of the second casing string 810 is necessarily smaller than the inner diameter of the first casing string 310, so that the second casing string 810 fits within the first casing string 310. Similarly, the largest portion of the expandable cutting structure 805 must be smaller than the inner diameter of the first casing string 310 while the expandable cutting structure 805 is in the retracted position.

The second casing string 810 is lowered (e.g., by the draw works) into the inner diameter of the first casing string 310 while optionally a portion of the first casing string 315 is being rotated by the top drive or mud motor. At the same time, drilling fluid is introduced into the inner diameter of the second casing string 810. The drilling fluid forces the drillable portions within the inner diameter of the first casing string 310 upward toward the surface and forms a path through the first casing string 310 for the expandable cutting structure 805 to travel.

FIG. 7 shows the second casing string 810 drilling through the inner diameter of the first casing string 310. Specifically, the second casing string 810 drills through and substantially destroys the drillable cementing assembly 330, including the check valve 350, the cement within the annular area 332, the tubular member 331, and the drillable portion 340. When the expandable cutting structure 805 drills to the cut-away portion 325, the inner diameter of the cut-away portion 325 may be too large for the expandable cutting structure 805 to reach while in the closed position; therefore, the voids in the drillable material 340 ensure that the portion of the drillable material 340 between the inner diameter of the first casing string 310 and the outermost portion of the expandable cutting structure 805 falls out. In the alternative, the expandable cutting structure 805 may be expanded to the open position to drill through the drillable material 340 within the cut-away portion 325. Finally, the expandable cutting structure 805 drills through the cutting structure 315. The drillable material 312 on the cutting structure 315 is destroyed, while the cutting members 313 are washed up toward the surface around the outer diameter of the second casing string 810 by the drilling fluid circulated through the wellbore 305.

After the expandable cutting structure 805 has destroyed the cutting structure 315, the expandable cutting structure 805 is actuated so that the blades 806, 807 are in the extended position. The blades 806, 807 are extended when the nozzles 385 cause a hydraulic pressure differential within the second casing string 810, as described in the above-mentioned patent application which was incorporated by reference. In the extended position, the blades 806, 807 are capable of forming a portion of the wellbore 305 below the first casing string 310 with a larger inner diameter than the inner diameter of the first casing string 310 so that the second casing string 810 may be expanded to have the same inner diameter as the first casing string 310, thus forming a substantially monobore well.

The second casing string 810 is then lowered and optionally at least a portion of the second casing string 810 is rotated while circulating drilling fluid so that the second casing string 810 is drilled to a second depth within the formation 320. The inner diameter of the wellbore 305 below the first casing string 310 is larger than the inner diameter of the casing string 310. FIG. 8 shows the extended expandable cutting structure 805 drilling within the formation 320 to a second depth.

Next, the expander tool 400 is lowered into the inner diameter of the first casing string 310 and the second casing string 810. Fluid is introduced through the working string 406 so that the pistons urge the rollers 416 against the inner diameter of the second casing string 810. The expander tool 400 rotates as the rollers are actuated and the expander tool 400 is urged upwards in the wellbore 305, so that the second casing string 810 is expanded along its length. A portion of the second casing string 810 is expanded into contact with the cut-away portion 325. As shown in FIG. 9, the upper portion of the second casing string 810 is expanded into contact with the cut-away portion 325. In another aspect, a portion of the second casing string 810 is expanded into contact with the cut-away portion 325, and the portion of the second casing string 810 located above the cut-away portion 325 and extending into the inner diameter of the first casing string 310 is cut off of the second casing string 810.

The expander tool 400 may be removed from the wellbore 305 after expansion of the second casing string 810 is completed. FIG. 10 shows a portion of the second casing string 810 expanded into contact with the cut-away portion 325 of the first casing string 310 and a remaining portion of the second casing string 810 expanded into the wellbore 305. The inner diameter of the portion of the second casing string 810 below the first casing string 310 is at least at large as the inner diameter of the first casing string 310, so that the inner diameter of the cased wellbore does not decrease with increased depth within the wellbore 305. FIG. 10 shows essentially a monobore well, which denotes a wellbore which has substantially the same diameter at every depth and length. Additional casing strings may be used to drill through the second casing string 810. The additional casing strings and the second casing string 810 may include cut-away portions 325 with drillable portions 340 located therein and may be expanded into the previous casing strings.

After removal of the expander tool 400 from the wellbore 305, a cementing operation may optionally be conducted to cement the second casing string 810 within the formation 320. A physically alterable bonding material such as cement is introduced into the inner diameter of the first casing string 310, then flows through the inner diameter of the second casing string 810, through the nozzles 385, and up through the annular space 335. Additional casing strings with expandable cutting structures operatively attached thereto may be used to drill through the expandable cutting structure 805 and the additional expandable cutting structures.

In the operation of the second embodiment shown in FIGS. 11-14A, the first casing string 610 with the cutting structure 615 operatively attached thereto is lowered and optionally at least a portion of the first casing string 610 is rotated as described above in relation to the casing string 310 of FIGS. 6-10. While the casing string 610 is being drilled into the formation 620, drilling fluid is simultaneously introduced into the inner diameter of the casing string 610 so that the fluid flows through the casing string 610, through the perforations 616 in the cutting structure 615, and up through the annular space 635 between the first casing string 610 and the formation 620.

The first casing string 610 is drilled to the desired depth within the formation 620. To determine when the first casing string 610 has reached the desired depth within the formation 620, logging-while-drilling and/or measuring-while-drilling may be utilized, as is known by those skilled in the art. Specifically, one or more logging tools and/or measuring tools may be employed to determine by measuring one or more geophysical parameters in the formation 620 whether the first casing string 610 is proximate to the desired location. Exemplary geophysical parameters which may be sensed within the formation 620 include but are not limited to resistivity of the formation 620, pressure, and temperature.

After the first casing string 610 is drilled to the desired depth within the formation 620, the flow of drilling fluid is halted. A physically alterable bonding material, preferably a setting fluid such as cement, may then optionally be introduced into the first casing string 610 to fill at least a portion of the annular space 635 as described above in relation to the first casing string 310 of FIGS. 6-10. The cement flows through the first casing string 610, through the perforations 616 in the cutting structure 615, and up through the annular space 635 past the attenuator 505. After the cement is pumped into the wellbore 605, drilling fluid may optionally be pumped into the first casing string 610 to ensure that most of the cement exits the lower end of the cutting structure 615. FIG. 11 shows the first casing string 310 set at the desired depth within the formation 620 by cement within the annular space 635. Cement bonds with the wall 510 of the attenuator 505.

Next, the second casing string 710 is lowered and optionally at least a portion of the second casing string 710 is rotated into the first casing string 610 as described in relation to casing strings 310 and 810 of FIGS. 6-10. Drilling fluid is simultaneously circulated through the second casing string 710, out the nozzles 685, and up through the annular space between the first casing string 610 and the second casing string 710. Initially, the expandable cutting structure 705 is in the retracted position as it travels through the inner diameter of the first casing string 610. FIG. 12 shows the second casing string 710 running into the first casing string 610 with the expandable cutting structure 705 in the retracted position.

The expandable cutting structure 705 is then used to drill through the drillable material 612 of the cutting structure 615. The fluid circulating within the wellbore 605 carries the cutting members 613 through the annular space between the inner diameter of the first casing string 610 and the outer diameter of the second casing string 710 toward the surface. The expandable cutting structure 705 is then extended to the open position below the first casing string 605 as described above in relation to the expandable cutting structure 805 of FIGS. 6-10. FIG. 13 shows the expandable cutting structure 705 forming a portion of the wellbore 605 below the first casing string 610 which is at least as large in inner diameter as the inner diameter of the first casing string 610.

The second casing string 705 is drilled to a second desired depth within the formation 620. The expander tool 400 is then lowered into the wellbore 605 and is actuated to expand the second casing string 710 along its length as described above in relation to FIGS. 6-10. When the expander tool 400 is moved upwards (and/or downwards) within the second casing string 710 to expand the portion of the second casing string 710 adjacent to the attenuator 505, the first casing string 610 bends outward radially toward the inner diameter of the wellbore 605. The first casing string 610 is able to move within the cement portion of the annular space 635 because the attenuator 505 is crushed by the expansion force exerted by the expander tool 400. FIG. 14 illustrates the expander tool 400 expanding the second casing string 710 to compress the attenuator 505 so that the inner diameter of the portion of the second casing string 710 adjacent the attenuator 505 is at least as large as the smallest portion of the inner diameter of the first casing string 610.

Figure 14A:
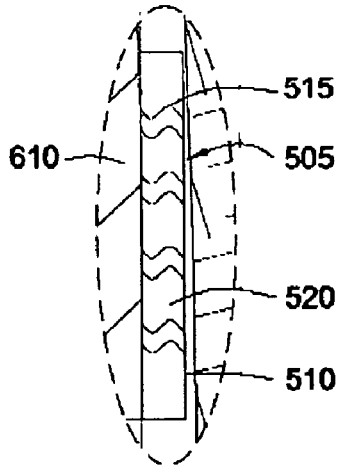
FIG. 14A is a section view of the attenuator shown in FIG. 14 in the compressed position after expansion.

FIG. 14A shows the attenuator 505 after expansion. The webs 515 are compressed to invade the void areas 520, thus allowing room for the first casing string 610 to move toward the inner diameter of the wellbore 605 to make room for the second casing string 710. The wall 510 remains pressed against the cement within the annular space 635.

At the end of the operation, the expander tool 400 may be removed from the wellbore 605. A physically alterable bonding material such as cement may optionally be introduced into the wellbore 605 and flowed through the casing strings 610, 710, through the nozzles 685, and up through the annular space 635 to cement the second casing string 710 within the wellbore.

In an additional aspect of the present invention, the second casing string 710 may also include an attenuator 505 at a lower portion around its outer diameter. Additional casing strings with expandable cutting structures attached thereto and attenuators around their outer diameters may then be used to drill through previous expandable cutting structures and experience expansion to compress the attenuators, as described above, to form a wellbore of a desired depth.

In a further additional, aspect of the present invention, a portion of the second casing string 710 is expanded into contact with the first casing string 610, and the portion of the second casing string 710 located above the attenuator 505 and extending into the inner diameter of the first casing string 610 is cut off of the second casing string 710.

In yet a further additional aspect of the present invention, the attenuator 505 or compressible member of FIGS. 11-14 may be located within an enlarged inner diameter portion (not shown) of the first casing string 610. The second casing string 710 may be used to drill through the first casing string 610 as described above in relation to FIGS. 11-14. Then, a portion of the second casing string 710 may be expanded into the enlarged inner diameter portion. The attenuator 505 compresses so that the portion of the second casing string 710 is moveable through the enlarged inner diameter portion of the first casing string 610 to form a substantially monobore well. Additional casing strings may be used to drill through the second casing string 710 and subsequent casing strings and through the formation. The additional casing strings as well as the second casing string 710 may include enlarged inner diameter portions and attenuators disposed therein.

The cutting structures 315 and 615 and the expandable cutting structures 805 and 705 are described above as connected to the lower end of the casing strings 310, 810, 610, and 710. It is understood that the cutting structures 315, 615, 805, and 705 are operatively disposed at the lower end of the casing strings 310, 810, 610, and 710, so that the cutting structures may be disposed at any location on the casing strings where the cutting structures are capable of drilling through the formation. As such, it is understood that the cutting structure may be connected at, for example, a middle portion of the casing string, and the cutting structure may protrude below the casing string in a position to drill through the formation.

Providing a method and apparatus for drilling with casing to form a substantially monobore well by use of the embodiments of the present invention increases the possible inner diameter of a cased wellbore formed by drilling with casing. As a consequence, flexibility in the tools which are capable of being run into the cased wellbore is increased. Furthermore, forming a substantially monobore well using drilling with casing technology in embodiments of the present invention allows a wellbore of substantially the same inner diameter along its length to be formed in less time compared to conventional drilling methods.

Embodiments of the present invention also advantageously provide apparatus and methods for maintaining a fluid bypass around casing during a drilling with casing operation after hanging casing within an open hole or cased wellbore. Use of embodiments of the present invention allows for creation of a substantially monobore well by drilling with casing.

Figure 15:
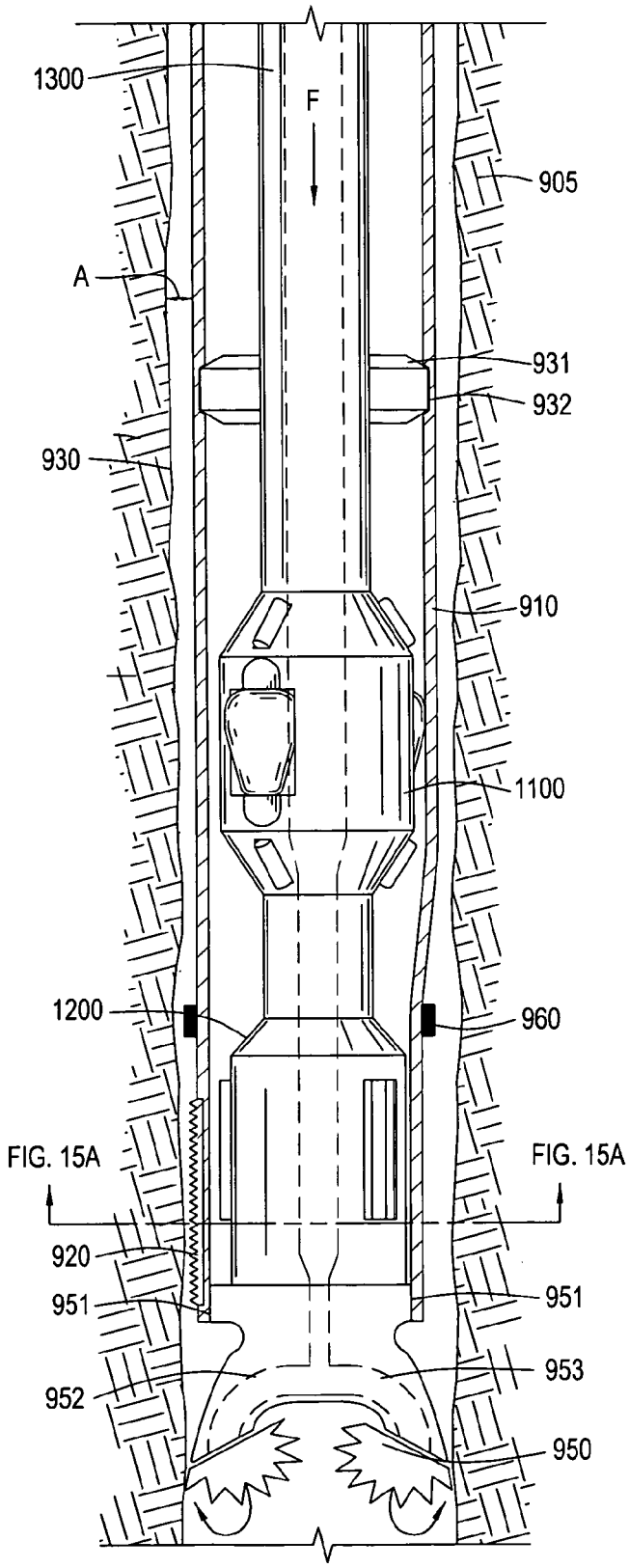
FIG. 15 is a section view of casing having an earth removal member attached thereto lowering into a formation. At least a portion of the casing is profiled. A running string having a setting tool and an expander tool is disposed within the casing.

FIG. 15 shows casing 910, at least a portion of the casing 910 profiled, having an earth removal member 950 operatively attached to its lower end. The casing 910 may include a casing section, or may include two or more casing sections connected, preferably threadedly connected to one another, to form a casing string 910. The casing 910 may be a tubular string, wherein only a portion of the tubular string is casing, or it may be only casing.

The earth removal member 950 is preferably a cutting structure, most preferably a drill bit, having one or more fluid passages 952 and/or 953 to allow for fluid flow therethrough. The earth removal member 950 may be an expandable cutting structure, the operation and structure of which is shown and described below in relation to the earth removal member 1550 of FIGS. 21-25. Alternately, the earth removal member 950 may be drillable.

The earth removal member 950 may be attached to any portion of the casing 910 which allows for drilling with the casing 910 into a formation 905. Preferably, the connection between the earth removal member 950 and the casing 910 is temporary to allow for retrieval of the earth removal member 950 during the drilling operation (described below). FIG. 15 depicts the earth removal member 950 attached to the casing 910 at its lower end by a temporary, shearable connection 951.

Figure 15A:
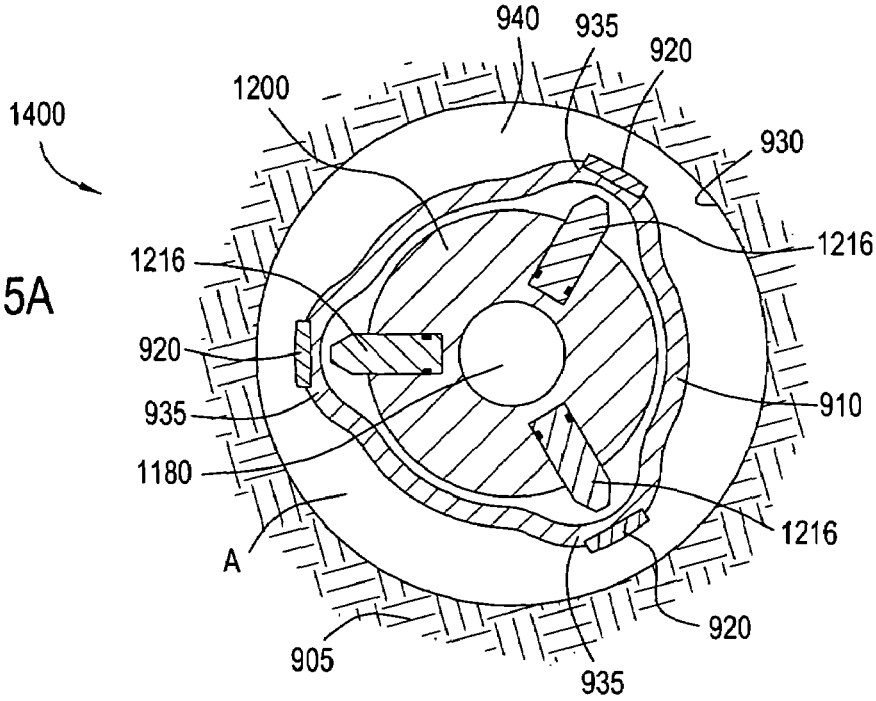
FIG. 15A is a top view of FIG. 15 taken along line 15A-15A.
Figure 15B:
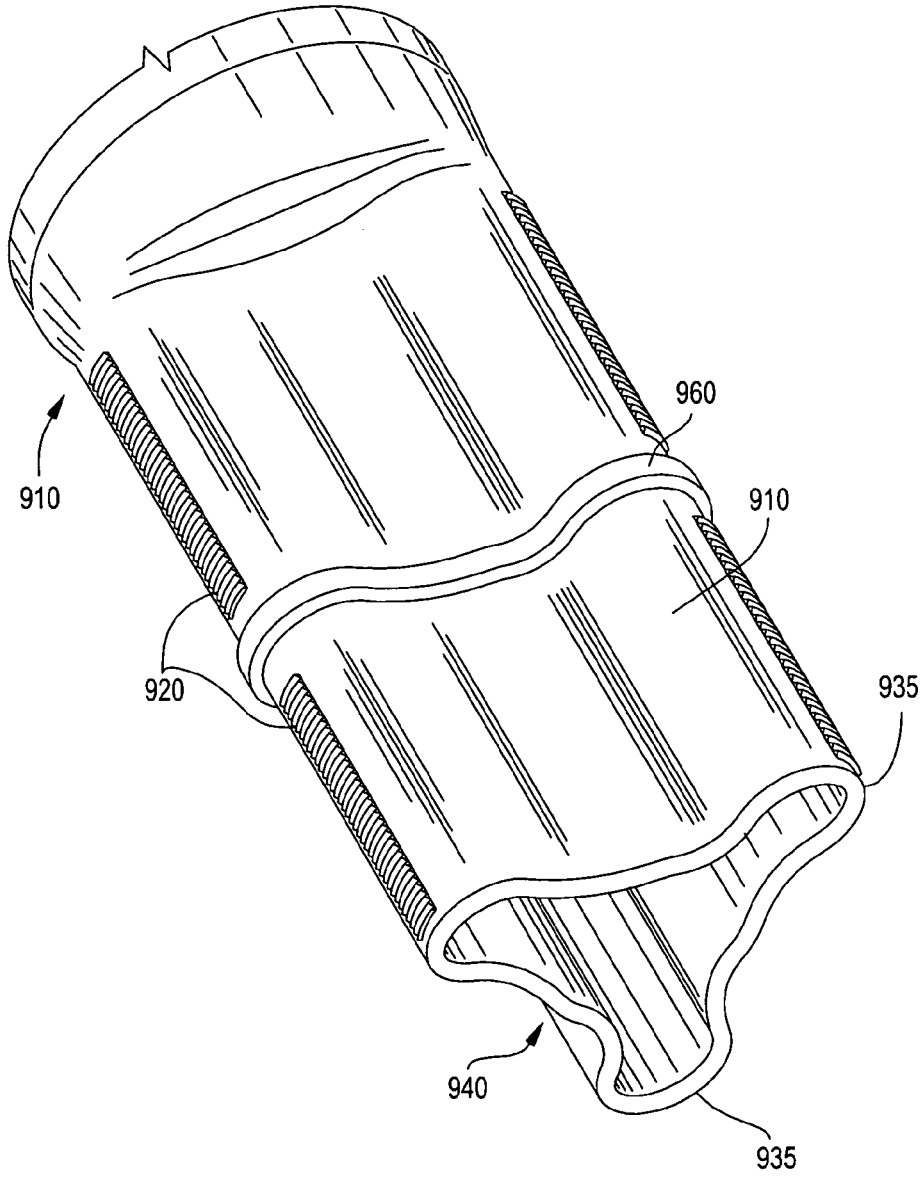
FIG. 15B is a perspective view of an embodiment of the profiled casing of the present invention.

The profiled casing 910 is shown in FIG. 15B. The profiled casing 910 has a generally tubular-shaped body with one or more gripping members 920 formed on its outer diameter at a first location, or a leg 935. Preferably, three legs 935 are formed on the casing 910 at three locations, each leg 935 preferably having gripping members 920 formed on its outer diameter. The gripping members 920, which are preferably slips having grit or teeth, provide gripping force to allow the casing 910 to frictionally engage a wellbore 930 to hang the casing 910 within the wellbore 930.

One or more fluid bypass areas 940 are formed between the legs 935 to provide a fluid path around the outside of the casing 910. The casing 910 is preformed into an irregular, profiled shape to create the bypass areas 940. The fluid bypass areas 940, as well as the casing 910, may be of any shape which allows for sufficient circulation of fluid around the outside of the casing 910 after the casing has been hung within the wellbore 930 and also permits eventual expansion of the casing 910 circumferentially during the various stages of the drilling operation. Alternatively, the fluid bypass areas 940 may be formed downhole from casing which is substantially circumferential. A sealing member 960 may be disposed around the outer diameter of the casing 910 to seal between the casing 910 and the wellbore 930 upon expansion of the casing 910. The sealing member 960 is preferably an elastomeric ring.

Referring again to FIG. 15, a setting tool 1200, an expander tool 1100, and one or more carrying dogs 931 are located on a running string 1300. The running string 1300 is releasably connected, preferably threadedly connected, to the earth removal member 950. The running string 1300 may also be releasably connected to the casing 910 by carrying dogs 931 disposed in slots 932 within the inner surface of the casing 910.

Figure 15C:
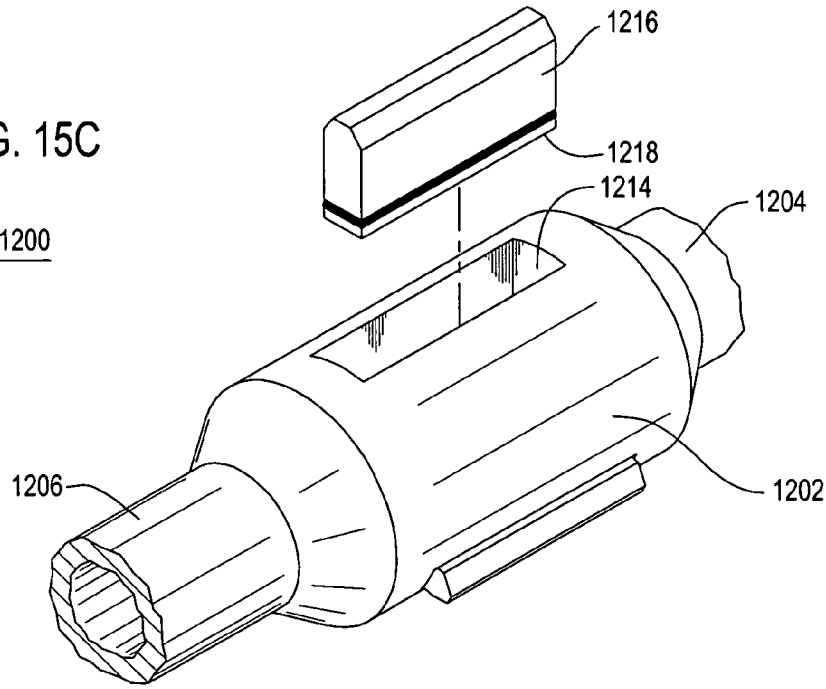
FIG. 15C is an exploded view of an expander tool.

An exploded view of the setting tool 1200 is shown in FIG. 15C. The setting tool 1200 has a body 1202 which is hollow and generally tubular and may have connectors 1204 and 1206 for connection to other components of a downhole assembly, including the earth removal member 950. The central body part has one or more recesses 1214 to hold one or more radially extendable setting members 1216. Each of the recesses 1214 has parallel sides and extends from a radially perforated inner tubular core (not shown) to the exterior of the tool 1200. Each mutually identical setting member 1216 is generally rectangular having a beveled setting surface and a piston surface 1218 on the back thereof in fluid communication with pressurized fluid delivered by the running string 1300. Pressurized fluid provided from the surface of the well, via the running string 1300, can actuate the setting members 1216 and cause them to extend outward and to contact the inner wall of casing 910 to be expanded.

Figure 15D:
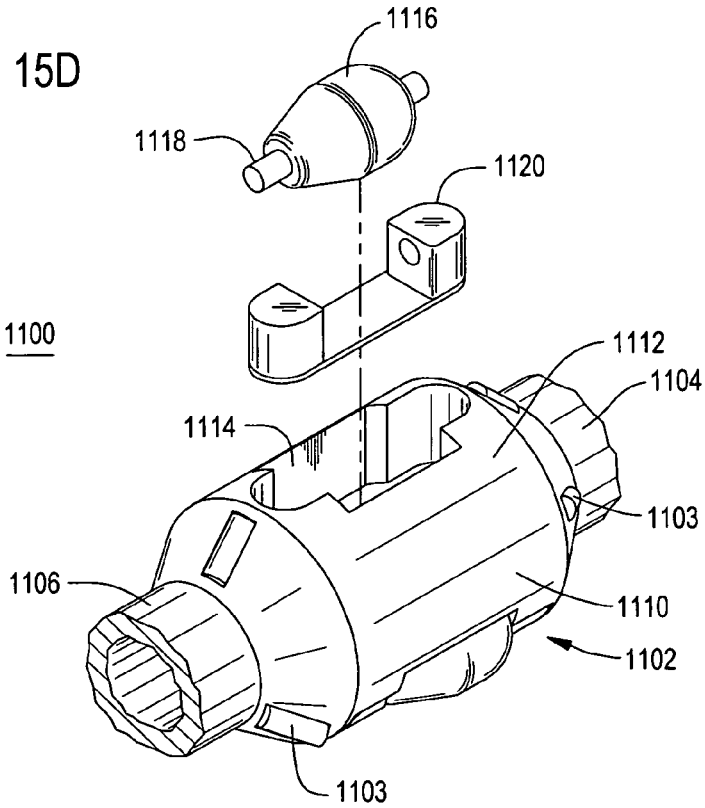
FIG. 15D is an exploded view of a setting tool.

An exploded view of the expander tool 1100 is shown in FIG. 15D. The expander tool 1100, which is run into the wellbore on the running string 1300, has expandable, fluid actuated members disposed on a body. During expansion of casing, the casing walls are expanded past their elastic limit.

The expander tool 1100 has a body 1102 which is hollow and generally tubular and may have connectors 1104 and 1106 for connection to other components (not shown) of the downhole assembly. The connectors 1104 and 1106 may be of a reduced diameter compared to the outside diameter of the longitudinally central body part of the expander tool 1100. The central body part has one or more recesses, shown here as three recesses 1114, to hold a respective expansion member, preferably a roller 1116. Each of the recesses 1114 has parallel sides and extends radially from a radially perforated tubular core (not shown) of the expander tool 1100. Each of the mutually identical rollers 1116 is generally cylindrical and barreled.

Each of the rollers 1116 is mounted by means of an axle 1118 at each end of the respective roller 1116 and the axles 1118 are mounted in slidable pistons 1120. The rollers 1116 are arranged for rotation about a respective rotational axis which is parallel to the longitudinal axis of the expander tool 1100 and, in the embodiment shown, radially offset therefrom at approximately 120-degree mutual circumferential separations around the central body 1102. The axles 1118 are formed as integral end members of the rollers 1116 and the pistons 1120 are radially slidable, one piston 1120 being slidably sealed within each radially extended recess 1114. The inner end of each piston 1120 is exposed to the pressure of fluid within the hollow core of the expander tool 1100 by way of the radial perforations in the tubular core. In this manner, pressurized fluid provided from the surface of the well, via the running string 1300, can actuate the pistons 1120 and cause them to extend outward and to contact the inner wall of the casing 910 to be expanded.

Additionally, at an upper and a lower end of the expansion tool 1100 are preferably a plurality of non-compliant rollers 1103 constructed and arranged to initially contact and expand the casing 910 prior to contact between the casing 910 and fluid actuated rollers 1116. Unlike the compliant, fluid actuated rollers 1116, the non-compliant rollers 1103 are supported only with bearings and do not change their radial position with respect to the body 1102 of the expander tool 1100.

Figure 16A:
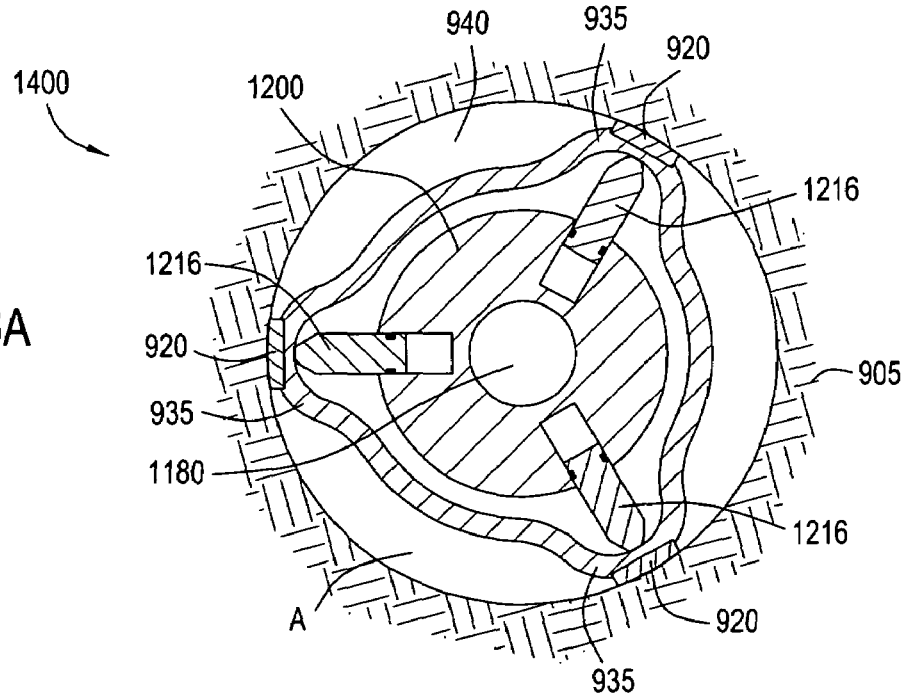
FIG. 16A is a top view of FIG. 16 taken along line 16A-16A.
Figure 16:
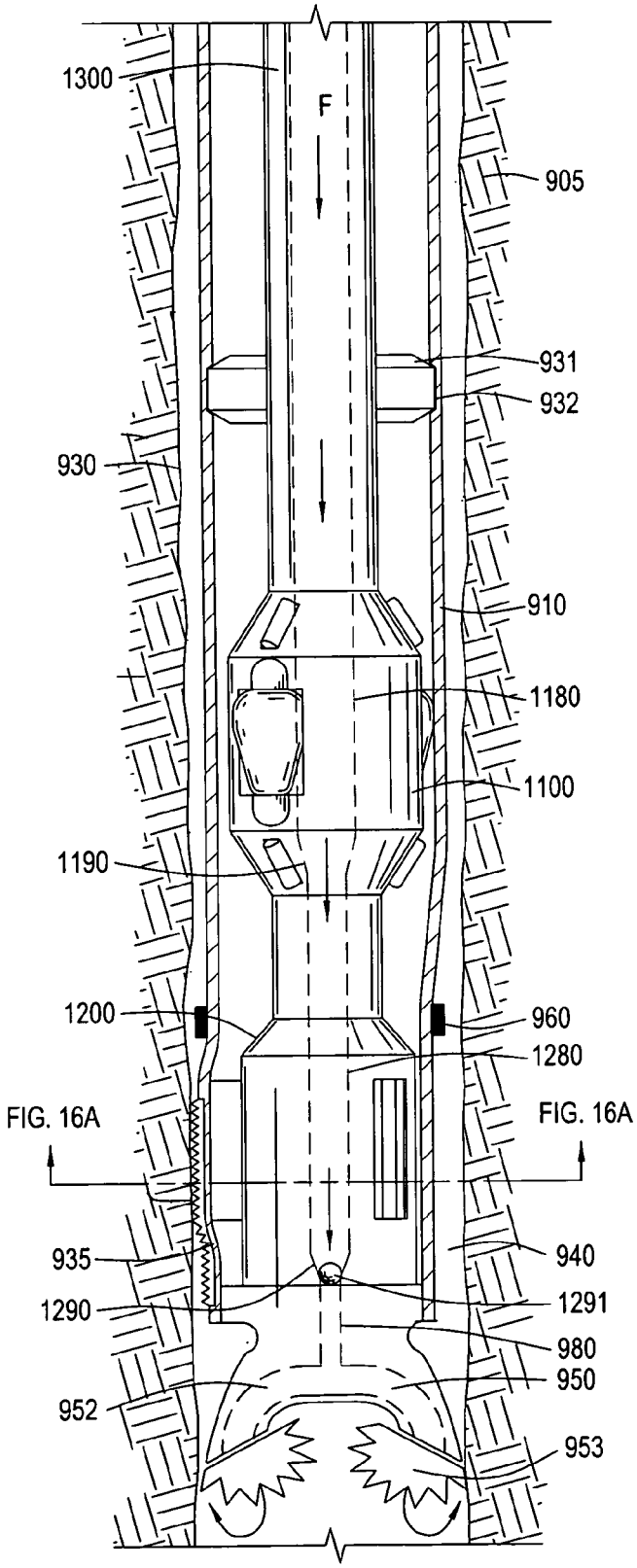
FIG. 16 is a section view of the embodiment shown in FIG. 15, showing the profiled casing hung within the wellbore with the setting tool.

As shown in FIG. 16, the expansion tool 1100 has a bore 1180 therethrough through which fluid may flow at various stages of the operation. Similarly, the setting tool 1200 has a bore 1280 therethrough through which fluid may flow at various stages of the operation. The bore 1180 of the expansion tool 1100 preferably has a larger diameter than the bore 1280 of the setting tool 1200. A bore 980 also exists below bore 1280 which preferably has an even smaller diameter than the diameter of bore 1280. The operation and purpose of the increasingly smaller bore 980, 1180, 1280 sizes are described below.

When using the expansion tool 1100, the casing being acted upon by the expansion tool 1100 is expanded past its point of elastic deformation. In this manner, the inner diameter and outer diameters of the expandable tubular are increased in the wellbore. By rotating the expansion tool 1100 in the wellbore and/or moving the expansion tool 1100 axially in the wellbore with the rollers 1116 actuated, the casing 910 can be expanded by plastic deformation into the wellbore 930 (or already existing casing of a cased wellbore).

In operation, the running string 1300 is initially made up to include the carrying dogs 931, expander tool 1100, and setting tool 1200 therein. The lower end of the running string 1300 is threadedly connected to the earth removal member 950 above its fluid passages 952 and 953. The running string 1300 components are configured so that the setting tool 1200 is located within the profiled portion of the casing 910 at the lower end of the casing 910. The carrying dogs 931 are extended into corresponding slots 932 in the casing 910. In this configuration, the casing 910 with the releasably connected running string 1300 is run into the formation 905. The earth removal member 950 may be rotated by a mud motor (not shown) while the casing 910 is being run into the formation 905. In the alternative, the entire casing string 910 including the earth removal member 950 may be rotated while running the casing 910 into the formation 905. It is also contemplated that, if the formation 905 is sufficiently soft, the casing 910 may be merely pushed into the formation 905 while circulating drilling fluid ("jetted") into the formation 905 without rotating the earth removal member 950 or the casing 910. Any combination of rotating the earth removal member 950 only, rotating the casing 910, or jetting the casing 910 may also be utilized to drill the casing 910 into the formation 905 to form the wellbore 930.

While the casing string 910 is drilling into the formation 905, drilling fluid F is preferably introduced into the inner diameter of the running string 1300. The drilling fluid F then travels through the expander tool 1100 and setting tool 1200, through the passages 952 and 953 through the earth removal member 950 and out through the earth removal member 950, then up to the surface of the well through an annulus A between the outer diameter of the casing 910 and the inner diameter of the wellbore 930 which is being drilled. The casing string 910 is drilled to the desired depth within the formation 905, as shown in FIG. 15. FIG. 15A illustrates a downward view along line 15A-15A of FIG. 15 at this step in the operation. The setting members 1216 are unextended, and the casing 910 is in position for expansion by extension of the setting members 1216.

Next, a ball 1291 is dropped into the bore 1180, as shown in FIG. 16. The ball 1291 is sized so that it stops at a ball seat 1290 formed at the junction between the larger bore 1280 and the smaller bore 980. After the ball 1291 is seated at the ball seat 1290, fluid F is introduced into the bore 1180. The presence of the ball 1291 halts fluid F flow through the bore 980 and increases fluid pressure within the setting tool 1200. The increased fluid pressure actuates the setting members 1216, thereby forcing the setting members 1216 outwards radially into contact with the legs 935 so that the profiled portion of the casing 910 including the legs 935 is expanded past its elastic limit along at least a portion of its outer diameter proximate to where the gripping members 920 are formed. The outer diameter of the legs 935 of the casing 910 grippingly engage the wellbore 930 to hang the casing 910 within the wellbore 930, while at the same time leaving a pathway through which fluid may bypass through the fluid bypass areas 940 in between the expanded legs 935. FIG. 16 shows the casing 910 set within the wellbore 930. FIG. 16A shows line 16A-16A of FIG. 16 with the setting members 1216 having expanded the legs 935 into contact with the wellbore 930 and the fluid bypass areas 940 remaining intact. In an alternative embodiment, the expander tool 1100 may be utilized to expand the legs 935 to frictionally engage the wellbore 930 by positioning the expander tool 1100 at approximately the location of the setting tool 1200 in FIGS. 15-20, thus eliminating the need for the setting tool 1200.

Figure 17:
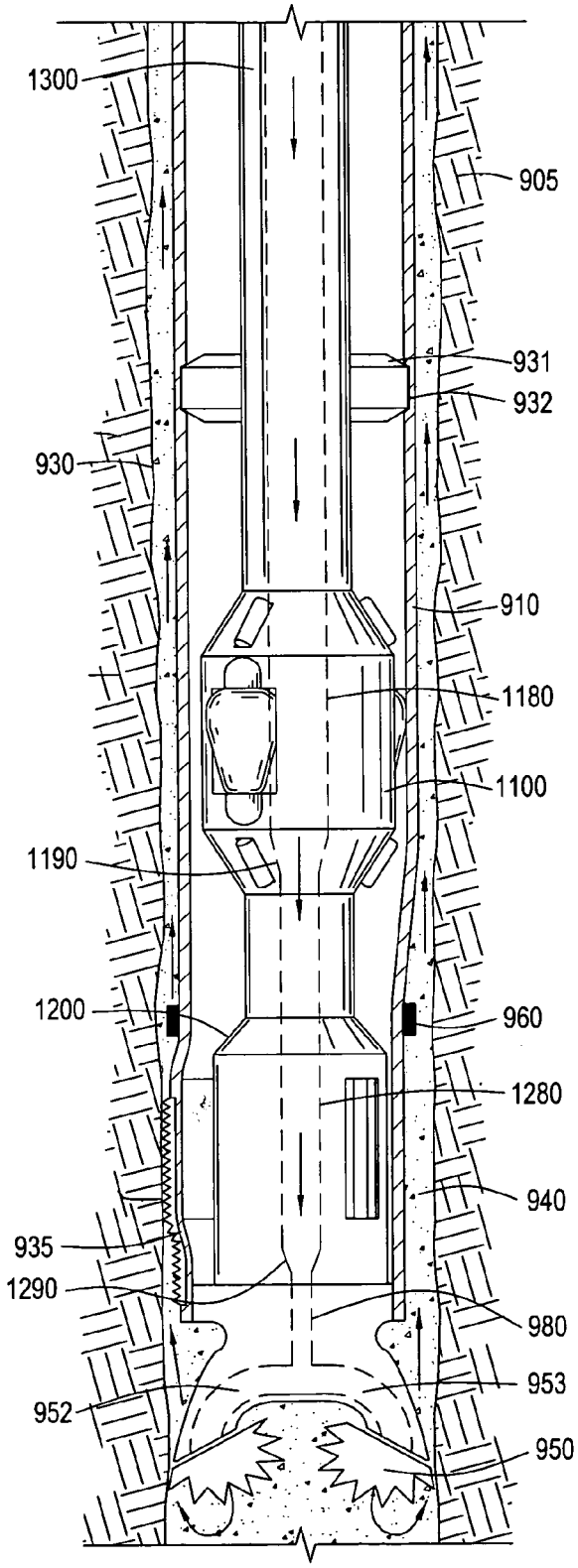
FIG. 17 is a section view of the embodiment shown in FIG. 15, showing the bypass area for fluid flow.

After the casing 910 has been expanded at the legs 935 into frictional contact with the wellbore 930, fluid pressure is increased within the bore 1280 to a fluid pressure above the rated limit of the ball seat 1290 to blow the ball 1291 out of the ball seat 1290. When the ball 1291 is blown out of the ball seat 1290, fluid flow through the bores 1180, 1280, and 980 within the running string 1300 is again unimpeded. At this point, the wellbore 930 may be conditioned and/or cemented by any conventional means. A cementing operation may be conducted by introducing cement or some other physically alterable bonding material into the running string 1300, as shown in FIG. 17. Cement flows through the bores 1180, 1280, and 980, out through the passages 952 and 953 in the earth removal member 950, then up through the annulus A between the outer diameter of the casing 910 and the wellbore 930 to the desired height. When flowing up through the annulus A, the cement flows up through the fluid bypass areas 940 and then up through the annulus A between the unexpanded casing 910, which is above the profiled portion of the casing 910, and the wellbore 930. FIG. 17 shows the cement having risen to a level at the top of the casing 910, but it is contemplated that cement may rise to any level with respect to the casing 910.

Figure 18:
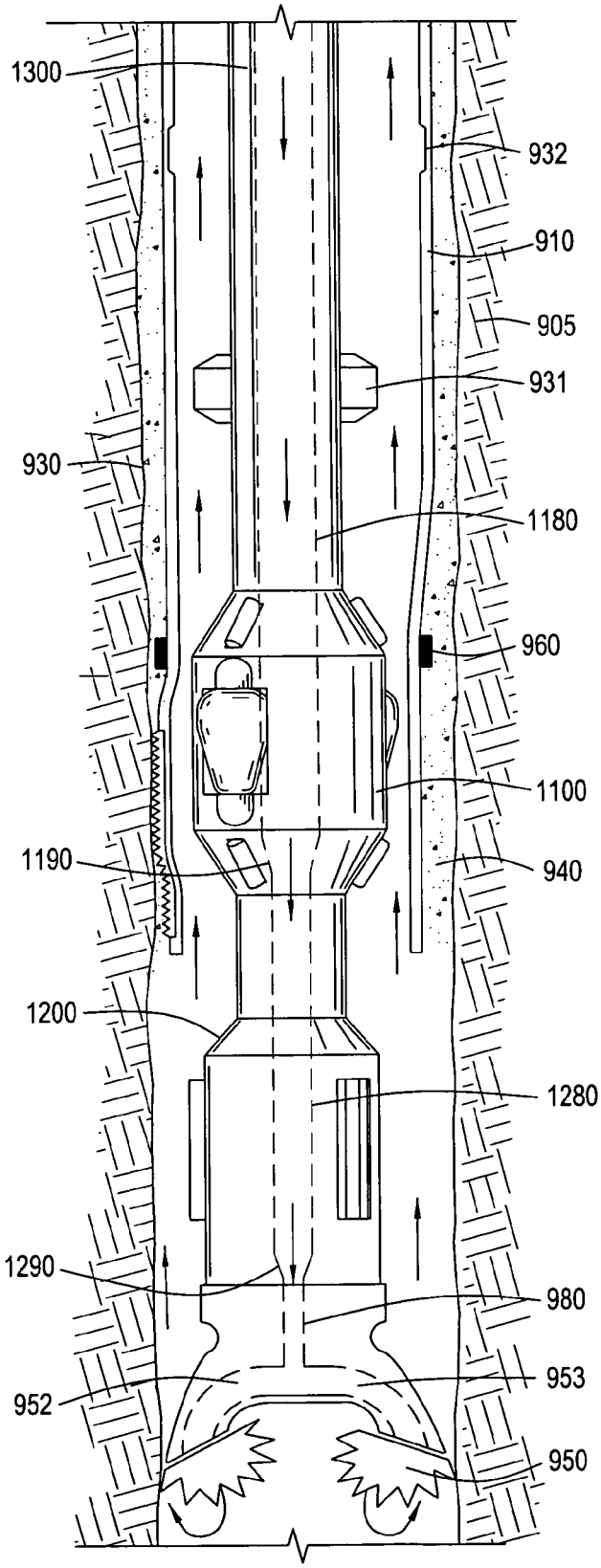
FIG. 18 is a section view of the embodiment shown in FIG. 15, showing the earth removal member and the running string drilling below the profiled casing.

After sufficient cement has been introduced into the annulus A but before the cement has cured, the carrying dogs 931 are retracted from the slots 932 and the temporary connection 951 connecting the earth removal member 950 to the casing 910 is released. The temporary connection 951 is preferably released by shearing the earth removal member 950 from the casing 910 by downward pushing or upward pulling of the running string 1300. Drilling fluid F is then introduced into the running string 1300 and the mud motor rotates the earth removal member 950 to drill the running string 1300 to a further depth within the formation 905. Other methods of drilling mentioned above, including rotating the entire running string 1300 or jetting the running string 1300 into the formation 905 may also be utilized, alone or in combination with one another. The running string 1300 is drilled to a further depth within the formation 905 to allow location of the expander tool 1100 adjacent the profiled lower end of the casing 910 within the casing 910. FIG. 18 shows the running string 1300 drilled to a further depth within the formation 905 to extend the wellbore 930.

Next, the drilling of the running string 1300, is halted, and fluid flow through the running string 1300 may be stopped. The running string 1300 is preferably drilled to the depth where the expander tool 1100 is located at the lowermost end of the casing 910. In this embodiment, the expansion of the casing 910 is from the bottom up. In the alternative, the expander tool 1100 may be located adjacent to the upper end of the profiled portion of the casing 910, if the expander tool 1100 is moved downward for the expansion of the profiled portion of the casing 910.

Figure 19:
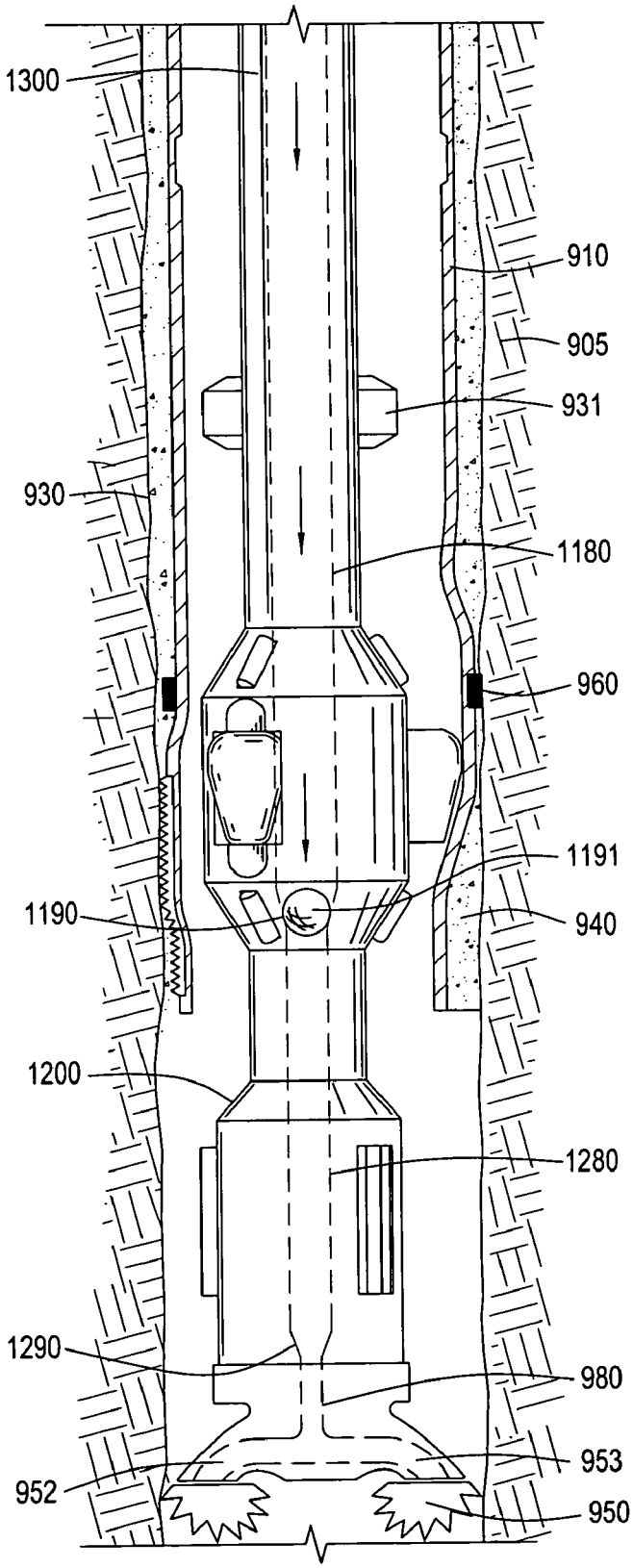
FIG. 19 is a section view of the embodiment shown in FIG. 15, showing the casing partially expanded into the wellbore.

As shown in FIG. 19, a ball 1191, larger than the ball 1291, is introduced into the bore 1180 and stops in a ball seat 1190. (In an alternate embodiment, the ball 1191 may be placed within the ball seat 1190 prior to locating the expander tool 1100 at the proper axial position adjacent the profiled portion of the casing 910.) Pressure build-up from the increased fluid pressure instigated by the presence of the ball 1191 within the expander tool 1100 activates the expander tool 1100 so that the rollers 1116 are urged radially outward from the expander tool 1100 to contact the casing 910 therearound. The expander tool 1100 exerts force against the wall of the casing 910 while rotating and preferably (but optionally) moving axially within the casing 910. The rollers 1116 thereby expand the casing 910 wall past its elastic limits around the circumference of the casing 910 at the profiled lower end.

Gravity and the weight of the components can move the expander tool 1100 downward in the casing 910 even as the rollers 1116 of the expander tool 1100 are actuated. Alternatively, the expansion can take place in a "bottom up" fashion by providing an upward force on the running string 1300. A tractor (not shown) may be used in a lateral wellbore or in some other circumstance when gravity and the weight of the components are not adequate to cause the actuated expander tool 1100 to move downward along the wellbore 930. Additionally, the tractor may be necessary if the expander tool 1100 is to be used to expand the casing 910 wherein the tractor provides upward movement of the expander tool 1100 in the wellbore 930. Preferably, the non-compliant rollers 1103 at the lower end of the expander tool 1100 contact the inner diameter of the casing 910 as the expansion tool 1100 is raised. This serves to smooth out the legs 935 and reform the casing 910 into a circular shape prior to fully expanding the casing 910 into the wellbore 930. The casing 910 is then expanded into circumferential contact with the wellbore 930. FIG. 19 shows the expander tool 1100 in the process of expanding the lower, profiled portion of the casing 910 into circumferential contact with the wellbore 930, from the bottom up.

The expander tool 1100 is preferably then utilized to expand the remainder of the casing 910 above the profiled portion to a desired extent, preferably leaving at least some cement outside the casing 910 to securely set the casing 910 within the wellbore 930. The remaining portion of the casing 910 may be expanded from the bottom up or from the top down. Expanding this remaining portion increases the inner diameter of the casing 910 along its length, thus expanding the available diameter within the wellbore 930. After the expansion is complete, the cement may be allowed to cure to set the casing 910 within the wellbore 930.

Fluid pressure is then increased to a pressure above the operating pressure of the expander tool 1100 to blow the ball 1191 through the frangible ball seat 1190. The ball 1191 then flows through the running string 1300 and to the surface with the fluid up through the annulus between the inner diameter of the casing 910 and the outer diameter of the running tool 1300. Consequently, a fluid path through the bores 980, 1180, and 1280 is again unobstructed and the rollers 1116 of the expander tool 1100 are retracted. The retractable earth removal member 950 is retracted, and the running string 1300 is removed from the wellbore 930.

Figure 20:
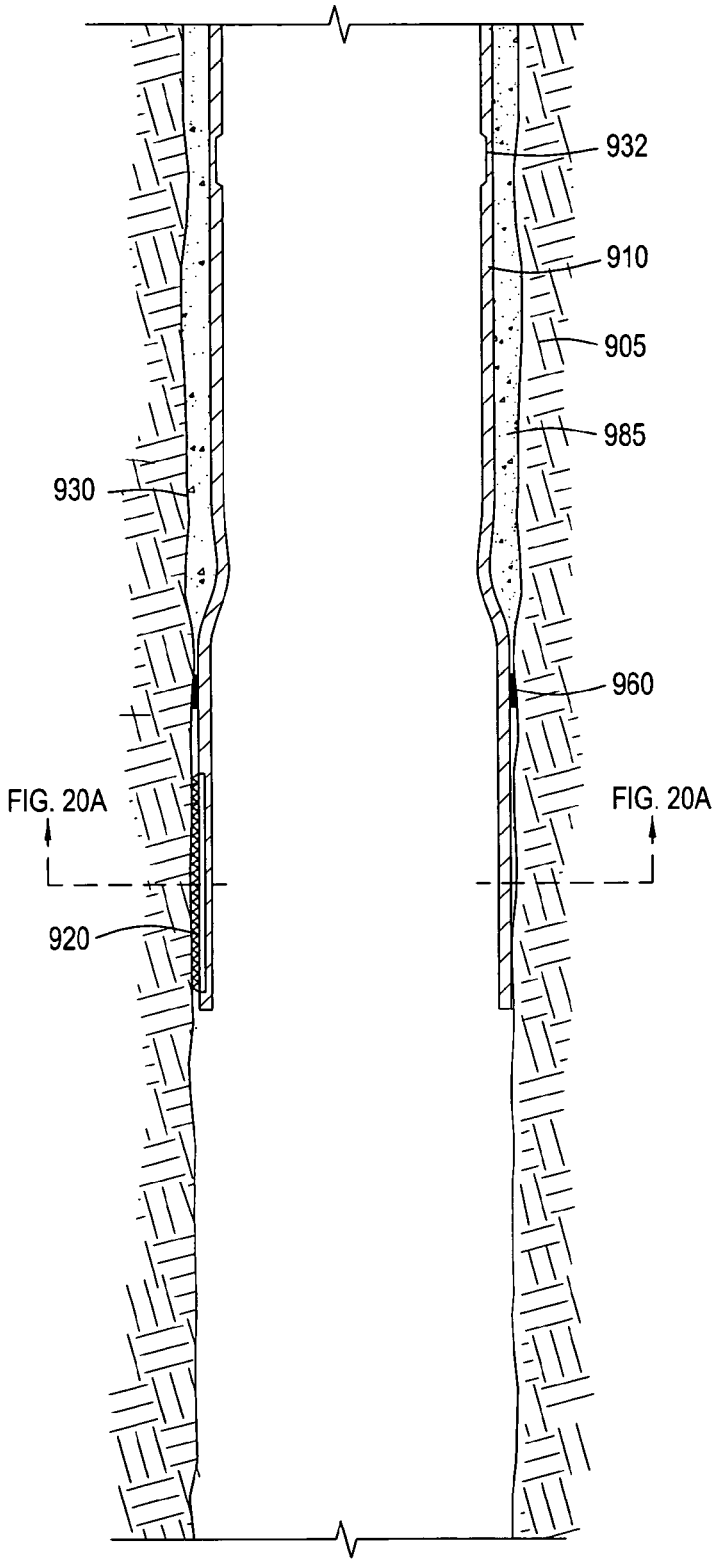
FIG. 20 is a section view of the embodiment shown in FIG. 15, showing a lower portion of the casing expanded into the wellbore. The profiled portion of an upper portion of the casing is expanded and the running string is removed.

FIG. 20 shows the casing 910 set within the wellbore 930 after the running string 1300 is removed. The casing 910 is preferably bell-shaped at the end of the expansion process, so that the casing 910 has a larger inner diameter at its lower end to permit a subsequent casing section or casing string (not shown) to be expanded into the bell-shaped portion. Expanding the subsequent casing section or casing string into the bell-shaped lower end of the casing 910 allows for formation of a substantially monobore well, or a cased wellbore having an inner diameter that does not decrease with increasing depth. The process shown in FIGS. 15-20 may be repeated any number of times with any number of casing strings or casing sections expanded into one another to form a cased wellbore of any desired depth.

Figure 20A:
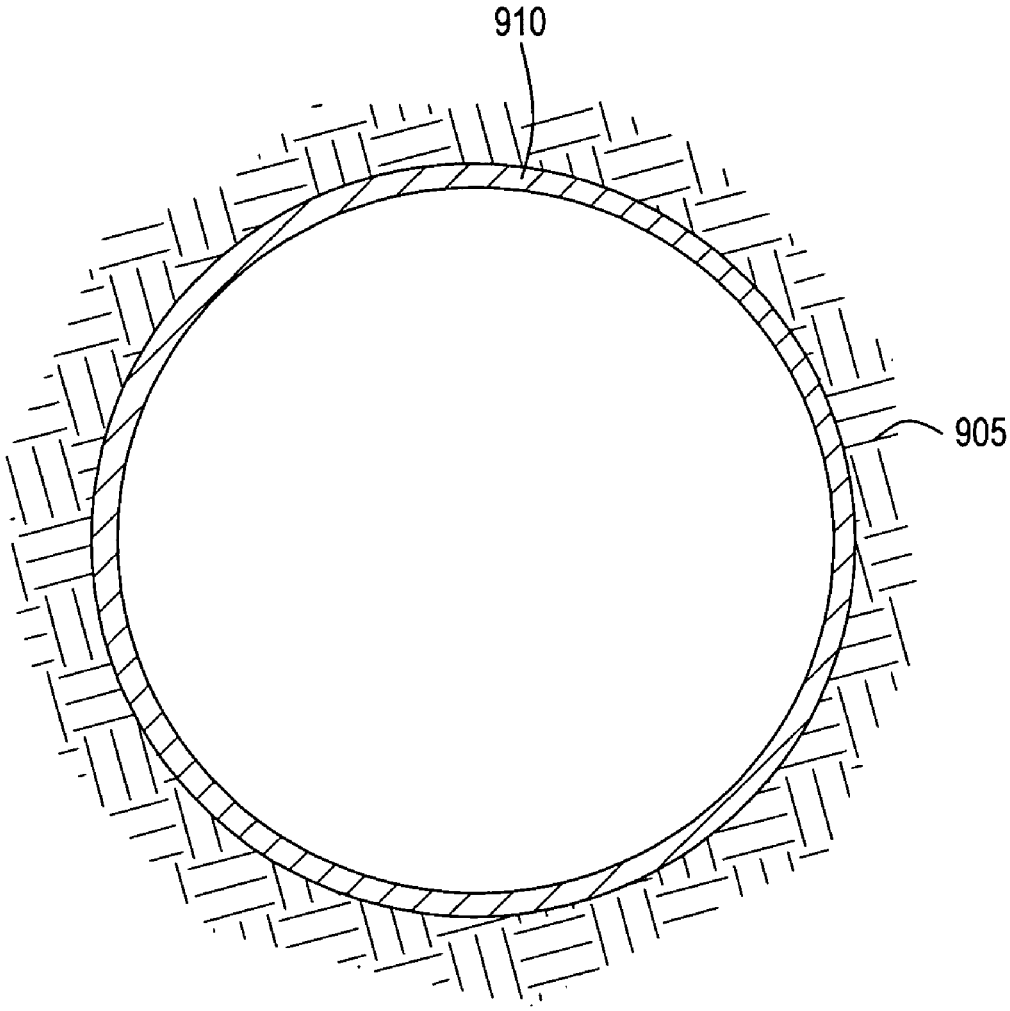
FIG. 20A is a top view of FIG. 20 taken along line 20A-20A.

FIG. 20A shows the bell-shaped portion of the casing 910 along line 20A-20A of FIG. 20. The lower portion of the casing 910 is expanded into contact with the wellbore 930 to form an essentially circumferential inner diameter of the casing 910.

In an alternate embodiment, the earth removal member 950 may be drillable rather than retractable. While a ball and ball seat arrangement is described, it should be understood that any appropriate valve arrangement may be used, such as a dart or a sleeve for isolating fluid flow from the running string 1300 to the setting tool 1200 and/or expander tool 1100.

Figure 21:
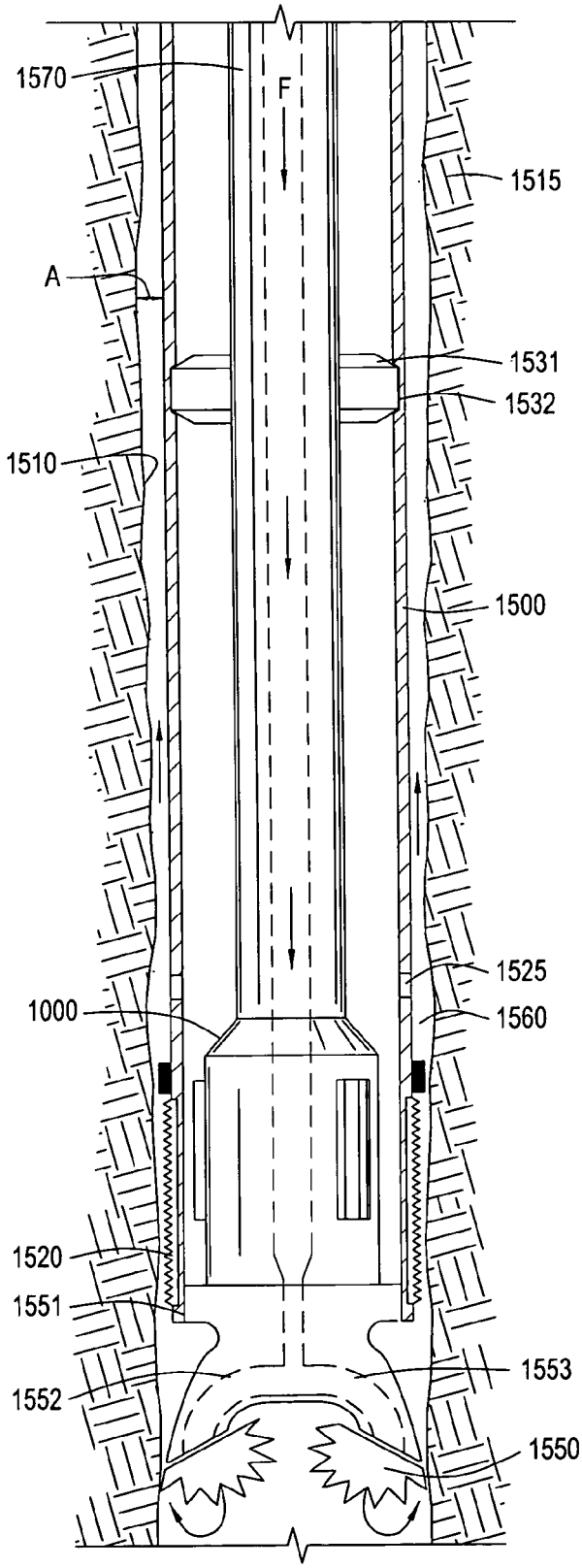
FIG. 21 is a section view of an embodiment of casing of the present invention having an earth removal member attached thereto lowering into a formation. A running string having therein an expander tool is disposed within the casing.

FIGS. 21-25 illustrate an alternate embodiment of the present invention. FIG. 21 shows casing 1500 drilling a wellbore 1510 into a formation 1515. The casing 1500 may include a casing section, or may include two or more casing sections connected to one another, preferably threadedly connected to one another, to form a casing string. A portion of the casing 1500 has a fluid path therethrough. The fluid path in the embodiment of FIG. 21 is in the form of one or more openings 1525 to allow setting fluid, such as cement, to pass through the casing 1500.

An earth removal member 1550 is operatively connected to a lower end of the casing 1500. As shown in FIG. 21, the earth removal member 1550 is shearably connected to the lower end of the casing 1500. The earth removal member 1550 is preferably a cutting structure, more preferably a drill bit. The earth removal member 1550 is preferably expandable and retractable, and may be the retractable drill bit described in U.S. application Ser. No. 10/335,957 filed on Dec. 31, 2002, which is herein incorporated by reference in its entirety. The expandable earth removal member 1550 generally includes a set of blades which move between the open and closed position. Hydraulic fluid flowing through the earth removal member 1550 controls the movement of the blades between the open and closed position.

The expandable earth removal member 1550 may be retrievable after expansion in its retracted state. In the alternative, the expandable cutting structure 1550 may be an expandable drill bit constructed of drillable material such as aluminum, as described in the above incorporated by reference application. The expandable drill bit of the application incorporated above has a plurality of cutting members disposed on an outer portion of the blades. The cutting members are typically small and substantially spherical, and may be made of tungsten carbide or polycrystalline diamond surfaces. The blades are constructed and arranged to permit the cutting members to contact and drill the earth when the blades are expanded outward and not ream the wellbore or surrounding casing when the blades are collapsed inward.

Fluid passages 1552 and 1553 extend through the earth removal member 1550 to provide a fluid path through the earth removal member 1550. Fluid passages 1552 and 1553 are in fluid communication with a longitudinal bore through the casing and allow jetting of the drilling fluid during the drilling operation through the casing to remove any cuttings build up which may gather in front of the blades and to form a path for the casing through the formation. Furthermore, the fluid passages 1552 and 1553 (also termed nozzles) are used to create a hydraulic pressure differential within the bore through the casing to cause the blades of the expandable cutting structure to expand outward, as described in U.S. application Ser. No. 10/335,957, incorporated by reference above.

The casing 1500 may optionally include one or more sealing members 1560 on its outer diameter for sealing an annular area A between the casing 1500 and the wellbore 1510. Additionally, the casing 1500 may optionally include one or more gripping members 1520 on a portion of its outer diameter to allow the casing 1500 to be initially hung within the wellbore 1510 due to frictional engagement of the gripping members 1520 with the wellbore 1510. The sealing members 1560 are preferably constructed of an elastomeric material, and the gripping members 1520 are preferably slips. Preferably, the sealing members 1560 and gripping members 1520 are located below the openings 1525, and the sealing members 1560 are located above the gripping members 1520 on the casing 1500.

A running string 1570 is releasably connected to the casing 1500, preferably by retractable carrying dogs 1531 disposed in slots 1532 in the inner diameter of the casing 1500. The expander tool 1100 shown and described in relation to FIG. 15D is connected, preferably threadedly connected, to a lower end of the running string 1570. The lower end of the expander tool 1100 may be threadedly connected to an upper portion of the earth removal member 1550.

In operation, as shown in FIG. 21, the casing 1500 is lowered into the formation 1515 while introducing drilling fluid through the running string 1570. The earth removal member 1550 (or the casing 1500 itself) may be rotated, if necessary or desired to drill through the formation 1515 to form the wellbore 1510, while the casing 1500 is lowered into the formation 1515. While the casing 1500 is drilling into the formation 1515, the drilling fluid F flows through the running string 1570, through the passages 1552 and 1553, and up through the annular area A between the casing 1500 and the wellbore 1510. The casing 1500 may be drilled to a further depth than the eventual setting depth of the casing 1500 within the wellbore 1510 to allow additional room for the running string 1570 to be lowered within the drilled-out portion of the wellbore 1510 in further steps in the operation of the present invention.

Figure 22:
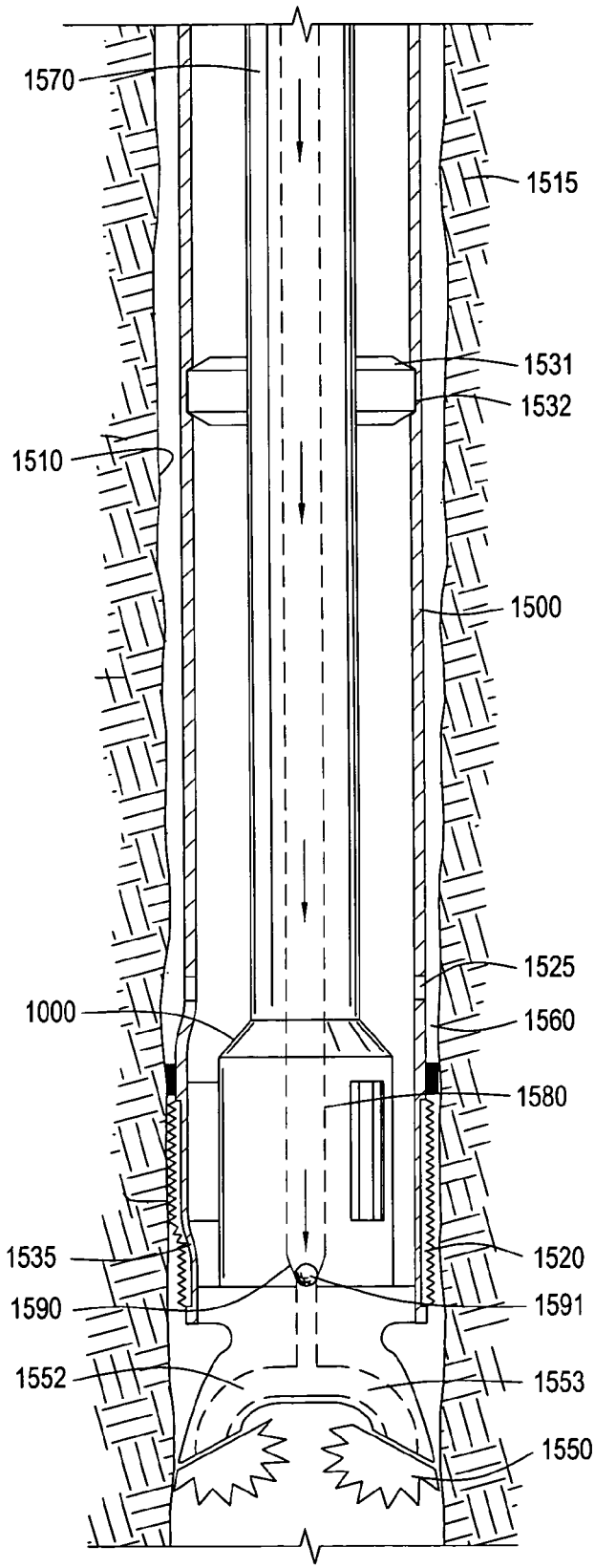
FIG. 22 is a section view of the embodiment shown in FIG. 21, showing the casing hung within the wellbore with the expander tool.

Next, as illustrated in FIG. 22, a ball 1591 is introduced into a bore 1580 of the running string 1570. The ball 1591 stops at a ball seat 1590 within the bore 1580 of the running string 1570. Fluid F is then introduced into the running string 1570, and the pressurized fluid forces the rollers 1116 (see FIG. 15D) of the expander tool 1100 to extend radially outward from the expander tool 1100 to contact the casing 1500 therearound. The rollers 1116 thereby expand the wall of the casing 1500 past its elastic limits in the portions at which each roller 1116 extends to initially anchor the casing 1500 within the wellbore 1510.

Figure 23:
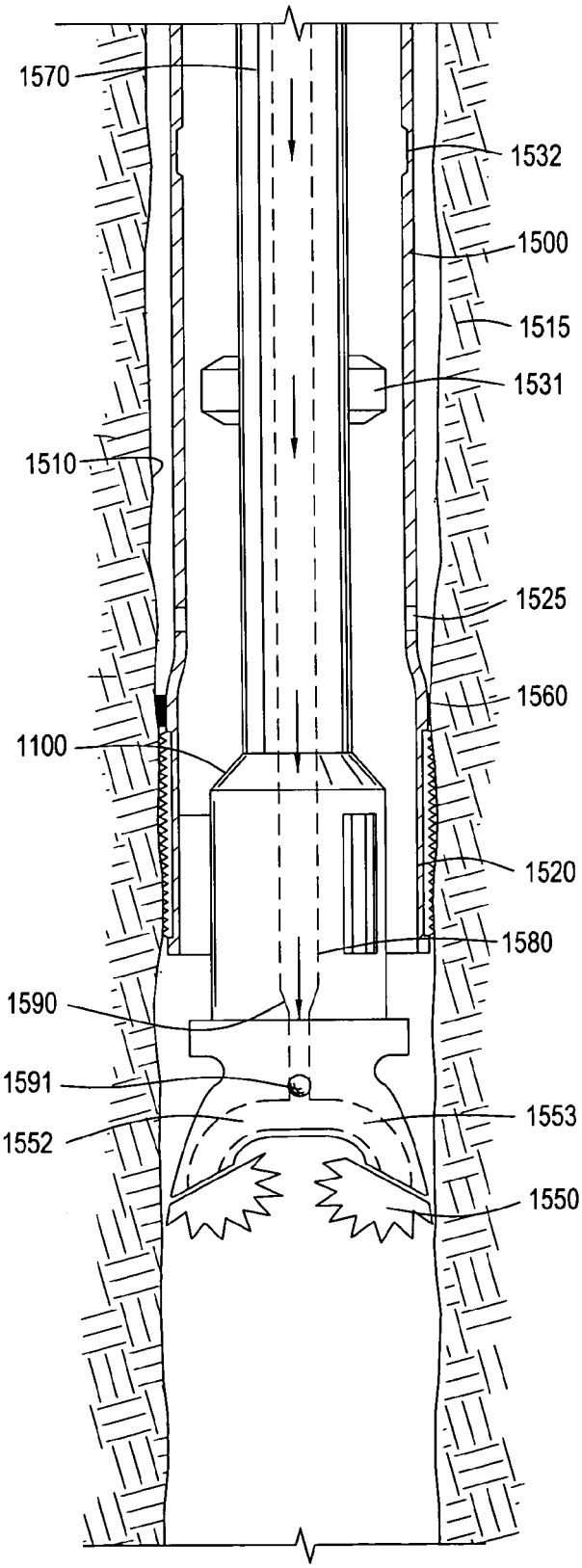
FIG. 23 is a section view of the embodiment shown in FIG. 21, showing a lower portion of the casing expanded into the wellbore.

The carrying dogs 1531 are next retracted from the slots 1532 in the casing 1500, and the earth removal member 1550 is removed from its releasable engagement with the casing 1500. The expander tool 1100 may now be rotated relative to the casing 1500 to expand the casing 1500 along its circumference into the wellbore 1510, as described above in relation to FIGS. 15-20. The lack of attachment between the casing 1500 and the running string 1570 allows the expander tool 1100 to move axially downward and rotate to expand the remainder of the lower portion of the casing 1500, as shown in FIG. 23. The axial movement of the expander tool 1100 in relation to the casing 1500 is accomplished as described above in relation to FIGS. 15-20.

The expander tool 1100 exerts force against the wall of the casing 1500 while rotating and moving axially within the casing 1500. The rollers 1116 thereby expand the casing 1500 wall past its elastic limit around the circumference of the casing 1500 at the lower end. Alternatively, the expansion can take place in a "bottom up" fashion by providing an upward force on the running string 1570, as described above in relation to FIGS. 15-20.

Fluid pressure in the running string 1570 is then increased to a pressure above the operating pressure of the expander tool 1100. The ball 1591 is blown through the frangible ball seat 1590, then flows up to the surface with the fluid up through the annulus A. The rollers 1116 of the expander tool 1100 are thus retracted due to lack of fluid pressure within the expander tool 1100, and the bore 1580 is again unobstructed to allow fluid flow therethrough.

Figure 24:
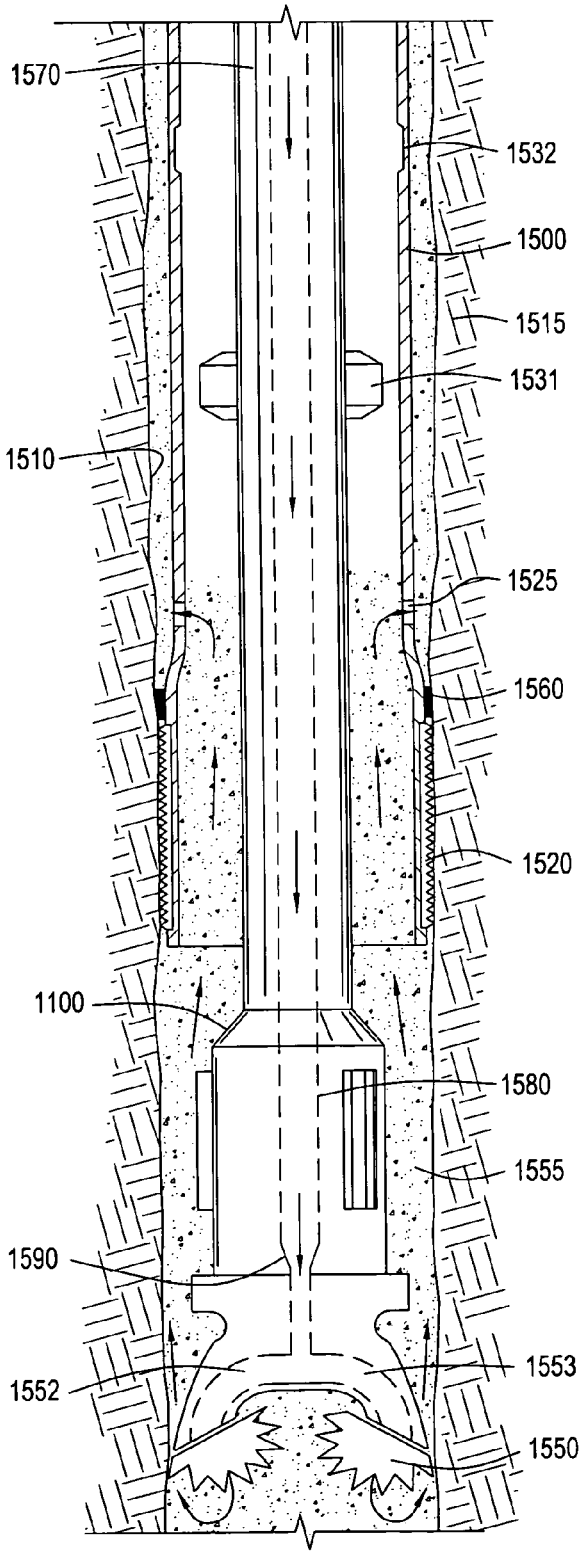
FIG. 24 is a section view of the embodiment shown in FIG. 21, showing a physically alterable bonding material flowing outside the casing.

As shown in FIG. 24, a setting fluid 1555, preferably cement, is next introduced into the running string 1570 from the surface of the wellbore 1510. The setting fluid 1555 flows through the running string 1570, out through the passages 1552 and 1553 of the earth removal member 1550, up through the annulus between the outer diameter of the running string 1570 and the inner diameter of the casing 1500, then out through the openings 1525 into the annulus A between the casing 1500 and the wellbore 1510. The setting fluid 1555 may fill only a portion of the annulus A or, in the alternative, may be allowed to fill up the annulus A. FIG. 24 shows the setting fluid 1555 flowing up through the annulus A through openings 1525 to substantially fill the annulus A with setting fluid 1555.

When sufficient setting fluid 1555 exists in the annulus A, setting fluid 1555 is no longer introduced into the running string 1570. After halting the setting fluid 1555 flow, the running string 1570 is moved axially upward within the wellbore 1510 so that the rollers 1116 of the expander tool 1100, upon radial extension, contact the unexpanded portion of the casing 1500 which is above the portion of the casing 1500 already expanded into the wellbore 1510. A second ball (not shown), which is larger than the ball 1591, may be introduced into the running string 1570. The second ball stops in a second ball seat (not shown), which is larger than the ball seat 1590. Again, pressurized fluid is flowed into the bore 1580 of the running string 1570 to force the rollers 1116 radially outward, and the expander tool 1100 is rotated and moved upward axially to expand the portion of the casing 1500 having the openings 1525 therein into contact with the wellbore 1510. Expanding the openings 1525 into the wellbore 1510 prevents the openings 1525 from becoming a weak spot in the casing 1500 of the cased wellbore, and closes off the ports into the annulus A.

To move the expander tool 1100 upward axially, the earth removal member 1550 may be retracted to allow it to fit within the inner diameter of the casing 1500 by methods such as those disclosed in U.S. patent application Ser. No. 10/335,957, which was above incorporated by reference.

Before the setting fluid 1555 cures, the upper portion of the casing 1500 above the openings 1525 is preferably expanded by the expander tool 1100 to some extent to increase the available space within the inner diameter of the casing 1500. This upper portion may be expanded from the bottom up, or from the top down. Preferably, the upper portion is not expanded into frictional contact with the wellbore so that at least some setting fluid 1555 remains within the annulus A to set the casing 1500 within the wellbore 1510.

Figure 25:
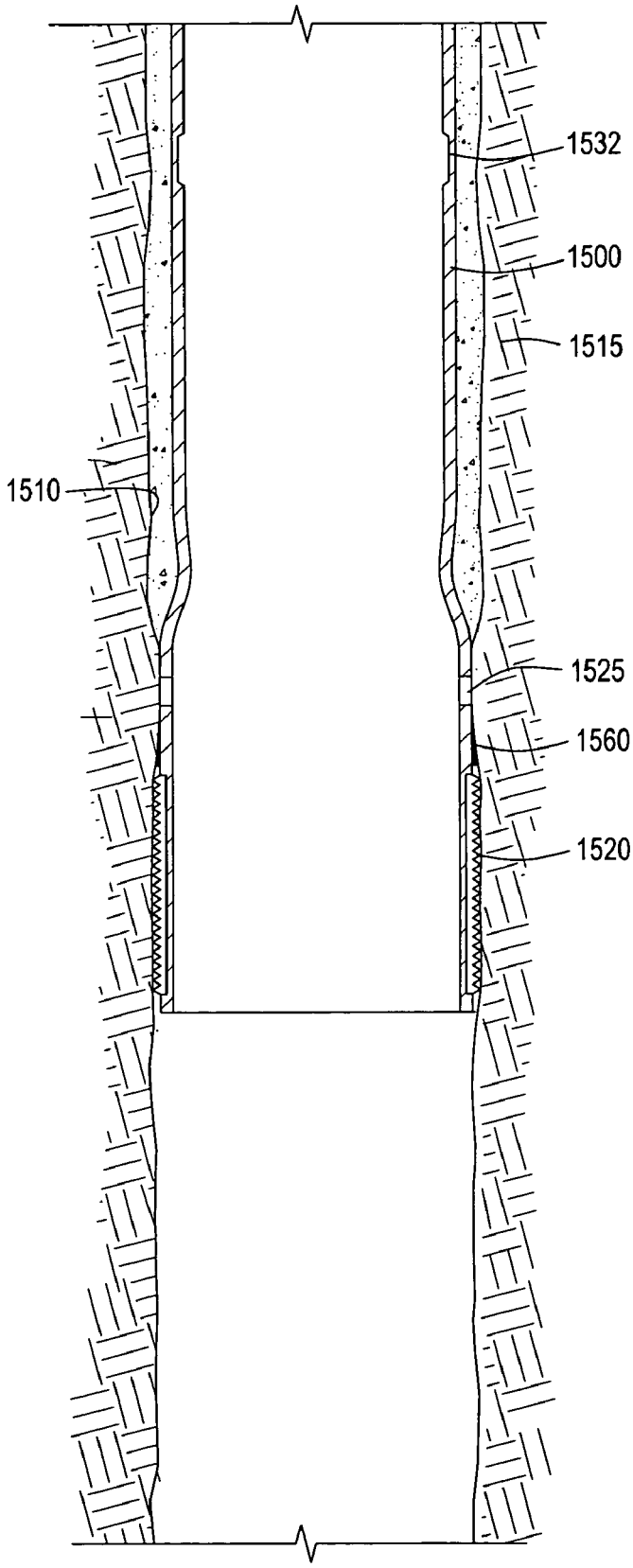
FIG. 25 is a section view of the embodiment shown in FIG. 21, showing the casing expanded into the wellbore and the running string removed.

The running string 1570 is then removed from the wellbore 1510. The setting fluid 1555 may be allowed to cure to set the casing 1500 within the wellbore 1510. FIG. 25 shows the casing 1500 set within the wellbore 1510.

An additional casing (not shown) may then be drilled into the wellbore 1510 in the same manner as described in relation to casing 1500, and then the upper portion of the additional casing expanded into the lower portion of the casing 1500, according to the method described in FIGS. 21-25. Multiple casings (not shown) may also be drilled and set in the same manner. In this way, a substantially monobore well, having substantially the same inner diameter along the length of the wellbore 1510, may be formed with one run-in of each casing 1500.

In another embodiment, the earth removal member 1550 of the embodiment shown in FIGS. 21-25 may, rather than being retractable, be drillable. For example, the earth removal member 1550 may be a drillable bit. In this alternate embodiment, a second casing (not shown) may be used to drill through the earth removal member 1550 when in the process of casing the wellbore 1510 with the second casing.

The expander tool 1100 described above in relation to the operations shown in FIGS. 15-25 may be any rotary expansion tool, whether fluid operated or mechanically operated. The expansion tool 1100 may in an alternate embodiment be an expander cone or any other mechanical apparatus capable of expanding expandable tubing past its elastic limit.

In another aspect, the present invention provides a method of drilling a lateral wellbore comprising forming the lateral wellbore from a parent wellbore in a manner whereby an inner diameter of the lateral wellbore is at least as large as an inner diameter of the parent wellbore. In one embodiment, the lateral wellbore is formed in a single trip into the well. In another embodiment, the lateral is formed with an expandable bit. In another embodiment still, the lateral wellbore is formed with a bit located at the end of a string of liner. In another embodiment still, the parent wellbore is lined with casing. In another embodiment still, the method includes placing a liner in the lateral wellbore. In another embodiment still, the liner is expanded into contact with the lateral wellbore. In another embodiment still, an inner diameter of the liner is at least as large as the inner diameter of the parent wellbore.

In another aspect, the present invention provides a wellbore junction between a patent wellbore and a lateral wellbore comprising a window leading from the parent wellbore to the lateral wellbore, the window having at least one dimension thereacross greater than any corresponding dimension of the parent wellbore.

In another aspect, the present invention provides a method of forming a lined lateral wellbore comprising forming a lateral wellbore extending from a main wellbore, wherein a diameter of the lateral wellbore is larger than an inner diameter of casing lining the main wellbore, running an expandable tubular element, through the casing lining the main wellbore, into the lateral wellbore, and expanding the tubular element within the lateral wellbore, such that the expanded-tubular element has an outer diameter larger than the drift diameter of the casing lining the main wellbore. In one embodiment, an inner diameter of the expanded tubular element is greater than an inner diameter of the casing lining the main wellbore. In another embodiment, the method includes cementing the tubular element into the lateral wellbore. In another embodiment still, the cementing is done after the expanding. In another embodiment still, the expandable tubular element is run into the lateral wellbore as the lateral wellbore is formed. In another embodiment still, the lateral wellbore is formed by drilling with a drilling member disposed on a bottom portion of the expandable tubular element. In another embodiment still, the drilling member is an expandable bit adapted to be drilled through by a subsequent bit without substantially damaging the subsequent bit. In another embodiment still, the drilling member a drill bit that is part of a bottom hole assembly comprising one or more tools in addition to the drill bit. In another embodiment still, at least one of the tools is a tool adapted to measure one or more downhole parameters and the method further comprises measuring one or more downhole parameters while forming the lateral wellbore. In another embodiment still, at least one of the tools is an expandable stabilizer. In another embodiment still, the method includes retrieving at least one of the tools after forming the lateral wellbore. In another embodiment still, forming the lateral wellbore comprises removing a section of the casing lining the main wellbore to form an uncased cavity; inserting a physically alterable bonding material into the cavity; and drilling the lateral wellbore through the physically alterable bonding material. In another embodiment still, the method includes expanding the diameter of the lateral wellbore to receive the expandable tubular element. In another embodiment still, the method includes drilling through the physically alterable bonding material to provide fluid communication between the lateral wellbore and a portion of the main wellbore below a junction between the lateral wellbore and the main wellbore. In another embodiment still, forming the lateral wellbore comprises expanding at least a portion of the lateral wellbore by drilling with an expandable drill bit. In another embodiment still, the method includes forming the main wellbore and lining the main wellbore with expandable tubular elements.

In another aspect, the present invention provides a method of forming a lined lateral wellbore comprising securing a diverter within a main wellbore lined with casing; forming a lateral wellbore with an earth removal member guided by the diverter; expanding a diameter of at least a portion of the lateral wellbore; running an expandable tubular element through the casing lining the main wellbore into the lateral wellbore; and expanding the tubular element within the lateral wellbore, such that the expanded tubular element has an inner diameter equal to or larger than the inner diameter of the casing lining the main wellbore. In one embodiment, the method includes removing the diverter prior to expanding the diameter of at least a portion of the lateral wellbore. In another embodiment, expanding the diameter of at least a portion of the lateral wellbore comprises expanding a portion of the lateral wellbore extending to the main wellbore. In another embodiment still, expanding the diameter of at least a portion of the lateral wellbore comprises operating an expandable back reamer. In another embodiment still, after expanding the tubular element within the lateral element, the expanded portion of the lateral wellbore extending to the main wellbore is fully lined with the expanded tubular element. In another embodiment still, after running the tubular element into the lateral wellbore, a portion of the tubular element extends into the main wellbore and the method further comprises, after expanding the tubular element, removing the portion of the tubular element extending into the main wellbore.

In another aspect, the present invention provides a lateral wellbore extending from a main wellbore lined with casing, wherein at least a portion of the lateral wellbore is lined with casing, the lined portion of the lateral wellbore having an outer diameter larger than a drift diameter of the main wellbore casing. In one embodiment, the inner diameter of the lateral wellbore is equal to or greater than an inner diameter of the main wellbore casing. In another embodiment, the lined portion of the lateral wellbore extends to the main wellbore. In another embodiment still, the lined portion of the lateral wellbore is lined with an expanded screen material. In another embodiment still, the lined portion of the lateral wellbore is lined with a solid expanded tubular element. In another embodiment still, the main wellbore is lined with an expanded tubular element. In another embodiment still, at least a portion of the lateral wellbore casing is cemented into the lateral wellbore.

In another aspect, the present invention provides a method of forming a cased wellbore comprising drilling a wellbore using a first casing string having an earth removal member operatively disposed at its lower end; locating the first casing string within the wellbore; locating a portion of a second casing string adjacent to a portion of the first casing string having an enlarged inner diameter; and expanding the portion of the second casing string so that the portion of the second casing string has an inner diameter at least as large as a smallest inner diameter portion of the first casing string. In one embodiment, at least one compressible member is disposed within the portion of the first casing string having the enlarged inner diameter. In another embodiment, expanding the portion of the second casing string comprises compressing at least a portion of the at least one compressible member. In another embodiment still, at least one compressible member comprises a plurality of webs moveable through at least one void area upon compression. In another embodiment still, at least one compressible member comprises a porous material. In another embodiment still, the inner diameter of the expanded portion of the second casing string is substantially equal to the smallest inner diameter portion of the first casing string. In another embodiment still, the second casing string has an earth removal member operatively attached to its lower end. In another embodiment still, the earth removal member of the second casing string comprises an expandable cutting structure. In another embodiment still, locating a portion of the second casing string adjacent to a portion of the first casing string comprises drilling through the first casing string with the second casing string. In another embodiment still, the earth removal member comprises a drillable material. In another embodiment still, the method includes setting the second casing string within the wellbore using a physically alterable bonding material. In another embodiment still, the portion of the first casing string with the enlarged inner diameter is an undercut cementing shoe. In another embodiment still, the method includes locating a portion of a third casing string adjacent to a portion of the second casing string having an enlarged inner diameter and expanding the portion of the third casing string so that the portion of the third casing string has an inner diameter at least as large as the smallest inner diameter portion of the first casing string.

In another aspect, the present invention provides a method of forming a cased wellbore comprising drilling a wellbore using a first casing string having an earth removal member operatively connected to its lower end and at least one compressible member disposed around at least a portion of the first casing string; locating the first casing string within the wellbore; locating a portion of a second casing string adjacent to the at least one compressible member; and expanding the portion of the second casing string so that the portion of the second casing string has an inner diameter at least as large as a smallest inner diameter portion of the first casing string. In one embodiment, at least one compressible member is disposed at a lower end of the first casing string. In another embodiment, locating the portion of the second casing string adjacent to the at least one compressible member comprises drilling through the earth removal member. In another embodiment still, the second casing string comprises an earth removal member operatively connected to its lower end. In another embodiment still, the earth removal member of the second casing string is extendable to form an enlarged wellbore below the first casing string. In another embodiment still, the inner diameter of the expanded portion of the second casing string is substantially equal to the smallest inner diameter portion of the first casing string. In another embodiment still, the at least one compressible member comprises a plurality of webs moveable through at least one void area upon compression. In another embodiment still, the at least one compressible member comprises a porous material. In another embodiment still, the method includes setting the second casing string within the wellbore using a physically alterable bonding material. In another embodiment still, the second casing string has a at least one compressible member disposed on its lower end. In another embodiment still, the method includes locating a portion of a third casing string adjacent to the compressible member of the second casing string and expanding the portion of the third casing string so that the portion of the third casing string has an inner diameter at least as large as the smallest inner diameter portion of the first casing string.

In another aspect, the present invention provides an apparatus for use in forming a cased wellbore comprising a casing string, an earth removal member operatively attached to a lower end of the casing string, and at least one compressible member disposed at a lower end of the casing string. In one embodiment, the earth removal member comprises a drillable material. In another embodiment, at least one compressible member includes a compressible material having at least one void formed therein. In another embodiment still, at least one compressible member is disposed around an outer surface of the casing string. In another embodiment still, at least one compressible member is disposed within a portion of the casing string having an enlarged inner diameter. In another embodiment still, at least one compressible member comprises a porous material.

In another embodiment still, at least one compressible member comprises a wall adjacent to the casing string and a plurality of compressible webs connecting the wall to the casing string. In another embodiment still, the plurality of compressible webs is moveable through a plurality of void areas between the plurality of webs.

In another embodiment, the present invention provides an apparatus for use in forming a cased wellbore comprising a casing string having an enlarged inner diameter portion; an earth removal member operatively connected to a lower end of the casing string; and a drillable portion disposed in the enlarged inner diameter portion. In one embodiment, the earth removal member comprises a drillable material. In another embodiment, the enlarged inner diameter portion is located at a lower end of the casing string. In another embodiment still, the drillable portion is constructed and arranged to become dislodged from the casing string when drilled with a second casing string having an outer diameter smaller than the enlarged inner diameter portion. In another embodiment still, the drillable portion is weakened by a plurality of voids formed therein. In another embodiment still, the plurality of voids formed in the drillable portion terminate at an inner surface of the enlarged inner diameter portion. In another embodiment still, at least a portion of the drillable portion includes a composite material.

In another embodiment, the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path. In one aspect, the method further comprises accomplishing the lowering, expanding, leaving, flowing, and closing in a single trip into the wellbore.

Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein closing the fluid path provides a seal between the first casing and the wellbore. Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein the fluid is setting fluid. In one embodiment, the setting fluid is cement.

Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein the at least a portion of the first casing is profiled and the fluid path comprises one or more fluid bypass areas formed in the profiled portion of the first casing. Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein the fluid path comprises one or more openings in the first casing to allow the setting fluid to flow into an annulus between the first casing and the wellbore. Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; closing the fluid path; and expanding at least a portion of an unexpanded portion of the first casing.

Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein a lower end of the first casing is expanded further radially than a remaining portion of the first casing. In one aspect, the first casing is bell-shaped. Another embodiment of the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; closing the fluid path; and lowering a second casing having an earth removal member operatively attached to its lower end into the formation to form a wellbore of a second depth. In one embodiment, the method further comprises expanding at least a portion of the second casing into gripping engagement with the wellbore to hang the second casing within the wellbore. In another embodiment, the method further comprises leaving a second fluid path between the second casing and the wellbore after expanding at least the portion of the second casing; flowing a setting fluid through the second fluid path; and closing the second fluid path.

In another embodiment, the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; and closing the fluid path, wherein closing the fluid path comprises expanding the fluid path into the wellbore. In another embodiment, the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; closing the fluid path, wherein a lower end of the first casing is expanded further radially than a remaining portion of the first casing; and lowering a second casing into the wellbore to a second depth and expanding the second casing into the first casing to form a substantially monobore well. In another embodiment, the present invention includes a method of forming a cased well, comprising lowering a first casing having an earth removal member operatively attached to its lower end into a formation to form a wellbore of a first depth; expanding at least a portion of the first casing into gripping engagement with the wellbore to hang the first casing within the wellbore; leaving a fluid path between the first casing and the wellbore after expanding at least the portion of the first casing; flowing a fluid through the fluid path; closing the fluid path; and rotating the first casing while lowering the first casing into the formation.

Another embodiment of the present invention includes a method of casing a wellbore, comprising lowering a first casing having an earth removal member operatively attached to its lower end into a formation to form a wellbore, the first casing having at least one bypass for circulating a fluid formed therein; expanding at least a portion of the first casing into frictional engagement with the wellbore to hang the first casing within the wellbore; circulating the fluid through the at least one bypass; and expanding the first casing to close the bypass. In one embodiment, a running string comprising a setting tool therein is disposed within the first casing to hang the first casing within the wellbore. In another embodiment, the running string further comprises an expander tool to close the bypass.

Another embodiment of the present invention includes a method of casing a wellbore, comprising lowering a first casing having an earth removal member operatively attached to its lower end into a formation to form a wellbore, the first casing having at least one bypass for circulating a fluid formed therein; expanding at least a portion of the first casing into frictional engagement with the wellbore to hang the first casing within the wellbore; circulating the fluid through the at least one bypass; and expanding the first casing to close the bypass, wherein a lower end of the first casing is expanded to a larger inner diameter than a remaining portion of the first casing. In one embodiment, the method further comprises lowering a second casing having an earth removal member operatively attached to its lower end into the formation to form the wellbore. In another embodiment, the method further comprises expanding the second casing into the first casing to form a substantially monobore well.

Another embodiment of the present invention includes an apparatus for use in drilling with casing, comprising a tubular string having a casing portion, an earth removal member operatively attached to its lower end, and at least one fluid bypass area located thereon; and an expansion tool disposed within the tubular string, the expansion tool capable of expanding a portion of the tubular string into a surrounding wellbore while leaving a flow path around an outer diameter of the tubular string to a surface of the wellbore. In one aspect, the at least one fluid bypass area comprises at least one longitudinal profile in the tubular string. In another aspect, the at least one fluid bypass area comprises at least one opening in the tubular string.

While the foregoing is directed to embodiments of the present invention, other and further embodiments of the invention may be devised without departing from the basic scope thereof, and the scope thereof is determined by the claims that follow.

We claim:

1. A method of forming a cased well, comprising:

lowering a first tubular having an earth removal member operatively attached to its lower end into a formation to form a first wellbore having a first length, at least a portion of the first tubular forming part of an undercut drillable cementing shoe, wherein the first tubular within the cementing shoe has, prior to the lowering, a first section with an enlarged inner diameter relative to a second section of the first tubular;

locating at least a portion of a second tubular within the first tubular, at least a portion of the second tubular comprising casing;

introducing a physically alterable bonding material into an annulus between the first tubular and the formation therearound; and expanding at least the portion of the second tubular against the first section of the first tubular so that at least the portion of the second tubular has an inner diameter at least as large as a smallest inner diameter portion of the first tubular.

2. The method of claim 1, wherein the second tubular has an earth removal member operatively attached to its lower end.

3. The method of claim 1, wherein locating at least a portion of the second tubular within the first tubular comprises lowering the second tubular into the formation to form a second wellbore of a second length.

4. The method of claim 3, wherein the first wellbore is a main wellbore and the second wellbore is a lateral wellbore.

5. The method of claim 4, wherein expanding at least the portion of the second tubular comprises expanding a portion of the lateral wellbore extending into the main wellbore.

6. The method of claim 4, wherein an inner diameter of the lateral wellbore is greater than or equal to an inner diameter of the main wellbore.

7. The method of claim 3, wherein the second tubular is expanded along its entire length to have an inner diameter at least as large as the smallest inner diameter portion of the first tubular.

8. The method of claim 1, wherein the first section is at a lower end of the first tubular.

9. The method of claim 8, wherein at least one compressible member is disposed within the first section of the first tubular.

10. The method of claim 9, wherein expanding at least the portion of the second tubular comprises compressing at least a portion of the at least one compressible member.

11. The method of claim 10, wherein compressing at least the portion of the at least one compressible member comprises moving a plurality of webs of the at least one compressible member through at least one void area.

12. The method of claim 1, wherein a drillable portion is disposed within the first section which is constructed and arranged to become dislodged from the first tubular when lowering the second tubular into the formation to form a second wellbore of a second length.

13. The method of claim 1, further comprising compressing at least one compressible member when expanding at least the portion of the second tubular.

14. The method of claim 13, wherein the at least one compressible member is compressed by expansion until at least the portion of the second tubular being expanded has an inner diameter at least as large as a smallest inner diameter portion of the first tubular.

15. The method of claim 1, wherein a portion of the first tubular surrounding the second tubular is expanded when expanding at least the portion of the second tubular.

16. The method of claim 1, wherein a compressible member is located at a lower end of the first tubular.

17. The method of claim 1, wherein the physically alterable bonding material is cement.

18. The method of claim 1, wherein said earth removal member comprises a drillable bit.

19. The method of claim 1, wherein said earth removal member comprises a retrievable bit.

* * * * *

UNITED STATES PATENT AND TRADEMARK OFFICE

CERTIFICATE OF CORRECTION

PATENT NO. : 7,413,020 B2
APPLICATION NO. : 10/794790
DATED : August 19, 2008
INVENTOR(S) : Carter et al.

It is certified that error appears in the above-identified patent and that said Letters Patent is hereby corrected as shown below:

On the Title Page
In the References Cited:

Item 56 please delete "1,585,089 A 5/1926 Youle" and insert --1,585,069 A 5/1926 Youle-- therefor;

Item 56 please delete "1,825,028 A 9/1931 Thomas" and insert --1,825,026 A 9/1931 Thomas-- therefor;

Item 56 please delete "2,383,214 A 8/1945 Proul" and insert --2,383,214 A 8/1945 Prout-- therefor;

Item 56 please delete "3,087,546 A 4/1963 Wooley" and insert --3,087,546 A 4/1963 Wolley-- therefor;

Item 56 please delete "3,467,180 A 9/1969 Pensolti" and insert --3,467,180 A 9/1969 Pensotti-- therefor;

Item 56 please delete "3,729,057 A 4/1973 Wemer" and insert --3,729,057 A 4/1973 Werner-- therefor;

Item 56 please delete "8,688,398 2/2004 Pietras" and insert --6,688,398 B2 2/2004 Pietras-- therefor;

Item 56 please delete "EP GB 2 329 918 4/1999" and insert --GB 2 329 918 4/1999-- therefor;

Item 56 please insert --A. S. JAFAR, H.H. AL-ATTAR, AND I. S. EL-AGELI, Discussion and Comparison of Performance of Horizontal Wells in Bouri Field, SPE 26927, Society of Petroleum Engineers, Inc. 1996--;

Item 56 please insert --G. F. BOYKIN, The Role of A Worldwide Drilling Organization and the Road to the Future, SPE/IADC 37630, 1997--;

Item 56 please insert --M. S. FULLER, M. LITTLER, and I. POLLOCK, Innovative Way To Cement a Liner Utitizing a New Inner String Liner Cementing Process, 1998--;

Item 56 please insert --HELIO SANTOS, Consequences and Relevance of Drillstring Vibration on Wellbore Stability, SPE/IADC 52820, 1999--;

UNITED STATES PATENT AND TRADEMARK OFFICE

CERTIFICATE OF CORRECTION

PATENT NO. : 7,413,020 B2
APPLICATION NO. : 10/794790
DATED : August 19, 2008
INVENTOR(S) : Carter et al.

It is certified that error appears in the above-identified patent and that said Letters Patent is hereby corrected as shown below:

Item 56 please insert --CHAN L. DAIGLE, DONALD B. CAMPO, CAREY J. NAQUIN, RUDY CARDENAS, LEV M. RING, PATRICK L. YORK, Expandable Tubulars: Field Examples of Application in Well Construction and Remediation, SPE 62958, Society of Petroleum Engineers Inc., 2000--;

Item 56 please insert --C. LEE LOHOEFER, BEN MATHIS, DAVID BRISCO, KEVIN WADDELL, LEV RING, and PATRICK YORK, Expandable Liner Hanger Provides Cost-Effective Alternative Solution, IADC/SPE 59151, 2000--;

Item 56 please insert --KENNETH K. DUPAL, DONALD B. CAMPO, JOHN E. LOFTON, DON WEISINGER, R. LANCE COOK, MICHAEL D. BULLOCK, THOMAS P. GRANT, and PATRICK L. YORK, Solid Expandable Tubular Technology-A Year of Case Histories in the Drilling Environment, SPE/IADC 67770, 2001--;

Item 56 please insert --MIKE BULLOCK, TOM GRANT, RICK SIZEMORE, CHAN DAIGLE, and PAT YORK, Using Expandable Solid Tubulars To Solve Well Construction Challenges In Deep Waters And Maturing Properties, IBP 27500, Brazilian Petroleum Institute-IBP, 2000--;

Item 56 please insert --Coiled Tubing Handbook, World Oil, Gulf Publishing Company, 1993--.

Signed and Sealed this

Twenty-eighth Day of April, 2009

John Doll

JOHN DOLL
*Acting Director of the United States Patent and Trademark Office*